US007860696B2

(12) United States Patent
Chen

(10) Patent No.: US 7,860,696 B2
(45) Date of Patent: Dec. 28, 2010

(54) METHODS AND SYSTEMS TO PREDICT ROTARY DRILL BIT WALK AND TO DESIGN ROTARY DRILL BITS AND OTHER DOWNHOLE TOOLS

(75) Inventor: Shilin Chen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

(21) Appl. No.: 12/333,824

(22) Filed: Dec. 12, 2008

(65) Prior Publication Data

US 2009/0090556 A1 Apr. 9, 2009

Related U.S. Application Data

(63) Continuation-in-part of application No. 11/462,918, filed on Aug. 7, 2006.

(60) Provisional application No. 60/706,321, filed on Aug. 8, 2005, provisional application No. 60/738,431, filed on Nov. 21, 2005, provisional application No. 60/706,323, filed on Aug. 8, 2005, provisional application No. 60/738,453, filed on Nov. 21, 2005, provisional application No. 61/013,859, filed on Dec. 14, 2007.

(51) Int. Cl.
*G06F 9/455* (2006.01)

(52) U.S. Cl. ..... 703/6; 703/10

(58) Field of Classification Search ..... 703/6, 703/10; 702/9; 175/408, 57, 393, 26, 24, 175/374; 76/108.2; 166/204
See application file for complete search history.

(56) References Cited

U.S. PATENT DOCUMENTS 1,209,299 A 12/1916 Hughes
1,263,802 A 4/1918 Reed (Continued)

FOREIGN PATENT DOCUMENTS

CN 2082755 U 8/1991

(Continued)

OTHER PUBLICATIONS

Dakun Ma & J.J. Azar, "A New Way to Characterize the Gouging-Scraping Action of Roller Cone Bits", Univ. of Tulsa, SPE 19448, 1989.

(Continued)

*Primary Examiner*—Paul L Rodriguez
*Assistant Examiner*—Kandasamy Thangavelu
(74) *Attorney, Agent, or Firm*—Baker Botts L.L.P.

(57) ABSTRACT

Methods and systems may be provided to simulate forming a wide variety of directional wellbores including wellbores with variable tilt rates, relatively constant tilt rates, wellbores with uniform generally circular cross-sections and wellbores with non-circular cross-sections. The methods and systems may also be used to simulate forming a wellbore in subterranean formations having a combination of soft, medium and hard formation materials, multiple layers of formation materials, relatively hard stringers disposed throughout one or more layers of formation material, and/or concretions (very hard stones) disposed in one or more layers of formation material. Values of bit walk rate from such simulations may be used to design and/or select drilling equipment for use in forming a directional wellbore.

28 Claims, 25 Drawing Sheets

U.S. PATENT DOCUMENTS

| | | | | |
|---|---|---|---|---|
| 1,394,769 | A | 10/1921 | Sorensen | |
| 1,847,981 | A | 3/1932 | Reed | |
| 2,038,866 | A | 4/1938 | Scott et al. | |
| 2,117,679 | A | 5/1938 | Reed | 255/71 |
| 2,122,759 | A | 7/1938 | Scott | 255/71 |
| 2,132,498 | A | 10/1938 | Smith | 255/71 |
| 2,165,584 | A | 7/1939 | Smith et al. | 255/71 |
| 2,230,569 | A | 2/1941 | Howard et al. | 255/71 |
| 2,496,421 | A | 2/1950 | Stokes | 255/71 |
| 2,728,559 | A | 12/1955 | Boice et al. | 255/334 |
| 2,851,253 | A | 9/1958 | Boice | 255/347 |
| 3,269,470 | A | 8/1966 | Kelly | |
| 4,056,153 | A | 11/1977 | Miglierini | 175/376 |
| 4,187,922 | A | 2/1980 | Phelps | 175/374 |
| 4,285,409 | A | 8/1981 | Allen | 175/336 |
| 4,334,586 | A | 6/1982 | Schumacher | 175/374 |
| 4,343,371 | A | 8/1982 | Baker, III et al. | 175/329 |
| 4,343,372 | A | 8/1982 | Kinzer | 175/374 |
| 4,393,948 | A | 7/1983 | Fernandez | 175/374 |
| 4,408,671 | A | 10/1983 | Munson | 175/377 |
| 4,427,081 | A | 1/1984 | Crawford | 175/376 |
| 4,455,040 | A | 6/1984 | Shin | |
| 4,512,426 | A | 4/1985 | Bidegaray | 175/329 |
| 4,611,673 | A | 9/1986 | Childers et al. | 175/340 |
| 4,627,276 | A | 12/1986 | Burgess et al. | 73/151 |
| 4,657,093 | A | 4/1987 | Schumacher | 175/353 |
| 4,738,322 | A | 4/1988 | Hall | |
| 4,776,413 | A | 10/1988 | Forsberg | |
| 4,804,051 | A | 2/1989 | Ho | 175/26 |
| 4,815,342 | A | 3/1989 | Brett et al. | 76/108 |
| 4,845,628 | A | 7/1989 | Gray et al. | 702/9 |
| 4,848,476 | A | 7/1989 | Deane et al. | 175/340 |
| 4,884,477 | A | 12/1989 | Smith et al. | |
| 4,889,017 | A | 12/1989 | Fuller et al. | 76/108 A |
| 5,004,057 | A | 4/1991 | Tibbitts | 175/408 |
| 5,010,789 | A | 4/1991 | Brett et al. | 76/108.2 |
| 5,027,913 | A | 7/1991 | Nquyen | 175/336 |
| 5,042,596 | A | 8/1991 | Brett et al. | 175/57 |
| 5,099,929 | A | 3/1992 | Keith et al. | 175/61 |
| 5,131,478 | A | 7/1992 | Brett et al. | 175/57 |
| 5,131,480 | A | 7/1992 | Lockstedt et al. | 175/374 |
| 5,137,097 | A | 8/1992 | Fernandez | 175/228 |
| 5,197,555 | A | 3/1993 | Estes | 175/374 |
| 5,216,917 | A | 6/1993 | Detournay | 73/151 |
| 5,224,560 | A | 7/1993 | Fernandez | 175/374 |
| RE34,435 | E | 11/1993 | Warren et al. | 175/398 |
| 5,258,755 | A | 11/1993 | Kuckes | 340/853.5 |
| 5,285,409 | A | 2/1994 | Hwangbo et al. | |
| 5,291,807 | A | 3/1994 | Vanderford | |
| 5,305,836 | A | 4/1994 | Holbrook et al. | 175/39 |
| 5,311,958 | A | 5/1994 | Isbell et al. | 175/341 |
| 5,318,136 | A | 6/1994 | Rowsell et al. | 175/24 |
| 5,341,890 | A | 8/1994 | Cawthorne et al. | 175/374 |
| 5,351,770 | A | 10/1994 | Cawthorne | |
| 5,370,234 | A | 12/1994 | Sommer, Jr. et al. | 209/44.1 |
| 5,372,210 | A | 12/1994 | Harrell | 175/431 |
| 5,394,952 | A | 3/1995 | Johns et al. | 175/332 |
| 5,415,030 | A | 5/1995 | Jogi et al. | 73/151 |
| 5,416,697 | A | 5/1995 | Goodman | 364/422 |
| 5,421,423 | A | 6/1995 | Huffstutler | 175/374 |
| 5,423,389 | A | 6/1995 | Warren et al. | |
| 5,435,403 | A | 7/1995 | Tibbits | |
| 5,456,141 | A | 10/1995 | Ho | 76/108.2 |
| 5,465,799 | A | 11/1995 | Ho | |
| 5,513,711 | A | 5/1996 | Williams | 175/57 |
| 5,579,856 | A | 12/1996 | Bird | 175/375 |
| 5,595,252 | A | 1/1997 | O'Hanlon | 175/57 |
| 5,595,255 | A | 1/1997 | Huffstutler | 175/331 |
| 5,605,198 | A | 2/1997 | Tibbitts et al. | 175/432 |
| 5,607,024 | A | 3/1997 | Keith et al. | 175/431 |
| 5,608,162 | A | 3/1997 | Ho | 73/152.48 |
| 5,636,700 | A | 6/1997 | Shamburger, Jr. | 175/331 |
| 5,697,994 | A | 12/1997 | Packer et al. | |
| 5,704,436 | A | 1/1998 | Smith et al. | 175/27 |
| 5,715,899 | A | 2/1998 | Liang et al. | 175/374 |
| 5,730,234 | A | 3/1998 | Putot | 175/50 |
| 5,767,399 | A | 6/1998 | Smith et al. | 73/152.11 |
| 5,787,022 | A | 7/1998 | Tibbitts et al. | 364/578 |
| 5,794,720 | A | 8/1998 | Smith et al. | 175/40 |
| 5,812,068 | A | 9/1998 | Wisler et al. | 340/855.5 |
| 5,813,480 | A | 9/1998 | Zaleski, Jr. et al. | 175/40 |
| 5,813,485 | A | 9/1998 | Portwood | 175/430 |
| 5,839,526 | A | 11/1998 | Cisneros et al. | 175/431 |
| 5,853,245 | A | 12/1998 | Price | |
| 5,937,958 | A | 8/1999 | Mensa-Wilmot et al. | 175/398 |
| 5,950,747 | A | 9/1999 | Tibbitts et al. | 175/432 |
| 5,960,896 | A | 10/1999 | Barr et al. | 175/431 |
| 5,967,245 | A | 10/1999 | Garcia et al. | |
| 5,967,247 | A * | 10/1999 | Pessier | 175/408 |
| 6,002,985 | A | 12/1999 | Stephenson | 702/13 |
| 6,003,623 | A | 12/1999 | Meiss | 175/430 |
| 6,012,015 | A | 1/2000 | Tubel | 702/6 |
| 6,021,377 | A * | 2/2000 | Dubinsky et al. | 702/9 |
| 6,021,859 | A | 2/2000 | Tibbitts et al. | 175/431 |
| 6,029,759 | A | 2/2000 | Sue et al. | 175/374 |
| 6,044,325 | A | 3/2000 | Chakravarthy et al. | 702/7 |
| 6,057,784 | A | 5/2000 | Schaaf et al. | 340/854.4 |
| 6,095,262 | A | 8/2000 | Chen | 175/57 |
| 6,095,264 | A | 8/2000 | Dillard | 175/331 |
| 6,109,368 | A | 8/2000 | Goldman et al. | 175/39 |
| 6,119,797 | A | 9/2000 | Hong et al. | 175/336 |
| 6,123,160 | A | 9/2000 | Tibbitts | |
| 6,123,161 | A | 9/2000 | Taylor | |
| 6,138,780 | A | 10/2000 | Beuershausen | |
| 6,142,247 | A | 11/2000 | Pessier | 175/340 |
| 6,173,797 | B1 | 1/2001 | Dykstra et al. | 175/374 |
| 6,176,329 | B1 | 1/2001 | Portwood et al. | 175/341 |
| 6,186,251 | B1 * | 2/2001 | Butcher | 175/393 |
| 6,206,117 | B1 | 3/2001 | Tibbitts et al. | 175/399 |
| 6,213,225 | B1 | 4/2001 | Chen | 175/57 |
| 6,241,034 | B1 | 6/2001 | Steinke et al. | 175/331 |
| 6,260,635 | B1 | 7/2001 | Crawford | 175/371 |
| 6,260,636 | B1 | 7/2001 | Cooley et al. | |
| 6,269,892 | B1 | 8/2001 | Boulton et al. | 175/61 |
| 6,302,223 | B1 | 10/2001 | Sinor | |
| 6,308,790 | B1 | 10/2001 | Mensa-Wilmot et al. | |
| 6,348,110 | B1 | 2/2002 | Evans | 148/528 |
| 6,349,595 | B1 | 2/2002 | Civolani et al. | 73/152.02 |
| 6,349,780 | B1 | 2/2002 | Beuershausen | |
| 6,374,930 | B1 | 4/2002 | Singh et al. | 175/374 |
| 6,401,839 | B1 | 6/2002 | Chen | 175/57 |
| 6,412,577 | B1 | 7/2002 | Chen | 175/57 |
| 6,424,919 | B1 | 7/2002 | Moran et al. | 702/6 |
| 6,499,547 | B2 | 12/2002 | Scott et al. | 175/374 |
| 6,516,293 | B1 | 2/2003 | Huang et al. | 703/10 |
| 6,527,068 | B1 | 3/2003 | Singh et al. | 175/431 |
| 6,533,051 | B1 | 3/2003 | Singh et al. | 175/371 |
| 6,550,548 | B2 | 4/2003 | Taylor | 175/45 |
| 6,581,699 | B1 | 6/2003 | Chen et al. | 175/61 |
| 6,607,047 | B1 | 8/2003 | Swadi et al. | |
| 6,619,411 | B2 | 9/2003 | Chen et al. | |
| 6,640,913 | B2 | 11/2003 | Lockstedt et al. | |
| 6,729,420 | B2 | 5/2004 | Mensa-Wilmot | |
| 6,785,641 | B1 | 8/2004 | Huang | 703/7 |
| 6,848,518 | B2 | 2/2005 | Chen et al. | 175/61 |
| 6,856,949 | B2 | 2/2005 | Singh et al. | 703/7 |
| 6,873,947 | B1 | 3/2005 | Huang et al. | 703/10 |
| 6,879,947 | B1 | 4/2005 | Glass | 703/10 |
| 7,020,597 | B2 | 3/2006 | Oliver et al. | 703/7 |
| 7,059,430 | B2 | 6/2006 | Singh et al. | |
| 7,079,996 | B2 | 7/2006 | Stewart et al. | 703/8 |
| 7,139,689 | B2 | 11/2006 | Huang | 703/7 |
| 7,147,066 | B2 | 12/2006 | Chen et al. | 175/61 |
| 7,188,685 | B2 | 3/2007 | Downton et al. | 175/61 |

| | | | | |
|---|---|---|---|---|
| 7,251,590 | B2 | 7/2007 | Huang et al. | 703/2 |
| 7,334,650 | B2 * | 2/2008 | Giroux et al. | 175/26 |
| 7,455,125 | B2 | 11/2008 | Sinor et al. | 175/40 |
| 2001/0030063 | A1 | 10/2001 | Dykstra et al. | |
| 2001/0042642 | A1 | 11/2001 | King | 175/40 |
| 2003/0178232 | A1 | 9/2003 | Mensa-Wilmot | 175/385 |
| 2004/0011159 | A1 * | 1/2004 | Meiners et al. | 76/108.2 |
| 2004/0045742 | A1 | 3/2004 | Chen | |
| 2004/0069531 | A1 | 4/2004 | McCormick et al. | 175/57 |
| 2004/0104053 | A1 | 6/2004 | Chen | |
| 2004/0143427 | A1 | 7/2004 | Huang et al. | 703/10 |
| 2004/0167762 | A1 | 8/2004 | Chen | |
| 2004/0216926 | A1 | 11/2004 | Dykstra et al. | 175/57 |
| 2004/0244982 | A1 | 12/2004 | Chitwood et al. | 166/347 |
| 2004/0254664 | A1 | 12/2004 | Centala et al. | 700/97 |
| 2005/0015230 | A1 | 1/2005 | Centala et al. | 703/10 |
| 2005/0096847 | A1 * | 5/2005 | Huang | 702/9 |
| 2005/0133272 | A1 | 6/2005 | Huang et al. | 175/327 |
| 2005/0145417 | A1 | 7/2005 | Radford et al. | 175/57 |
| 2005/0273302 | A1 | 12/2005 | Huang et al. | |
| 2005/0273304 | A1 | 12/2005 | Oliver et al. | 703/10 |
| 2006/0032674 | A1 | 2/2006 | Chen et al. | 175/372 |
| 2006/0048973 | A1 * | 3/2006 | Brackin et al. | 175/57 |
| 2006/0074616 | A1 | 4/2006 | Chen | 703/10 |
| 2006/0076132 | A1 * | 4/2006 | Nold et al. | 166/264 |
| 2006/0100836 | A1 * | 5/2006 | Singh | 703/10 |
| 2006/0149478 | A1 * | 7/2006 | Calhoun et al. | 702/9 |
| 2006/0149518 | A1 | 7/2006 | Oliver et al. | |
| 2006/0162967 | A1 * | 7/2006 | Brackin et al. | 175/374 |
| 2007/0005316 | A1 | 1/2007 | Paez | 703/10 |
| 2007/0021857 | A1 | 1/2007 | Huang | |
| 2007/0029111 | A1 * | 2/2007 | Chen | 175/24 |
| 2007/0029113 | A1 | 2/2007 | Felderhoff et al. | |
| 2007/0185696 | A1 | 8/2007 | Moran et al. | 703/10 |
| 2007/0192071 | A1 | 8/2007 | Huang et al. | 703/2 |
| 2007/0192074 | A1 | 8/2007 | Chen | 703/10 |
| 2009/0055135 | A1 | 2/2009 | Tang et al. | 703/1 |

FOREIGN PATENT DOCUMENTS

| | | | |
|---|---|---|---|
| EP | 0193361 | | 10/1989 |
| EP | 0384734 | A1 | 8/1990 |
| EP | 0511547 | A2 | 4/1992 |
| EP | 0511547 | A3 | 4/1992 |
| EP | 0511547 | B1 | 4/1992 |
| EP | 1006256 | | 6/2000 |
| GB | 2186715 | | 8/1987 |
| GB | 2241266 | A | 8/1991 |
| GB | 2 300 208 | A | 10/1996 |
| GB | 2305195 | A | 4/1997 |
| GB | 2327962 | | 2/1999 |
| GB | 2363409 | A | 6/2001 |
| GB | 2365899 | A | 2/2002 |
| GB | 2367578 | A | 4/2002 |
| GB | 2367579 | A | 4/2002 |
| GB | 2367626 | | 4/2002 |
| GB | 2384567 | | 7/2003 |
| GB | 2388857 | | 11/2003 |
| GB | 2400696 | | 10/2004 |
| RU | 1441051 | A2 | 1/1987 |
| RU | 1691497 | A1 | 4/1988 |
| RU | 1654515 | A1 | 6/1991 |
| RU | 1768745 | A1 | 9/1999 |
| WO | 2007/022185 | | 2/2007 |

OTHER PUBLICATIONS

Communication of Notice of Opposition filed Oct. 21, 2004, for Application No. 99945375.6-2315/1112433 through the EPO office in Munich, Germany.
Official Action for EP06789543.3, 3 pgs., Oct. 13, 2008.
Official Action for EP06789544.1, 4 pgs., Aug. 18, 2008.
International Search Report and Written Opinion, PCT/2008/058097, 10 pgs., Aug. 7, 2008.
International Search Report and Written Opinion, PCT/2008/064862, 10 pgs., Sep. 2, 2008.
TransFormation Bits; Sharp Solutions; ReedHycalog; www.ReedHycalog.com; pp. 8, 2004.
International Search Report and Written Opinion; PCT/US 08/86586; pp. 9, Jan. 30, 2009.
"Down Hole Tools", Halliburton Security DBS, © 2003 Halliburton, 8 pages, Mar. 2003.
"HyperSteer™ and FullDrift® Bits for Rotary Steerable Applications", Halliburton, Security DBS Drill Bits, Drilling and Formation Evaluation, © 2006 Halliburton, 6 pages, Jan. 2006.
European Office Action, Application No. 06 800 931.5, 3 pgs., Aug. 13, 2009.
Denise Valdez, 'Direction by Design' Software Modeling Capability Advances Directional PDC Bit Design to New Level, www.halliburton.com, 2 pages, Dec. 2007.
PCT International Search Report and Written Opinion, PCT/US2008/060468, 8 pages, Mailing Date Aug. 8, 2008.
Communication pursuant to Article 94(3) EPC, Application No. 06 789 544.1-1266, 4 pages, Aug. 18, 2008.
Bannerman "Walk Rate Prediction of Alwyn North Field by Means of Data Analysis and 3D Computer Model" SPE 20933 (pp. 471-476), Oct. 24, 1990.
Barton "Development of Stable PDC Bits for Specific Use on Rotary Steerable Systems" IADC/SPE 62779 (pp. 1-13), Sep. 13, 2000.
Behr et al. "3D PDC Bit Model Predicts Higher Cutter Loads" SPE Drilling & Completion (pp. 253-258), Dec. 1993.
Behr et al. "Three-Dimensional Modeling of PDC Bits" SPE/IADC 21928 (pp. 273-281), Mar. 14, 1991.
Glowka "Use of Single-Cutter Data in the Analysis of PDC Bit Designs: Part 1-Development of a PDC Cutting Force Model" SPE, Sandia Natl. Laboratories (pp. 797-849), Aug. 1989.
International Preliminary Report on Patentability, PCT/US2006/030804, 5 Pages, Mailing Date Feb. 21, 2008.
International Preliminary Report on Patentability, PCT/US2006/030830, 5 pages, Mailing Date Feb. 12, 2008.
Chen et al., "Reexamination of PDC Bit Walk in Directional and Horizontal Wells," IADC/SPE 112641, 12 pgs, Mar. 4, 2008.
Glowka "Development of a Method for Predicting the Performance and Wear of PDC Drill Bits" Sandia Natl. Laboratories (205 pages), Sep. 1987.
O' Hare et al., Design Index: A Systematic Method of PDC Drill Bit Selection, IADC/SPE 59112, 15 pages, 2000.
C.J. Perry, Directional Drilling With PDC Bits in the Gulf of Thailand, SPE 15616, 9 pages, 1986.
H.S. Ho, General Formulation of Drillstring Under Large Deformation and Its Use in BHA Analysis, SPE 15562, 12 pages, 1986.
Chen et al., Maximizing Drilling Performance With State-of-the-Art BHA Program, PSE/IADC 104502, 13 pages, 2007.
Menand, PDC Bit Classification According to Steerability, SPE Drilling & Completion, pp. 5-12, 2004.
Notification Concerning Transmittal of International Preliminary Report on Patentability for International Application No. PCT/US2006/030803 (4 pages), Mar. 3, 2008.
Sutherland et al. "Development & Application of Versatile and Economical 3D Rotary Steering Technology" AADE, Emerging Technologies (pp. 2-16), 2001.
J.S. Bannerman, Walk Rate Prediction on Alywn North Field by Means of Data Analysis and 3D Computer Model, SPE 20933, 6 pages, 1990.
Millhiem et al., Side Cutting Characteristics of Rock Bits and Stabilizers While Drilling, SPE 7518, 8 pages, 1978.
Chen et al., Modeling of the Effects of Cutting Structure, Impact Arrestor, and Gage Geometry on PDS Bit Steerability, AADE-07-NTC-10, 10 pages, 2007.
Hanson et al. "Dynamics Modeling of PDC Bits" SPE/IADC 29401 (pp. 589-604), Mar. 2, 1995.
Langeveld "PDC Bit Dynamics (Supplement to IADC/SPE 23867)" IADC/SPE 23873 (pp. 1-5), Feb. 21, 1992.
Langeveld "PDC Bit Dynamics" IADC/SPE 23867 (pp. 227-241), Feb. 21, 1992.
Menand et al. Classification of PDC Bits According to their Steerability SPE 79795 (pp. 1-13), Feb. 21, 2003.

Menand et al. "How the Bit Profile and Gages Affect the Well Trajectory" IADC/SPE 74459 (pp. 1-13), Feb. 28, 2002.
Millhiem et al. "Side Cutting Characteristics of Rock Bits and Stabilizers While Drilling" SPE 7518 (8 pages), Oct. 3, 1978.
Perry "Directional Drilling With PDC Bits in the Gulf of Thailand" SPE 15616 (9 pages), Oct. 8, 1986.
R.K. Dropek, "A Study to Determine Roller Cone Cutter Offset Effects at Various Drilling Depths" American Society of Mechanical Engineers. 10 pages, Aug. 1, 1979.
Halliburton Revolutionizes PDC Drill Bit Design with the Release of FM3000, 2003 Press Releases, 2 pgs, Aug. 8, 2005.
J.A. Norris, et al., "Development and Successful Application of Unique Steerable PDC Bits," Copyright 1998 IADC/SPE Drilling Confrence, 14 pgs, Mar. 3, 1998.
Drawing No. A460679 for Rock Bit and Hole Opener. 1 page, Sep. 14, 1946.
Halliburton catalogue item entitled: EZ-Pilot (TM) Rotary Steerable System (1 page), Jul. 24, 2006.
Halliburton catalogue item entitled: Geo-Pilot (R) Rotary Steerable System (1 page), Jul. 24, 2006.
Approved Judgement, Case No. HC 04 C 00114 00689 00690, Royal Courts of Justice, BEtween: Halliburton Energy Services, Inc. and (1) Smith International (North Sea) Limited (2) Smith International, Inc. (3) Smith International Italia SpA, Jul. 21, 2005.
W.C. Maurer, "The "Perfect-Cleaning" Theory of Rotary Drilling," Journal of Petroleum Technology, pp. 1175, 1270-1274, Nov. 1962.
Communication from European Patent Office regarding opposition; Application No. 99945376.4-1266/1117894 through the Munich office (5 pages), Feb. 15, 2006.
Notification of European Search Report for Patent Application No. EP 04025560.6-2315 (4 pages), Feb. 24, 2006.
J. P. Nguyen, "Oil and Gas Field Development Techniques: Drilling" (translation 1996, from French original 1993), 1993.
T.M. Warren et al, "*Drag*-Bit Performance Modeling", SPE Drill Eng. Jun. 1989, vol. 4, No. 2, pp. 119-127 15618, XP002266079, Jun. 1989.
"Making Hole", part of Rotary Drilling Series, edited by Charles Kirkley, 1983.
T.M. Warren,"Factors Affecting Torque for A Roller Cone Bit", JPT J PET Technol Sep. 1984, vol. 36, No. 10, pp. 1500-1508, XP002266078, Sep. 1984.
"Drilling Mud", part of Rotary Drilling Series, edited by Charles Kirkley, 1984.
Ma. D., et al. "A New Method for Designing Rock Bit", SPE Proceedings, vol. 22431, XP008058830, 10 pages, Mar. 24, 1992.
Notification of Eurpean Search Report for Patent Application No. EP 04025561.4-2315 (4 pages), Feb. 24, 2006.
Notification of European Search Report for Patent Application No. EP 04025562.2-2315 (4 pages), Feb. 24, 2006.
Notification of European Search Report for Patent Application No. EP 04025232.2-2315 (4 pages), Feb. 24, 2006.
Sikarskie, et. al., "Penetration Problems in Rock Mechanics", American Society of Mechanical Engineers, Rock Mechanics Symposium, 1973.
Dykstra, et. al., "Experimental Evaluations of Drill String Dynamics", Amoco Report No. SPE 28323, 1994.
Decision revoking European Patent No. EP-B-1117894, 16 pgs., May 15, 2006.
Wilson C. Chin, Wave Propagation in Petroleum Engineering, 1994.
Notification of Great Britain Search Report for Application No. GB 0523735.9 (3 pages), Jan. 31, 2006.
Kenner and Isbell, "Dynamic Analysis Reveals Stability of Roller Cone Rock Bits", SPE 28314, 1994.
H.G. Benson, "Rock Bit Design, Selection and Evaluation", presented at the spring meeting of the pacific coast district, American Petroleum Institute, Division of Production, Los Angeles, May 1956.
Dma & J.J. Azar, A New Way to Characterize the Gouging-Scraping Action of Roller Cone Bits, 1989.
Brochure entitled "FS2000 Series-New Steel Body Technology Advances PDC Bit Performance and Efficiency", Security DBS, Dresser Industries, Inc. (6 pages), 1997.
U.S. Appl. No. 10/325,650, filed Dec. 19, 2002 by John G. Dennis, entitled Drilling with Mixed Tooth Types.
Communication of Notice of Opposition filed Oct. 21, 2004, for Application No. 99945375.6-2315/1112433 through the EPO office in Munich, Germany, 2004.
Dekun Ma et al., The Computer Simulation of the Interaction Between Roller Bit and Rock, pp. 309-317, 1995.
Longer Useful Lives for Roller Bits Cuts Sharply into Drilling Costs, South African Mining & Engineering Journal, vol. 90, pp. 39-43, Mar. 1979.
F.A.S.T.™ Technology Brochure entitled "Tech Bits", Security/Dresser Industries (1 page), Sep. 17, 1993.
MA Dekun, The Operational Mechanics of the Rock Bit, Petroleum Industry Press, Beijing, China, 1996.
Shilin Chen, Linear and Nonlinear Dynamics of Drillstrings, 1994-1995.
D. Ma, & J.J. Azar, Dynamics of Roller Cone Bits, Dec. 1985.
D.K. Ma & S.L. Yang, Kinamatics of the Cone Bit, Jun. 1985.
L.E. Hibbs, Jr., et al, Diamond Compact Cutter Studies for Geothermal Bit Design, Nov. 1978.
Brief Communication from European Patent Office enclosing letter from the opponent of Oct. 13, 2004, Oct. 22, 2004.
J.C. Estes, "*Selecting the Proper Rotary Rock Bit*", JPT, pp. 1359, Nov. 1971.
"Twist & Shout" Brochure by Smith Bitts a business unit of Smith International, Inc. 4 pages, 2001.
D.K. Ma, "A New Method of Description of Scraping Characteristics of Roller cone Bit" Petroleum Machinery (in Chinese); Also attached is the English translation, "New Method for Characterizing the Scraping-Chiseling Performance of Rock Bits", Jul. 1988.
"Machino Export", Russia, 4 pages, 1974.
Steklyanov, B.L. et al.; "Improving the Effectiveness of Drilling Tools", Central Institute for Scientific and Technical Information and Technical and Economic Research on Chemical and Petroleum Machine Building, Series KhM-3, (in Russian) Moscow, 1991, 34 pages, also attached is English translation, 1991.
D Stroud et al., "Development of the Industry's First Slimhole Point-the-Bit Rotary Steerable System," Society of Petroleum Engineers Inc, 4 pgs, 2003.
British Search Report for GB Patent Application No. 0504304.7, 4 pgs, Apr. 22, 2005.
British Search Report for GB Patent Application No. 0503934.2, 3 pgs, May 16, 2005.
Brief Communication from European Patent Office enclosing letter from the opponent dated Dec. 2, 2004.
Notification of European Search Report for Patent application No. 04025232.5-2315, pages, Apr. 4, 2006.
Notification of European Search Report for Patent application No. 04025234.8-2315, 3 pages, Apr. 4, 2006.
Notification of European Search Report for Patent application No. 04025233.0-2315, 3 pages, Apr. 11, 2006.
Russian bit catalog listing items "III 190,5 T-LIB-1" and "III 109,5 TKZ-LIB", prior 1997.
Sikarskie, et. al., "Penetration Problems in Rock Mechanics", American Society of Mechanical Engineers, Rock Mechanics Symposium, 1973.
FM2000, Tomorrow's Technology for Today's Drilling, Security DBS, 2 pgs, 1991.
International Search Report, PCT/US2006/030804, 11 pgs, Mailing Date Dec. 19, 2006.
O. Vincke, et al., "Interactive Drilling: The Up-To-Date Drilling Technology," Oil & Gas Science and Technology Rev. IFP, vol. 59, No. 4, pp. 343-356, Jul. 2004.
Halliburton catalogue item entitled: SlickBore (R) Matched Drilling System (1 page), Jul. 24, 2006.
Notification of Great Britain Search Report for Application No. GB 0516638.4 (4 pages), Jan. 5, 2006.
Patent Acts 1977: Error in Search Report, Application No. GB0516638.4, 2 pgs, May 24, 2006.
Specification sheet entitled "SQAIR Quality Sub-Specification", Shell Internationale Petroleum Mij. B.V., The Hauge, The Netherlands, 1991 (2 Pages), 1991.
M.C. Sheppard, et al., "Forces at the Teeth of a Drilling Rollercone Bit: Theory and Experiment", Proceedings: 1988 SPE Annual Technical Conference and Exhibition; Houston, TX, USA, Oct. 2-5, 1988, vol. Delta, 1988, pp. 253-260 18042, XP002266080, Soc. Pet Eng AIME Pap SPE 1988 Publ by Soc of Petroleum Engineers of AIME, Richardson, TX, USA, 1988.
Adam T. Bourgoyne Jr et. al., "Applied Drilling Engineering", Society of Petroleum Engineers Textbook Series, 1991.
Lecture Handouts, Rock Bit Design, Dull grading, Selection and Application, presented by Reed Rock bit Company, Oct. 16, 1980.
Rabia, H., Oilwell Drilling Engineering: Principles and Practice, University of Newcastle upon Tyne, 331 pages, 1985.
Plaintiffs Original Complaint for Patent Infringement and Jury Demand, filed Sep. 6, 2002 in the United States District Court for the Eastern District of Texas, Sherman Division, Civil Action No. 4-02CV269, *Halliburton Energy Services, Inc.* v. *Smith International, Inc.,* 4 pages, Sep. 6, 2002.
Response of Plaintiff and Counterclaim Defendant to Defendant's Counterclaim of Declaratory Judgment, filed Apr. 3, 2003. in the United States District Court for the Eastern District of Texas, Sherman Division, Civil Action No. 4-02CV269, *Halliburton Energy Services, Inc.* v. *Smith International, Inc.*, 3 pages, Apr. 3, 2003.
Answer and Counterclaim of Smith International, filed Mar. 14, 2003, in the United States District Court for the Eastern District of Texas, Sherman Division, Civil Action No. 4-02CV269, *Halliburton Energy Services, Inc.* v. *Smith International, Inc.*, 6 pages, Mar. 14, 2003.
First Amended Answer and Counterclaim of Smith International, filed Oct. 9, 2003, in the United States District Court for the Eastern District of Texas, Sherman Division, Civil Action No. 4-02CV269, *Halliburton Energy Services, Inc.* v. *Smith International, Inc*., 8 pages, Oct. 9, 2003.
Memorandum Opinion of Judge Davis, signed Feb. 13, 2004, in the United States District Court for the Eastern District of Texas, Sherman Division, Civil Action No. 4-02CV269. *Halliburton Energy Services, Inc.* v. *Smith International, Inc*., 37 pages (including fax coversheet), Feb. 19, 2004.
Final Judgment of Judge Davis, signed Aug. 13, 2004, in the United States District Court for the Eastern District of Texas, Sherman Division, Civil Action No. 4-02CV269, *Halliburton Energy Services, Inc.* v. *Smith International, Inc.* , 3 pages, Aug. 13, 2004.
Sworn written statement of Stephen Steinke and Exhibits SS-1 to SS-6, Oct. 13, 2004.
International Search Report, PCT/US2006/030830, 11 pages, Mailing Date Dec. 19, 2006.
Menand et al., Classification of PDC Bits According to their Steerability, SPe, 11 pgs, 2003.
International Search Report, PCT/US2006/030803, 11 pgs, Mailing date Dec. 19, 2006.
Hare et al., Design Index: A Systematic Method of PDC Drill-Bit Selection, SPe, 15 pgs, 2000.
Pastusek et al., A Fundamental Model for Prediction of Hole Curvature and Build Rates With Steerable Bottomhole Assemblies, SPE, 8 pgs, 2005.
Composite Catalog of Oil Filed Equipment & Services, 27th Revision 1666-67 vol. 3, 1966.
European Office Action; Application No. 06 789 544.1; pp. 3, Aug. 12, 2009.
International Preliminary Report on Patentability; PCT/US2008/060468; pp. 7, Oct. 29, 2009.
Final Technical Report, "'P.A.B. Bit,' Predetermined Azimuthal Behavior of PDC Bits," Contract No. OG/222/97, Gerth, SecurityDBS, Armines and TotalFinalElf (46 pages), Jan. 1998.
Menand et al., "PDC Bit Classification According to Steerability" SPE Drilling & Completion (pp. 5-12), Mar. 2004.
Menand et al., "How Bit Profile and Gauges Affect Well Trajectory, SPE Drilling & Completion" (pp. 34-41, Mar. 2003.
Energy Balanced Series Roller Cone Bits, www. halliburton.com/oil_gas/sd1380.jsp, 1 page, printed Dec. 24, 2003.

* cited by examiner

METHODS AND SYSTEMS TO PREDICT ROTARY DRILL BIT WALK AND TO DESIGN ROTARY DRILL BITS AND OTHER DOWNHOLE TOOLS

RELATED APPLICATIONS

This application is a continuation-in-part application of the application entitled "Methods and Systems For Designing and/or Selecting Drilling Equipment With Desired Drill Bit Steerability," application Ser. No. 11/462,918 filed Aug. 7, 2006, which claims the benefit of the four Provisional Applications as follows: 1) Provisional patent application entitled "Methods and Systems of Rotary Drill Bit Steerability Prediction, Rotary Drill Bit Design and Operation," Application Ser. No. 60/706,321 filed Aug. 8, 2005; (2) Provisional patent application entitled "Methods and Systems of Rotary Drill Bit Walk Prediction, Rotary Drill Bit Design and Operation," Application Ser. No. 60/738,431 filed Nov. 21, 2005; (3) Provisional patent application entitled "Methods and Systems of Rotary Drill Bit Walk Prediction, Rotary Drill Bit Design and Operation," Application Ser. No. 60/706,323 filed Aug. 8, 2005; and (4) Provisional patent application entitled "Methods and Systems of Rotary Drill Steerability Walk Prediction, Rotary Drill Bit Design and Operation," Application Ser. No. 60/738,453 filed Nov. 21, 2005.

This application claims the benefit of provisional patent application entitled "Rotary Drill Bit Steerability Prediction and Design Using Wellbore Configuration" Application Ser. No. 61/013,859 filed Dec. 14, 2007.

TECHNICAL FIELD

The present disclosure is related to rotary drill bits and particularly to fixed cutter drill bits having blades with cutting elements and gage pads disposed therein, roller cone drill bits and associated components.

BACKGROUND OF THE DISCLOSURE

Various types of rotary drill bits have been used to form wellbores or boreholes in downhole formations. Such wellbores are often formed using a rotary drill bit attached to the end of a generally hollow, tubular drill string extending from an associated well surface. Rotation of a rotary drill bit progressively cuts away adjacent portions of a downhole formation using cutting elements and cutting structures disposed on exterior portions of the rotary drill bit. Examples of rotary drill bits include fixed cutter drill bits or drag drill bits, impregnated diamond bits and matrix drill bits. Various types of drilling fluids are generally used with rotary drill bits to form wellbores or boreholes extending from a well surface through one or more downhole formations.

Various types of computer based systems, software applications and/or computer programs have previously been used to simulate forming wellbores including, but not limited to, directional wellbores and to simulate performance of a wide variety of drilling equipment including, but not limited to, rotary drill bits which may be used to form such wellbores. Some examples of such computer based systems, software applications and/or computer programs are discussed in various patents and other references listed on Information Disclosure Statements filed during prosecution of this patent application.

Various types of rotary drill bits, reamers, stabilizers and other downhole tools may be used to form a borehole in the earth. Examples of such rotary drill bits include, but are not limited to, fixed cutter drill bits, drag bits, PDC drill bits, matrix drill bits, roller cone drill bits, rotary cone drill bits and rock bits used in drilling oil and gas wells. Cutting action associated with such drill bits generally requires weight on bit (WOB) and rotation of associated cutting elements into adjacent portions of a downhole formation. Drilling fluid may also be provided to perform several functions including washing away formation materials and other downhole debris from the bottom of a wellbore, cleaning associated cutting elements and cutting structures and carrying formation cuttings and other downhole debris upward to an associated well surface.

Some prior art rotary drill bits have been formed with blades extending from a bit body with a respective gage pad disposed proximate an uphole edge of each blade. Gage pads have been disposed at a positive angle or positive taper relative to a rotational axis of an associated rotary drill bit. Gage pads have also been disposed at a negative angle or negative taper relative to a rotational axis of an associated rotary drill bit. Such gage pads may sometimes be referred to as having either a positive "axial" taper or a negative "axial" taper. See for example U.S. Pat. No. 5,967,247. The rotational axis of a rotary drill bit will generally be disposed on and aligned with a longitudinal axis extending through straight portions of a wellbore formed by the associated rotary drill bit. Therefore, the axial taper of associated gage pads may also be described as a "longitudinal" taper.

The phenomenon of bit walk, particularly when drilling a directional wellbore, has been observed in the oil and gas industry for many years. It is widely accepted that roller cone drill bits will generally have a tendency to "walk right" relative to a longitudinal axis being formed by the associated roller cone drill bit. It has also been widely accepted that fixed cutter drill bits, sometimes referred to as "PDC bits," may often have a tendency to walk left relative to a longitudinal axis of a wellbore formed by an associated fixed cutter drill bit.

Some prior models used to simulate drilling wellbores often failed to explain why fixed cutter drill bits walk right and may even have very large right walk rates under some specific conditions. For example, prior field reports have noted that some fixed cutter drill bits have a strong tendency to walk right when building angle during forming a directional wellbore segment.

For many downhole drilling conditions, bit walk and particularly excessive amounts of bit walk are not desired. Bit walk may generally increase drag on an associated drill string while forming a directional wellbore. Excessive amounts of bit walk may also result in damage to an associated drill string and/or "sticking" of the drill string with adjacent portions of a wellbore. Excessive amounts of bit walk may also result in forming a tortuous wellbore which may create problems while installing an associated casing string or other well completion problems. In many drilling applications, bit walk should be avoided and/or substantially minimized whenever possible.

SUMMARY OF THE DISCLOSURE

In accordance with teachings of the present disclosure, rotary drill bits and associated components including fixed cutter drill bits and near bit stabilizers and/or sleeves may be designed with bit walk characteristics, steerability and/or controllability optimized for a desired wellbore profile and anticipated downhole drilling conditions. Alternatively, rotary drill bits and associated components including fixed cutter drill bits and near bit stabilizers and/or sleeves with desired bit walk characteristics, steerability and/or controllability may be selected from existing designs based on a desired wellbore profile and anticipated downhole drilling conditions. Computer models incorporating teachings of the present disclosure may calculate bit walk force, bit walk rate and bit walk angle based at least in part on bit cutting structure, bit gage geometry, hole size, hole geometry, rock compressive strength, steering mechanism of an associated directional drilling system, bit rotational speed, penetration rate and dogleg severity.

Methods and systems incorporating teachings of the present disclosure may be used to simulate interaction between cutting structure of a rotary drill bit, associate gage pads, a near bit stabilizer or sleeve and adjacent portions of a downhole formation. Such methods and systems may consider various types of downhole drilling conditions including, but not limited to, bit tilt motion, rock inclination, formation strength (both hard, medium and soft), transition drilling while forming non-vertical portions of a wellbore, and wellbores with non-circular cross-sections. Calculations of bit walk represent only one portion of the information which may be obtained from simulating forming a wellbore in accordance with teachings of the present disclosure.

One aspect of the present disclosure may include a three dimensional (3D) model which considers bit tilting motion, bit walk rate and/or bit steerability for use in design or selection of rotary drill bits and associated components including, but not limited to, short gage pads, long gage pads, near bit stabilizers and/or sleeves. Methods and systems incorporating teachings of the present disclosure may also be used to select the type of directional drilling system such as point-the-bit steerable systems or push-the-bit rotary steerable systems.

One aspect of the present disclosure may include determining bit walk rate and/or bit steerability in various portions of a wellbore based at least in part on a rate of change in degrees (tilt rate) of the wellbore from vertical, steer forces and/or downhole formation inclination. Multiple kick off sections, building sections, holding sections and/or dropping sections may form portions of a complex directional wellbore. Systems and methods incorporating teachings of the present disclosure may be used to simulate drilling various types of wellbores and segments of wellbores using both push-the-bit directional drilling systems and point-the-bit directional drilling systems.

Systems and methods incorporating teachings of the present disclosure may be used to design rotary drill bits and/or components of an associated bottomhole assemblies with optimum bit walk characteristics and/or steerability characteristics for drilling a wellbore profile. Such systems and methods may also be used to select a rotary drill bit and/or components of an associated bottomhole assembly (BHA) from existing designs with optimum steerability characteristics for drilling a wellbore profile.

Another aspect of the present disclosure may include evaluating various mechanisms associated with "bit walk" in directional wellbores to numerically model directional steering systems, rotary drill bits and/or associated components. Such models have shown that oversized wellbores and/or wellbores with non-circular cross sections may be a major cause of fixed cutter drill bits walking right. Oversized wellbores and/or non-circular wellbores often require large deflection of a rotary drill bit by an associated rotary steering unit to satisfactorily direct the rotary drill bit along a desired trajectory or path to form the directional wellbore. Large deflections may create a side force in the magnitude of thousands of pounds at a contact location point associated with contact between exterior portions of a stabilizer or near bit sleeve. This side force due to BHA deflection may lead to bit walk right. Another right walk force may be generated at the same contact location due to the interaction between near bit stabilizer or near bit sleeve and adjacent portions of the wellbore. To reduce or avoid undesired right walk forces, teachings of the present disclosure may be used to reduce side forces at such contact location. One solution to reduce the BHA side forces may be redesigning the locations of one or more stabilizers along the BHA. Another solution to reduce undesired interaction between a near bit sleeve and/or gage pads with a wellbore may be increasing width of the gage pads, increasing spiral angle of the gage pads, rounding the leading edge of each blade disposed on the sleeve and/or reducing the friction coefficient between exterior portions of the near bit sleeve and the wellbore.

Bit walk problems may be solved using teachings of the present disclosure. Bit steerability may also be improved. PDC bit walk may depend on many factors including, but not limited to, cutting structure geometry, gage/sleeve geometry, steering mechanism of a rotary steerable system, BHA configuration, downhole formation type and anisotropy, hole enlargement and hole shape. Computer models incorporating teachings of the present disclosure may be used to predict bit walk characteristics, including walk force, walk angle and walk rate. Bit walk characteristics may be substantial different for the same drill bit forming the same wellbore in the same downhole formation depending on whether a point-the-bit or a push-the-bit rotary steerable system is used.

BRIEF DESCRIPTION OF THE DRAWINGS

A more complete and thorough understanding of the present disclosure and advantages thereof may be acquired by referring to the following description taken in conjunction with the accompanying drawings, in which like reference numbers indicate like features, and wherein.

DETAILED DESCRIPTION OF THE INVENTION

Figure 1A:
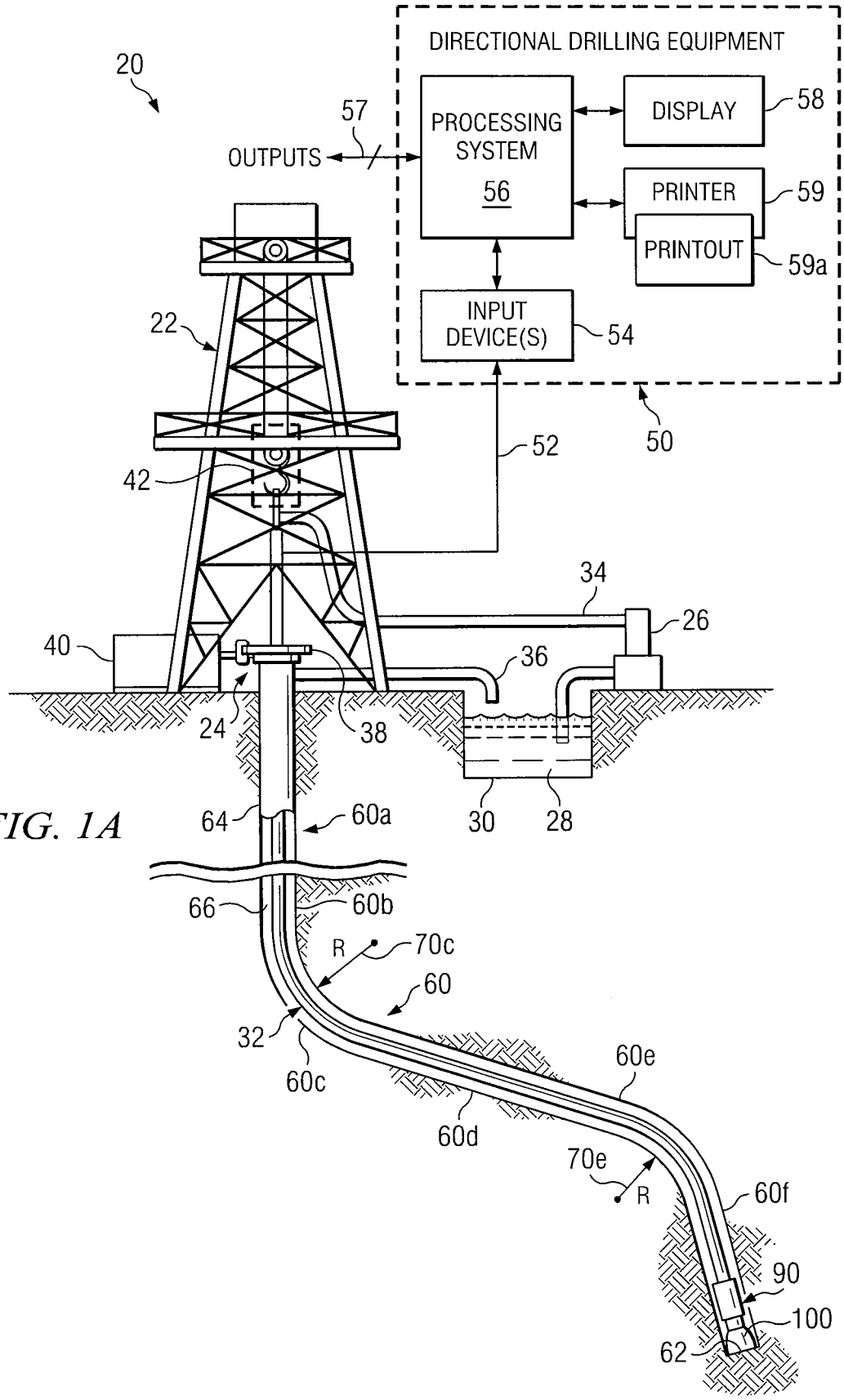
FIG. 1A is a schematic drawing in section and in elevation with portions broken away showing one example of a directional wellbore which may be formed by a drill bit designed in accordance with teachings of the present disclosure or selected from existing drill bit designs in accordance with teachings of the present disclosure.

Preferred embodiments of the invention and its advantages are best understood by reference to FIGS. 1A-18G wherein like number refer to same and like parts.

The terms "axial taper" or "axially tapered" may be used in this application to describe various components or portions of a rotary drill bit, sleeve, near bit stabilizer, other downhole tool and/or components such as a gage pad disposed at an angle relative to an associated bit rotational axis.

The term "bottom hole assembly" or "BHA" may be used in this application to describe various components and assemblies disposed proximate a rotary drill bit at the downhole end of a drill string. Examples of components and assemblies (not expressly shown) which may be included in a BHA include, but are not limited to, a bent sub, a downhole drilling motor, a near bit reamer, stabilizers and downhole instruments. A BHA may also include various types of well logging tools (not expressly shown) and other downhole tools associated with directional drilling of a wellbore. Examples of such logging tools and/or directional drilling tools may include, but are not limited to, acoustic, neutron, gamma ray, density, photoelectric, nuclear magnetic resonance, rotary steering tools and/or any other commercially available well tool.

The terms "cutling element" and "cutting elements" may be used in this application to include, but are not limited to, various types of cutters, compacts, buttons, inserts and gage cutters satisfactory for use with a wide variety of rotary drill bits. Impact arrestors may be included as part of the cutting structure on some types of rotary drill bits and may sometimes function as cutting elements to remove formation materials from adjacent portions of a wellbore. Polycrystalline diamond compacts (PDC) and tungsten carbide inserts are often used to form cutting elements or cutters. Various types of other hard, abrasive materials may also be satisfactorily used to form cutting elements or cutters.

The term "cutting structure" may be used in this application to include various combinations and arrangements of cutting elements, impact arrestors and/or gage cutters formed on exterior portions of a rotary drill bit. Some rotary drill bits may include one or more blades extending from an associated bit body with cutters disposed of the blades. Such blades may also be referred to as "cutter blades". Various configurations of blades and cutters may be used to form cutting structures for a rotary drill bit.

The terms "downhole" and "uphole" may be used in this application to describe the location of various components of a rotary drill bit relative to portions of the rotary drill bit which engage the bottom or end of a wellbore to remove adjacent formation materials. For example an "uphole" component may be located closer to an associated drill string or BHA as compared to a "downhole" component which may be located closer to the bottom or end of the wellbore.

The term "gage pad" as used in this application may include a gage, gage segment, gage portion or any other portion of a rotary drill bit incorporating teachings of the present disclosure. Gage pads may be used to define or establish a nominal inside diameter of a wellbore formed by an associated rotary drill bit. A gage, gage segment, gage portion or gage pad may include one or more layers of hardfacing material. One or more gage cutters, gage inserts, gage compacts or gage buttons may be disposed on or adjacent to a gage, gage segment, gage portion or gage pad in accordance with teachings of the present disclosure.

The term "rotary drill bit" may be used in this application to include various types of fixed cutter drill bits, drag bits, matrix drill bits, steel body drill bits, roller cone drill bits, rotary cone drill bits and rock bits operable to form a wellbore extending through one or more downhole formations. Rotary drill bits and associated components formed in accordance with teachings of the present disclosure may have many different designs, configurations and/or dimensions.

Simulating drilling a wellbore in accordance with teachings of the present disclosure may be used to optimize the design of various features of a rotary drill bit including, but not limited to, the number of blades or cutter blades, dimensions and configurations of each cutter blade, configuration and dimensions of junk slots disposed between adjacent cutter blades, the number, location, orientation and type of cutters and gages (active or passive) and length of associated gages. The location of nozzles and associated nozzle outlets may also be optimized.

A rotary drill bit or other downhole tool may be described as having multiple components, segments or portions for purposes of simulating forming a wellbore in accordance with teachings of the present disclosure. For example, one component of a fixed cutter drill bit may be described as a "cutting face profile" or "bit face profile" responsible for removal of formation materials to form an associated wellbore. For some types of fixed cutter drill bits the "cutting face profile" or "bit face profile" may be further divided into three segments such as "inner cutters or cone cutters", "nose cutters" and/or "shoulder cutters". See for example cone cutters 130*c*, nose cutters 130*n* and shoulder cutters 130*s* in FIG. 6B.

Various teachings of the present disclosure may also be used to design and/or select other types of downhole tools. For example, a stabilizer or sleeve located relatively close to a rotary drill bit may function similar to a passive gage or an active gage. A near bit reamer (not expressly shown) located relatively close to a rotary drill bit may function similar to cutters and/or an active gage portion.

One difference between a "passive gage" and an "active gage" is that a passive gage will generally not remove formation materials from the sidewall of a wellbore or borehole while an active gage may at least partially cut into the sidewall of a wellbore or borehole during directional drilling. A passive gage may deform a sidewall plastically or elastically during directional drilling. Active gage cutting elements generally contact and remove formation material from sidewall portions of a wellbore. For active and passive gages the primary force is generally a normal force which extends generally perpendicular to the associated gage face either active or passive.

Aggressiveness of a typical cutting element disposed on a fixed cutter drill bit may be mathematically defined as one (1.0). Aggressiveness of a passive gage on a fixed cutter drill bit may be mathematically defined as nearly zero (0). Aggressiveness of an active gage disposed on a fixed cutter drill bit may have a value between 0 and 1.0 depending on dimensions and configuration of each active gage element.

Aggressiveness of gage elements may be determined by testing and may be inputted into a simulation program such as represented by FIGS. 18A-18G. Similar comments apply with respect to near bit stabilizers, near bit reamers, sleeves and other components of a BHA which contact adjacent portions of a wellbore.

The term "straight hole" may be used in this application to describe a wellbore or portions of a wellbore that extends at generally a constant angle relative to vertical. Vertical wellbores and horizontal wellbores are examples of straight holes.

The terms "slant hole" and "slant hole segment" may be used in this application to describe a straight hole formed at a substantially constant angle relative to vertical. The constant angle of a slant hole is typically less than ninety (90) degrees and greater than zero (0) degrees.

Most straight holes such as vertical wellbores and horizontal wellbores with any significant length will have some variation from vertical or horizontal based in part on characteristics of associated drilling equipment used to form such wellbores. A slant hole may have similar variations depending upon the length and associated drilling equipment used to form the slant hole.

The term "kick off segment" may be used to describe a portion or section of a wellbore forming a transition between the end point of a straight hole segment and the first point where a desired DLS or tilt rate is achieved. A kick off segment may be formed as a transition from a vertical wellbore to an equilibrium wellbore with a constant curvature or tilt rate. A kick off segment of a wellbore may have a variable curvature and a variable rate of change in degrees from vertical (variable tilt rate).

The term "directional wellbore" may be used in this application to describe a wellbore or portions of a wellbore that extend at a desired angle or angles relative to vertical. Such angles are greater than normal variations associated with straight holes. A directional wellbore sometimes may be described as a wellbore deviated from vertical.

Sections, segments and/or portions of a directional wellbore may include, but are not limited to, a vertical section, a kick off section, a building section, a holding section (sometimes referred to as a "tangent section") and/or a dropping section. Vertical sections may have substantially no change in degrees from vertical. Build segments generally have a positive, constant rate of change in degrees. Drop segments generally have a negative rate constant of change in degrees. Holding sections such as slant holes or tangent segments and horizontal segments may extend at respective fixed angles relative to vertical and may have substantially zero rate of change in degrees from vertical.

Transition sections formed between straight hole portions of a wellbore may include, but are not limited to, kick off segments, building segments and dropping segments. Such transition sections generally have a rate of change in degrees either greater than or less than zero. The rate of change in degrees may vary along the length of all or portions of a transition section or may be substantially constant along the length of all or portions of the transition section.

A building segment having a relatively constant radius and a relatively constant change in degrees from vertical (constant tilt rate) may be used to form a transition from vertical segments to a slant hole segment or horizontal segment of a wellbore. A dropping segment may have a relatively constant radius and a relatively constant change in degrees from vertical (constant tilt rate) may be used to form a transition from a slant hole segment or a horizontal segment to a vertical segment of a wellbore. See FIG. 1A. For some applications a transition between a vertical segment and a horizontal segment may only be a building segment having a relatively constant radius and a relatively constant change in degrees from vertical. See FIG. 1B. Building segments and dropping segments may also be described as "equilibrium" segments.

The terms "dogleg severity" or "DLS" may be used to describe the rate of change in degrees of a wellbore from vertical during drilling of the wellbore. DLS is often measured in degrees per one hundred feet (°/100 ft). A straight hole, vertical hole, slant hole or horizontal hole will generally have a value of DLS of approximately zero. DLS may be positive, negative or zero.

Tilt angle (TA) may be defined as the angle in degrees from vertical of a segment or portion of a wellbore. A vertical wellbore has a generally constant tilt angle (TA) approximately equal to zero. A horizontal wellbore has a generally constant tilt angle (TA) approximately equal to ninety degrees (90°).

Tilt rate (TR) may be defined as the rate of change of a wellbore in degrees (TA) from vertical per hour of drilling. Tilt rate may also be referred to as "steer rate."

$$TR = \frac{d(TA)}{dt}$$

Where t=drilling time in hours

Tilt rate (TR) of a rotary drill bit may also be defined as DLS times rate of penetration (ROP).

$$TR = DLS \times ROP/100 = (\text{degrees/hour})$$

Bit tilting motion is often a critical parameter for accurately simulating drilling directional wellbores and evaluating characteristics of rotary drill bits and other downhole tools used with directional drilling systems. Prior two dimensional (2D) and prior three dimensional (3D) bit models and hole models are often unable to consider bit tilting motion due to limitations of Cartesian coordinate systems or cylindrical coordinate systems used to describe bit motion relative to a wellbore. The use of spherical coordinate system to simulate drilling of directional wellbore in accordance with teachings of the present disclosure allows the use of bit tilting motion and associated parameters to enhance the accuracy and reliability of such simulations.

Various aspects of the present disclosure may be described with respect to modeling or simulating drilling a wellbore or portions of a wellbore. Dogleg severity (DLS) of respective segments, portions or sections of a wellbore and corresponding tilt rate (TR) may be used to conduct such simulations. Appendix A lists some examples of data such as simulation run time and mesh size which may be used to conduct such simulations.

Various features of the present disclosure may also be described with respect to modeling or simulating drilling of a wellbore based on at least one of three possible drilling modes. See for example, FIG. 18A. A first drilling mode (straight hole drilling) may be used to simulate forming segments of a wellbore having a value of DLS approximately equal to zero. A second drilling mode (kick off drilling) may be used to simulate forming segments of a wellbore having a value of DLS greater than zero and a value of DLS which varies along portions of an associated section or segment of the wellbore. A third drilling mode (building or dropping) may be used to simulate drilling segments of a wellbore having a relatively constant value of DLS (positive or negative) other than zero.

The terms "downhole data" and "downhole drilling conditions" may include, but are not limited to, wellbore data and formation data such as listed on Appendix A. The terms "downhole data" and "downhole drilling conditions" may also include, but are not limited to, drilling equipment operating data such as listed on Appendix A.

The terms "design parameters," "operating parameters," "wellbore parameters" and "formation parameters" may sometimes be used to refer to respective types of data such as listed on Appendix A. The terms "parameter" and "parameters" may be used to describe a range of data or multiple ranges of data. The terms "operating" and "operational" may sometimes be used interchangeably.

Directional drilling equipment may be used to form wellbores having a wide variety of profiles or trajectories. Directional drilling system 20 and wellbore 60 as shown in FIG. 1A may be used to describe various features of the present disclosure with respect to simulating drilling all or portions of a wellbore and designing or selecting drilling equipment such as a rotary drill bit, near bit stabilizer or other downhole tools based at least in part on such simulations.

Directional drilling system 20 may include land drilling rig 22. However, teachings of the present disclosure may be satisfactorily used to simulate drilling wellbores using drilling systems associated with offshore platforms, semi-submersible, drill ships and any other drilling system satisfactory for forming a wellbore extending through one or more downhole formations. The present disclosure is not limited to directional drilling systems or land drilling rigs.

Drilling rig 22 and associated directional drilling equipment 50 may be located proximate well head 24. Drilling rig 22 also includes rotary table 38, rotary drive motor 40 and other equipment associated with rotation of drill string 32 within wellbore 60. Annulus 66 may be formed between the exterior of drill string 32 and the inside diameter of wellbore 60.

For some applications drilling rig 22 may also include top drive motor or top drive unit 42. Blow out preventors (not expressly shown) and other equipment associated with drilling a wellbore may also be provided at well head 24. One or more pumps 26 may be used to pump drilling fluid 28 from fluid reservoir or pit 30 to one end of drill string 32 extending from well head 24. Conduit 34 may be used to supply drilling mud from pump 26 to the one end of drilling string 32 extending from well head 24. Conduit 36 may be used to return drilling fluid, formation cuttings and/or downhole debris from the bottom or end 62 of wellbore 60 to fluid reservoir or pit 30. Various types of pipes, tube and/or conduits may be used to form conduits 34 and 36.

Drill string 32 may extend from well head 24 and may be coupled with a supply of drilling fluid such as pit or reservoir 30. Opposite end of drill string 32 may include BHA 90 and rotary drill bit 100 disposed adjacent to end 62 of wellbore 60. As discussed later in more detail, rotary drill bit 100 may include one or more fluid flow passageways with respective nozzles disposed therein. Various types of drilling fluids may be pumped from reservoir 30 through pump 26 and conduit 34 to the end of drill string 32 extending from well head 24. The drilling fluid may flow through a longitudinal bore (not expressly shown) of drill string 32 and exit from nozzles formed in rotary drill bit 100.

At end 62 of wellbore 60 drilling fluid may mix with formation cuttings and other downhole debris proximate drill bit 100. The drilling fluid will then flow upwardly through annulus 66 to return formation cuttings and other downhole debris to well head 24. Conduit 36 may return the drilling fluid to reservoir 30. Various types of screens, filters and/or centrifuges (not expressly shown) may be provided to remove formation cuttings and other downhole debris prior to returning drilling fluid to pit 30.

BHA 90 may include various downhole tools and components associated with a measurement while drilling (MWD) system that provides logging data and other information from the bottom of wellbore 60 to directional drilling equipment 50. Logging data and other information may be communicated from end 62 of wellbore 60 through drill string 32 using MWD techniques and converted to electrical signals at well surface 24. Electrical conduit or wires 52 may communicate the electrical signals to input device 54. The logging data provided from input device 54 may then be directed to a data processing system 56. Various displays 58 may be provided as part of directional drilling equipment 50.

For some applications printer 59 and associated printouts 59*a* may also be used to monitor the performance of drilling string 32, BHA 90 and associated rotary drill bit 100. Outputs 57 may be communicated to various components associated with operating drilling rig 22 and may also be communicated to various remote locations to monitor the performance of directional drilling system 20.

Wellbore 60 may be generally described as a directional wellbore or a deviated wellbore having multiple segments or sections. Section 60*a* of wellbore 60 may be defined by casing 64 extending from well head 24 to a selected downhole location. Remaining portions of wellbore 60 as shown in FIG. 1A may be generally described as "open hole" or "uncased."

Teachings of the present disclosure may be used to simulate drilling a wide variety of vertical, directional, deviated, slanted and/or horizontal wellbores. Teachings of the present disclosure are not limited to simulating drilling wellbore 60, designing drill bits for use in drilling wellbore 60 or selecting drill bits from existing designs for use in drilling wellbore 60.

Wellbore 60 as shown in FIG. 1A may be generally described as having multiple sections, segments or portions with respective values of DLS. The tilt rate for rotary drill bit 100 during formation of wellbore 60 will be a function of DLS for each segment, section or portion of wellbore 60 times the rate of penetration for rotary drill bit 100 during formation of the respective segment, section or portion thereof. The tilt rate of rotary drill bit 100 during formation of straight hole sections or vertical section 80*a* and horizontal section 80*c* will be approximately equal to zero.

Section 60*a* extending from well head 24 may be generally described as a vertical, straight hole section with a value of DLS approximately equal to zero. When the value of DLS is zero, rotary drill bit 100 will have a tile rate of approximately zero during formation of the corresponding section of wellbore 60.

A first transition from vertical section 60*a* may be described as kick off section 60*b*. For some applications the value of DLS for kick off section 60*b* may be greater than zero and may vary from the end of vertical section 60*a* to the beginning of a second transition segment or building section 60*c*. Building section 60*c* may be formed with relatively constant radius 70*c* and a substantially constant value of DLS. Building section 60*c* may also be referred to as third section 60*c* of wellbore 60.

Fourth section 60*d* may extend from build section 60*c* opposite from second section 60*b*. Fourth section 60*d* may be described as a slant hole portion of wellbore 60. Section 60*d* may have a DLS of approximately zero. Fourth section 60*d* may also be referred to as a "holding" section.

Fifth section 60*e* may start at the end of holding section 60*d*. Fifth section 60*e* may be described as a "drop" section having a generally downward looking profile. Drop section 60*e* may have relatively constant radius 70*e*.

Sixth section 60*f* may also be described as a holding section or slant hole section with a DLS of approximately zero. Section 60*f* as shown in FIG. 1A is being formed by rotary drill bit 100, drill string 32 and associated components of drilling system 20.

Figure 1C:
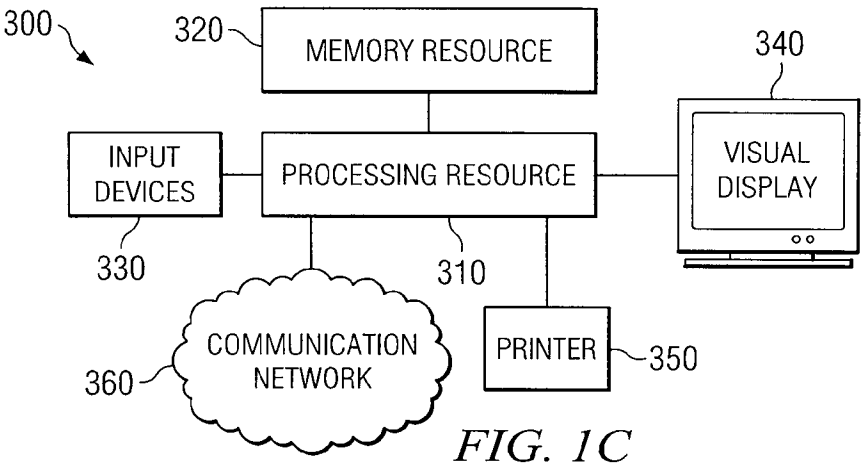
FIG. 1C is a schematic drawing showing one example of a system and associated apparatus operable to simulate drilling a complex, directional wellbore such as shown in FIG. 1A in accordance with teachings of the present disclosure.
Figure 1B:
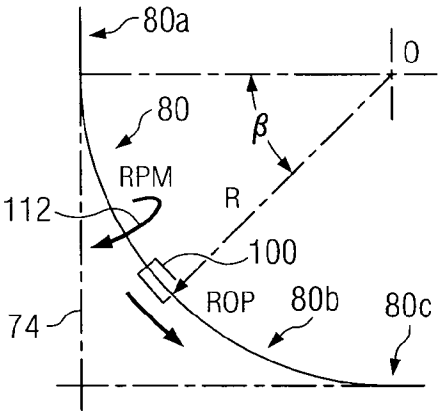
FIG. 1B is a schematic drawing showing a graphical representation of a directional wellbore having a constant radius between a generally vertical section and a generally horizontal section which may be formed by a drill bit designed in accordance with teachings of the present disclosure or selected from existing drill bit designs in accordance with teachings of the present disclosure.

FIG. 1B is a graphical representation of a specific type of directional wellbore represented by wellbore 80. For this example wellbore 80 may include three segments or three sections—vertical section 80*a*, building section 80*b* and horizontal section 80*c*. Vertical section 80*a* and horizontal section 80*c* may be straight holes with a value of DLS approximately equal to zero. Building section 80*b* may have a constant radius corresponding with a constant rate of change in degrees from vertical and a constant value of DLS. Tilt rate during formation building section 80*b* may be constant if ROP of a drill bit forming build section 80*b* remains constant.

FIG. 1C shows one example of a system operable to simulate drilling a complex, directional wellbore in accordance with teachings of this present disclosure. System 300 may calculate bit walk force, walk rate and walk angle based at least in part on bit cutter layout, bit gage geometry, hole size, hole geometry, rock compressive strength, inclination of formation layers, bit steering mechanism, bit rotational speed, penetration rate and dogleg severity using teachings of the present disclosure.

System 300 may include one or more processing resources 310 operable to run software and computer programs incorporating teaching of the present disclosure. A general purpose computer may be used as a processing resource. All or portions of software and computer programs used by processing resource 310 may be stored one or more memory resources 320. One or more input devices 330 may be operate to supply data and other information to processing resources 310 and/or memory resources 320. A keyboard, keypad, touch screen and other digital input mechanisms may be used as an input device. Examples of such data are shown on Appendix A.

Processing resources 310 may be operable to simulate drilling a directional wellbore in accordance with teachings of the present disclosure. Processing resources 310 may be operate to use various algorithms to make calculations or estimates based on such simulations.

Display resources 340 may be operable to display both data input into processing resources 310 and the results of simulations and/or calculations performed in accordance with teachings of the present disclosure. A copy of input data and results of such simulations and calculations may also be provided at printer 350.

For some applications, processing resource 310 may be operably connected with communication network 360 to accept inputs from remote locations and to provide the results of simulation and associated calculations to remote locations and/or facilities such as directional drilling equipment 50 shown in FIG. 1A.

Figure 1D:
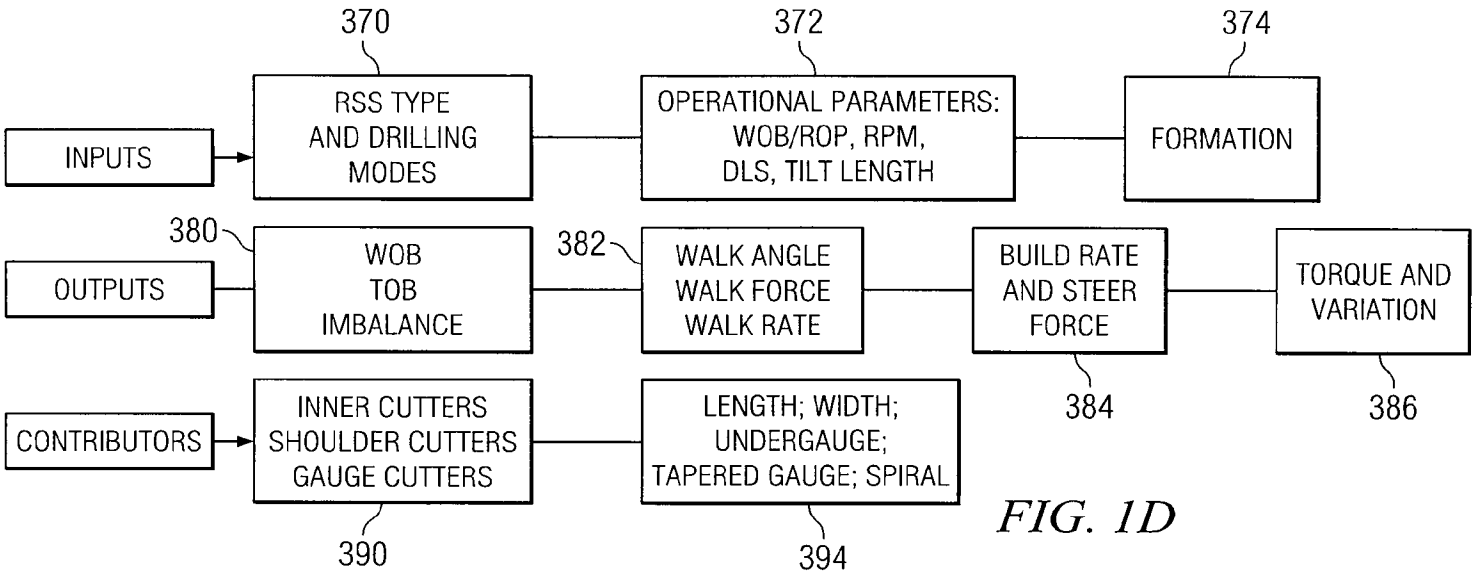
FIG. 1D is a block diagram representing various capabilities of systems and computer programs for simulating drilling a directional wellbore in accordance with teachings of the present disclosure.

FIG. 1D is a block diagram representing some of the inputs which may be used to simulate or model forming a directional wellbore such as shown in FIG. 1A using various teachings of the present disclosure. Input 370 may include the type of rotary steering system such as point-the-bit or push-the bit. Input 370 may also include the drilling mode such as vertical, horizontal, slant hole, building, dropping, transition and/or kick-off. Operational parameters 372 may include WOB, ROP, RPM and other parameters. See Appendix A.

Formation information 374 may include soft, medium or hard formation materials, multiple layers of formation materials, inclination of formation layers, the presence of hard stringers and/or the presence of concretions or very hard stones in one or more formation layers. Soft formations may include, but are not limited to, unconsolidated sands, clay, soft limestone and other downhole formations having similar characteristics. Medium formations may include, but are not limited to, calcites, dolomites, limestone and some shale formations. Hard formation materials may include, but are not limited to, hard shales, hard limestone and hard calcites.

Output 380 may include, but is not limited to, changes in WOB, TOB and/or any imbalances on associated cutting elements or cutting structures. Output 382 may include walk angle, walk force and/or walk rate of an associated rotary drill bit. Outputs 384 may include required build rate, drop rate and/or steering forces required to form a desired wellbore profile. Output 388 may include variations in any of the previous outputs over the length of forming an associated wellbore.

Additional contributors may also be used to simulate and evaluate the performance of a rotary drill bit and/or other downhole tools in forming a directional wellbore. Contributors 390 may include, but are not limited to, the location and design of cone cutters, nose cutters, shoulder cutters and/or gage cutters. Contributors 392 may include the length/width of gage pads, taper of gage pads, blade spiral and/or under gage dimensions of a rotary drill bit or other downhole tool.

Figure 2A:
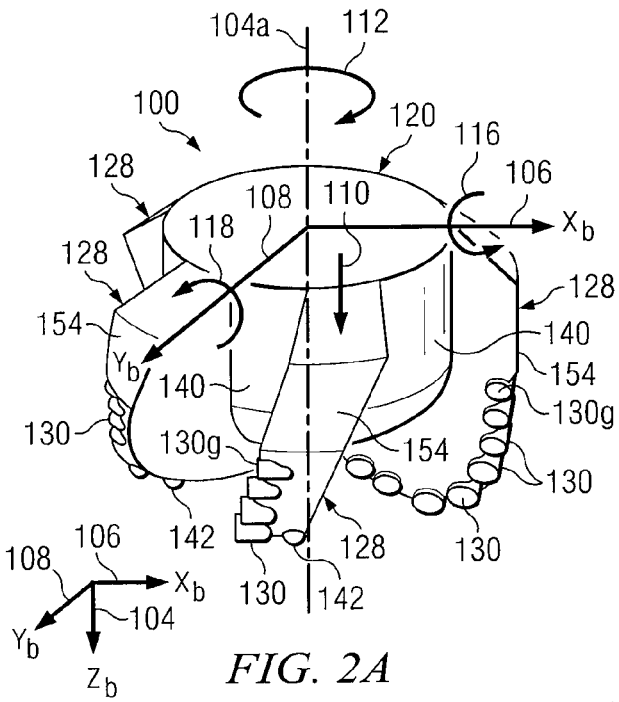
FIG. 2A is a schematic drawing showing an isometric view with portions broken away of a rotary drill bit with six (6) degrees of freedom which may be used to describe motion of the rotary drill bit in three dimensions in a bit coordinate system.
Figure 3A:
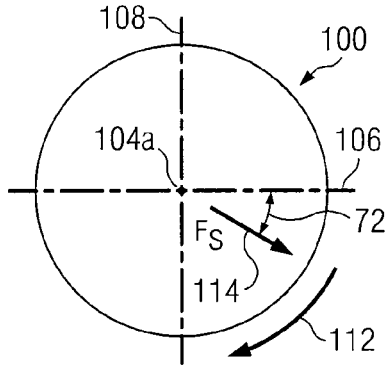
FIG. 3A is a schematic representation showing a side force applied to a rotary drill bit at an instant in time in a two dimensional Cartesian bit coordinate system.
Figure 3B:
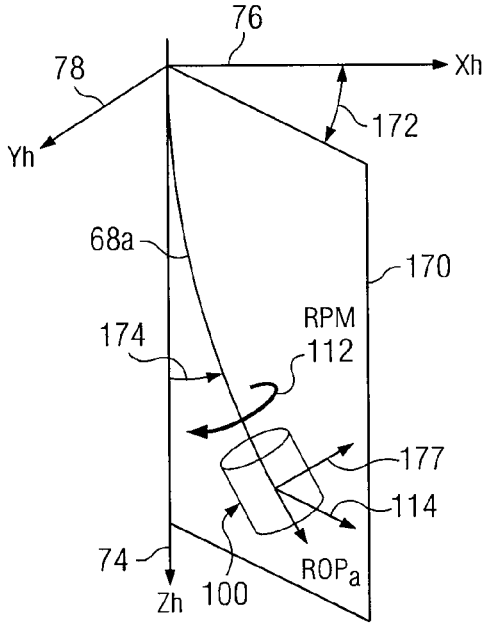
FIG. 3B is a schematic representation showing a trajectory of a directional wellbore and a rotary drill bit disposed in a tilt plane at an instant of time in a three dimensional Cartesian hole coordinate system.
Figure 16A:
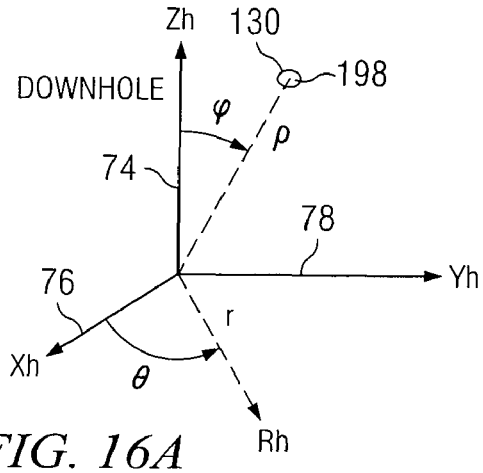
FIG. 16A is a schematic drawing showing a graphical representation of a spherical coordinate system which may be used to describe motion of a rotary drill bit and also describe the bottom of a wellbore in accordance with teachings of the present disclosure.
Figure 16B:
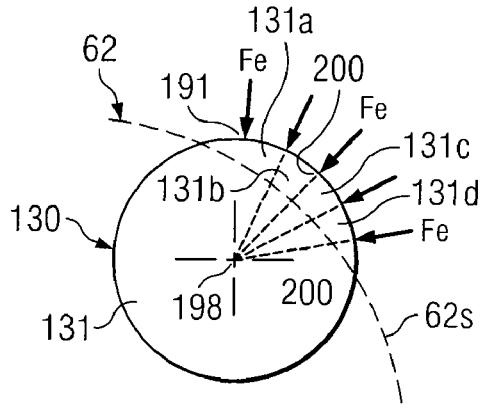
FIG. 16B is a schematic drawing showing forces operating on a rotary drill bit against the bottom and/or the sidewall of a bore hole in a spherical coordinate system.
Figure 17:
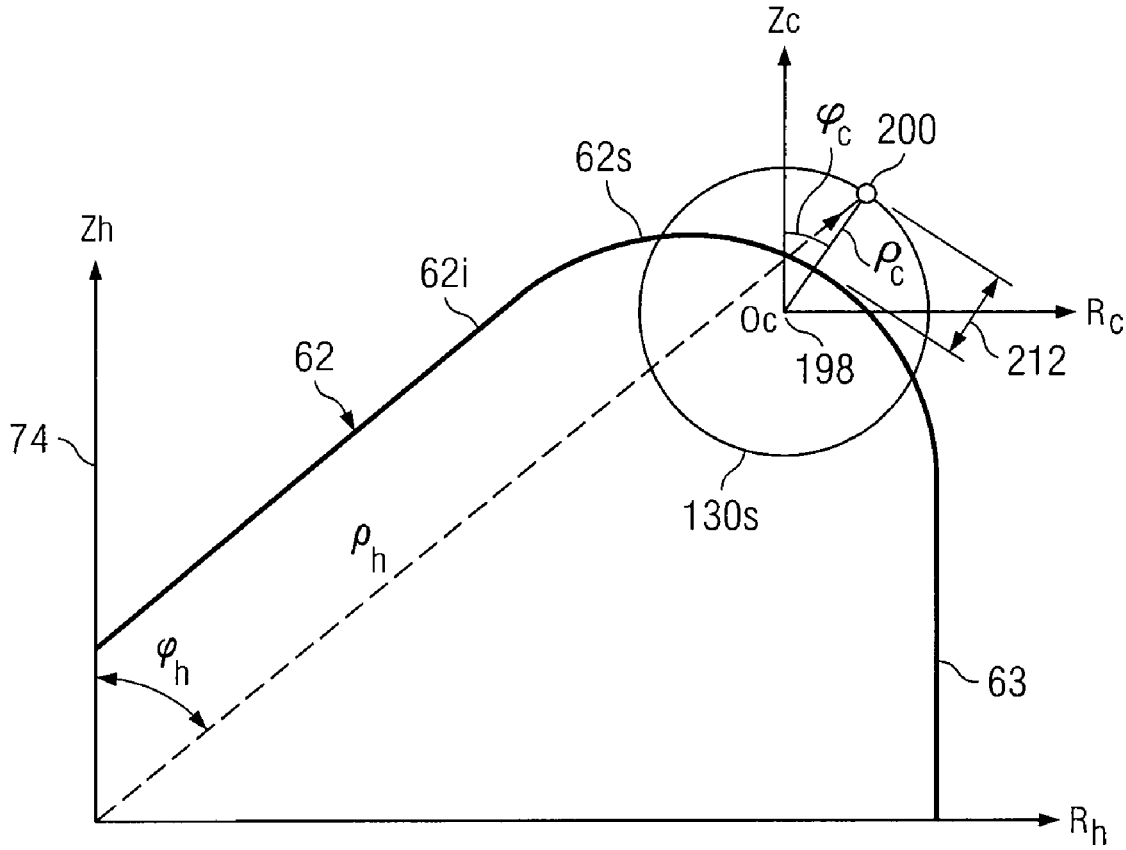
FIG. 17 is a graphical representation of one example of calculations used to estimate cutting depth of a cutter disposed on a rotary drill bit in accordance with teachings of the present disclosure.

Movement or motion of a rotary drill bit and associated drilling equipment in three dimensions (3D) during formation of a segment, section or portion of a wellbore may be defined by a Cartesian coordinate system (X, Y, and Z axes) and/or a spherical coordinate system (two angles $\phi$ and $\theta$ and a single radius $\rho$) in accordance with teachings of the present disclosure. Examples of Cartesian coordinate systems are shown in FIGS. 2A and 3B. Examples of spherical coordinate systems are shown in FIGS. 16A, 16B and 17. Various aspects of the present disclosure may include translating the location of downhole drilling equipment or tools and adjacent portions of a wellbore between a Cartesian coordinate system and a spherical coordinate system. FIG. 16A shows one example of translating the location of a single point between a Cartesian coordinate system and a spherical coordinate system.

Figure 3C:
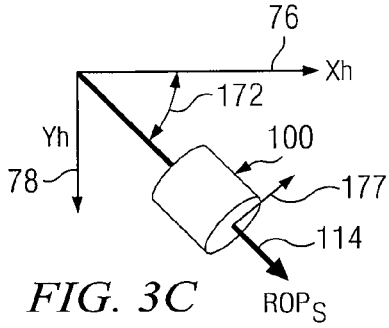
FIG. 3C is a schematic representation showing the rotary drill bit in FIG. 3B at the same instant of time in a two dimensional Cartesian hole coordinate system.

A Cartesian coordinate system generally includes a Z axis and an X axis and a Y axis which extend normal to each other and normal to the Z axis. See for example FIG. 2A. A Cartesian bit coordinate system may be defined by a Z axis extending along a rotational axis or bit rotational axis of the rotary drill bit. See FIG. 2A. A Cartesian hole coordinate system (sometimes referred to as a "downhole coordinate system" or a "wellbore coordinate system") may be defined by a Z axis extending along a rotational axis of the wellbore. See FIG. 3B. In FIG. 2A the X, Y and Z axes include subscript $_{(b)}$ to indicate a "bit coordinate system". In FIGS. 3A, 3B and 3C the X, Y and Z axes include subscript $_{(h)}$ to indicate a "hole coordinate system".

FIG. 2A is a schematic drawing showing rotary drill bit 100. Rotary drill bit 100 may include bit body 120 having a plurality of blades 128 with respective junk slots or fluid flow paths 140 formed therebetween. A plurality of cutting elements 130 may be disposed on the exterior portions of each blade 128. Various parameters associated with rotary drill bit 100 including, but not limited to, the location and configuration of blades 128, junk slots 140 and cutting elements 130. Such parameters may be designed in accordance with teachings of the present disclosure for optimum performance of rotary drill bit 100 in forming portions of a wellbore.

Each blade 128 may include respective gage surface or gage portion 154. Gage surface 154 may be an active gage and/or a passive gage. Respective gage cutter 130*g* may be disposed on each blade 128. A plurality of impact arrestors 142 may also be disposed on each blade 128. Additional information concerning impact arrestors may be found in U.S. Pat. Nos. 6,003,623, 5,595,252 and 4,889,017.

Figure 2B:
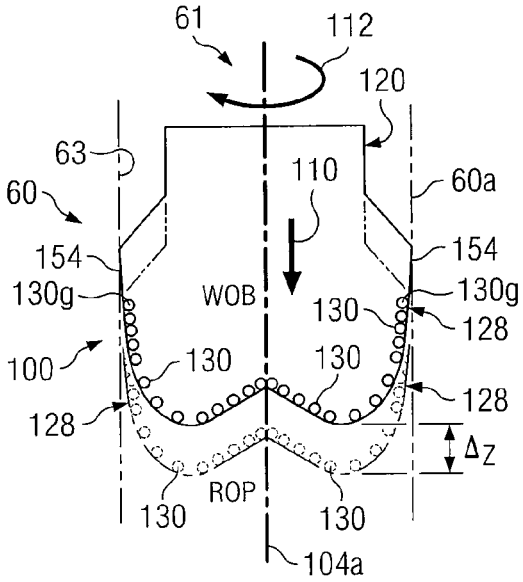
FIG. 2B is a schematic drawing showing forces applied to a rotary drill bit while forming a substantially vertical wellbore.

Rotary drill bit 100 may translate linearly relative to the X, Y and Z axes as shown in FIG. 2A (three (3) degrees of freedom). Rotary drill bit 100 may also rotate relative to the X, Y and Z axes (three (3) additional degrees of freedom). As a result movement of rotary drill bit 100 relative to the X, Y and Z axes as shown in FIGS. 2A and 2B, rotary drill bit 100 may be described as having six (6) degrees of freedom.

Movement or motion of a rotary drill bit during formation of a wellbore may be fully determined or defined by six (6) parameters corresponding with the previously noted six degrees of freedom. The six parameters as shown in FIG. 2A include rate of linear motion or translation of rotary drill bit 100 relative to respective X, Y and Z axes and rotational motion relative to the same X, Y and Z axes. These six parameters are independent of each other.

For straight hole drilling these six parameters may be reduced to revolutions per minute (RPM) and rate of penetration (ROP). For kick off segment drilling these six parameters may be reduced to RPM, ROP, dogleg severity (DLS), bend length ($B_L$) and azimuth angle of an associated tilt plane. See tilt plane or azmuth plane 170 in FIG. 3B. For equilibrium drilling these six parameters may be reduced to RPM, ROP and DLS based on the assumption that the rotational axis of the associated rotary drill bit will move in the same vertical plane or tilt plane.

For calculations related to steerability only forces acting in an associated tilt plane are considered. Therefore an arbitrary azimuth angle may be selected usually equal to zero. For calculations related to bit walk forces in the associated tilt plane and forces in a plane perpendicular to the tilt plane are considered.

In a bit coordinate system, rotational axis or bit rotational axis 104*a* of rotary drill bit 100 may correspond generally with Z axis 104 of an associated bit coordinate system. When sufficient force from rotary drill string 32 has been applied to rotary drill bit 100, cutting elements 130 will engage and remove adjacent portions of a downhole formation at bottom hole or end 62 of wellbore 60. Removing such formation materials will allow downhole drilling equipment including rotary drill bit 100 and associated drill string 32 to move linearly relative to adjacent portions of wellbore 60.

Various kinematic parameters associated with forming a wellbore using a rotary drill bit may be based upon revolutions per minute (RPM) and rate of penetration (ROP) of the rotary drill bit into adjacent portions of a downhole formation. Arrow 110 in FIG. 2B may be used to represent forces which move rotary drill bit 100 linearly relative to rotational axis 104*a*. Such linear forces typically result from weight applied to rotary drill bit 100 by drill string 32 and may be referred to as "weight on bit" or WOB.

Rotational force 112 may be applied to rotary drill bit 100 by rotation of drill string 32. Revolutions per minute (RPM) of rotary drill bit 100 may be a function of rotational force 112. Rotation speed (RPM) of drill bit 100 is generally defined relative to the rotational axis of rotary drill bit 100 which corresponds with Z axis 104.

Arrow 116 indicates rotational forces which may be applied to rotary drill bit 100 relative to X axis 106. Arrow 118 indicates rotational forces which may be applied to rotary drill bit 100 relative to Y axis 108. Rotational forces 116 and 118 may result from interaction between cutting elements 130 disposed on exterior portions of rotary drill bit 100 and adjacent portions of bottom hole 62 during the forming of wellbore 60. Rotational forces applied to rotary drill bit 100 along X axis 106 and Y axis 108 may result in tilting of rotary drill bit 100 relative to adjacent portions of drill string 32 and wellbore 60.

FIG. 2B is a schematic drawing showing rotary drill bit 100 disposed within vertical section or straight hole section 60*a* of wellbore 60. During the drilling of a vertical section or any other straight hole section of a wellbore, the bit rotational axis of rotary drill bit 100 will generally be aligned with a corresponding rotational axis of the straight hole section. The incremental change or the incremental movement of rotary drill bit 100 in a linear direction during a single revolution may be represented by $\Delta Z$ in FIG. 2B.

Rate of penetration of a rotary drill bit is typically a function of both weight on bit and revolutions per minute. For some applications a downhole motor (not expressly shown) may be provided as part of BHA 90 to also rotate rotary drill bit 100. The ROP of a rotary drill bit is generally stated in feet per hour.

The axial penetration of rotary drill bit 100 may be defined relative to bit rotational axis 104*a* in an associated bit coordinate system. An equivalent side penetration rate or lateral penetration rate due to tilt motion of rotary drill bit 100 may be defined relative to an associated hole coordinate system. Examples of a hole coordinate system are shown in FIGS. 3A, 3B and 3C. FIG. 3A is a schematic representation of a model showing side force 114 applied to rotary drill bit 100 relative to X axis 106 and Y axis 108. Angle 72 formed between force vector 114 and X axis 106 may correspond approximately with angle 172 associated with tilt plane 170 as shown in FIG. 3B. A tilt plane may be defined as a plane extending from an associated Z axis or vertical axis in which dogleg severity (DLS) or tilting of the rotary drill bit occurs.

Various forces may be applied to rotary drill bit 100 to cause movement relative to X axis 106 and Y axis 108. Such forces may be applied to rotary drill bit 100 by one or more components of a directional drilling system included within BHA 90. See FIGS. 4A, 4B, 5A and 5B. Various forces may also be applied to rotary drill bit 100 relative to X axis 106 and Y axis 108 in response to engagement between cutting elements 130 and adjacent portions of a wellbore.

During drilling of straight hole segments of wellbore 60, side forces applied to rotary drill bit 100 may be substantially minimized (approximately zero side forces) or may be balanced such that the resultant value of any side forces will be approximately zero. Straight hole segments of wellbore 60 as shown in FIG. 1A include, but are not limited to, vertical section 60*a*, holding section or slant hole section 60*d*, and holding section or slant hole section 60*f*.

During formation of straight hole segments of wellbore 60, the primary direction of movement or translation of rotary drill bit 100 will be generally linear relative to an associated longitudinal axis of the respective wellbore segment and relative to associated bit rotational axis 104*a*. See FIG. 2B. During the drilling of portions of wellbore 60 having a DLS with a value greater than zero or less than zero, a side force ($F_s$) or equivalent side force may be applied to an associated rotary drill bit to cause formation of corresponding wellbore segments 60*b*, 60*c* and 60*e*.

For some applications such as when a push-the-bit directional drilling system is used with a rotary drill bit, an applied side force may result in a combination of bit tilting and side cutting or lateral penetration of adjacent portions of a wellbore. For other applications such as when a point-the-bit directional drilling system is used with an associated rotary drill bit, side cutting or lateral penetration may generally be small or may not even occur. When a point-the-bit directional drilling system is used with a rotary drill bit, directional portions of a wellbore may be formed primarily as a result of bit penetration along an associated bit rotational axis and tilting of the rotary drill bit relative to a wellbore axis.

FIGS. 3A, 3B and 3C are graphical representations of various kinematic parameters which may be satisfactorily used to model or simulate drilling segments or portions of a wellbore having a value of DLS greater than zero. FIG. 3A shows a schematic cross-section of rotary drill bit 100 in two dimensions relative to a Cartesian bit coordinate system. The bit coordinate system is defined in part by X axis 106 and Y axis 108 extending from bit rotational axis 104*a*. FIGS. 3B and 3C show graphical representations of rotary drill bit 100 during drilling of a transition segment such as kick off segment 60*b* of wellbore 60 in a Cartesian hole coordinate system defined in part by Z axis 74, X axis 76 and Y axis 78.

A side force is generally applied to a rotary drill bit by an associated directional drilling system to form a wellbore having a desired profile or trajectory using the rotary drill bit. For a given set of drilling equipment design parameters and a given set of downhole drilling conditions, a respective side force must be applied to an associated rotary drill bit to achieve a desired DLS or tilt rate. Therefore, forming a directional wellbore using a point-the-bit directional drilling system, a push-the-bit directional drilling system or any other directional drilling system may be simulated using methods incorporating teachings of the present disclosure by determining required bit side force to achieve desired DLS or tilt rate for each segment of a directional wellbore.

FIG. 3A shows side force 114 extending at angle 72 relative to X axis 106. Side force 114 may be applied to rotary drill bit 100 by directional drilling system 20. Angle 72 (sometimes referred to as an "azimuth" angle) extends from rotational axis 104*a* of rotary drill bit 100 and represents the angle at which side force 114 will be applied to rotary drill bit 100. For some applications side force 114 may be applied to rotary drill bit 100 at a relatively constant azimuth angle.

Figure 4A:
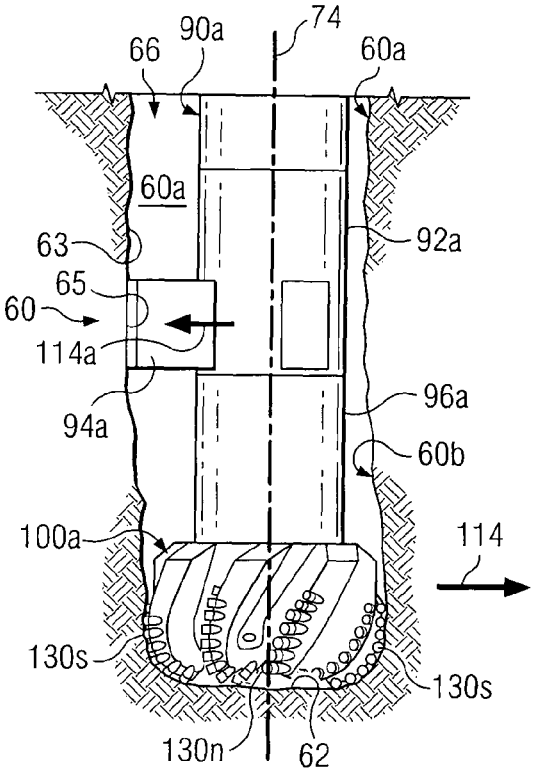
FIG. 4A is a schematic drawing in section and in elevation with portions broken away showing one example of a push-the-bit directional drilling system and associated rotary drill bit disposed adjacent to the end of a wellbore.
Figure 5A:
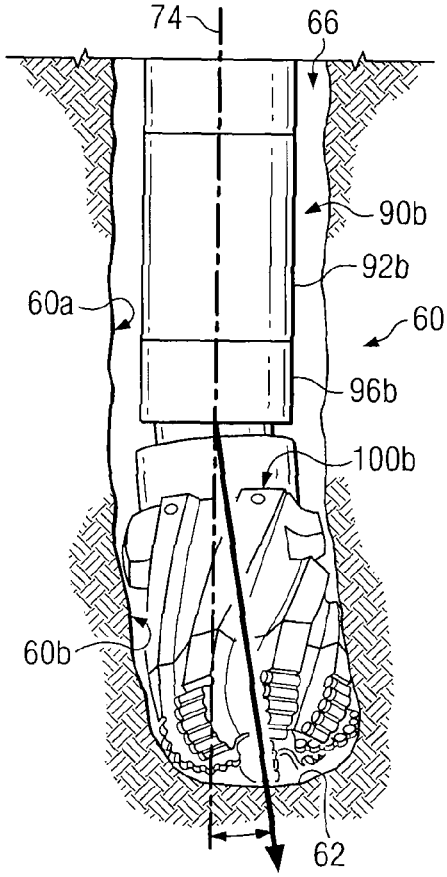
FIG. 5A is a schematic drawing in section and in elevation with portions broken away showing one example of a point-the-bit directional drilling system and associated rotary drill bit disposed adjacent to the end of a wellbore.

Directional drilling systems such as rotary drill bit steering units 92*a* and 92*b* shown in FIGS. 4A and 5A may be used to either vary the amount of side force 114 or to maintain a relatively constant amount of side force 114 applied to rotary drill bit 100. Directional drilling systems may also vary the azimuth angle at which a side force is applied to a rotary drill bit to correspond with a desired wellbore trajectory or drill path.

Side force 114 may be adjusted or varied to cause associated cutting elements 130 to interact with adjacent portions of a downhole formation so that rotary drill bit 100 will follow profile or trajectory 68*b*, as shown in FIG. 3B, or any other desired profile. Profile 68*b* may correspond approximately with kick off segment 60*b* of FIG. 1A. Rotary drill bit 100 will generally move only in tilt plane 170 during formation of kickoff segment 60*b* if rotary drill bit 100 has zero walk tendency or neutral walk tendency (no bit walk). However, rotary drill bits often walk right or left.

Respective tilting angles of rotary drill bit 100 will vary along the length of trajectory 68*b*. Each tilting angle of rotary drill bit 100 as defined in a hole coordinate system ($Z_h$, $X_h$, $Y_h$) will generally lie in tilt plane 170 (if there is no bit walk). As previously noted, during the formation of a kickoff segment of a wellbore, tilting rate in degrees per hour as indicated by arrow 174 will also increase along trajectory 68*b*. For use in simulating forming kickoff segment 60*b*, side penetration rate, side penetration azimuth angle, tilting rate and tilt plane azimuth angle may be defined in a hole coordinate system which includes Z axis 74, X axis 76 and Y axis 78.

Arrow 174 corresponds with the variable tilt rate of rotary drill bit 100 relative to vertical at any one location along trajectory 68*b*. During movement of rotary drill bit 100 along profile or trajectory 68*a*, the respective tilt angle at each location on trajectory 68*a* will generally increase relative to Z axis 74 of the hole coordinate system shown in FIG. 3B. For embodiments such as shown in FIG. 3B, the tilt angle at each point on trajectory 68*b* will be approximately equal to an angle formed by a respective tangent extending from the point in question and intersecting Z axis 74. Therefore, the tilt rate will also vary along the length of trajectory 168.

During the formation of kick off segment 60*b* and any other portions of a wellbore in which the value of DLS is either greater than zero or less than zero and is not constant, rotary drill bit 100 may experience side cutting motion, bit tilting motion and axial penetration in a direction associated with cutting or removing of formation materials from the end or bottom of a wellbore.

For embodiments such as shown in FIGS. 3A, 3B and 3C directional drilling system 20 may cause rotary drill bit 100 to move in the same azimuth plane 170 during formation of kick off segment 60*b*. FIGS. 3B and 3C show relatively constant azimuth plane angle 172 relative to the X axis 76 and Y axis 78. Arrow 114 as shown in FIG. 3B represents a side force applied to rotary drill bit 100 by directional drilling system 20. Arrow 114 will generally extend normal to rotational axis 104*a* of rotary drill bit 100. Arrow 114 will also be disposed in tilt plane 170. A side force applied to a rotary drill bit in a tilt plane by an associate rotary drill bit steering unit or directional drilling system may also be referred to as a "steer force."

During the formation of a directional wellbore such as shown in FIG. 3B, without consideration of bit walk, rotational axis 104*a* of rotary drill bit 100 and a longitudinal axis of BHA 90 may generally lie in tilt plane 170. Rotary drill bit 100 may experience tilting motion in tilt plane 170 while rotating relative to rotational axis 104*a*. Tilting motion may result from a side force or steer force applied to rotary drill bit 100 by a directional steering unit. See FIGS. 4A AND 4B or 5A and 5B. Tilting motion often results from a combination of side forces and/or axial forces applied to rotary drill bit 100 by directional drilling system 20.

If rotary drill bit 100 walks, either left toward x axis 76 or right toward y axis 78, bit 100 will generally not remain in the same azimuth plane or tilt plane 170 during formation of kickoff segment 60*b*. As discussed later, rotary drill bit 100 may experience a walk force ($F_W$) as indicated by arrow 177. Arrow 177 as shown in FIGS. 3B and 3C represents a walk force which will cause rotary drill bit 100 to "walk" left relative to tilt plane 170. Simulations of forming a wellbore in accordance with teachings of the present disclosure may be used to modify cutting elements, bit face profiles, gages and other characteristics of a rotary drill bit or associated downhole tools to substantially reduce or minimize the walk force represented by arrow 177 or to provide a desired right walk rate or left walk rate.

Simulations incorporating teachings of the present disclosure may be used to calculate side forces applied to rotary drill bits 100, 100*a*, 100*b* and 100*c* and/or each segment and component thereof. For example cone cutters 130*c*, nose cutters 130*n* and shoulder cutters 130*s* may apply respective side forces during formation of a directional wellbore. Gage portion 154 and/or sleeve 240 may also apply respective side forces during formation of a directional wellbore.

FIG. 4A shows portions of BHA 90*a* disposed in generally vertical portion 60*a* of wellbore 60 as rotary drill bit 100*a* begins to form kick off segment 60*b*. BHA 90*a* may include rotary drill bit steering unit 92*a* operable to apply side force 114 to rotary drill bit 100*a*. Steering unit 92*a* may be one portion of a push-the-bit directional drilling system or rotary steerable system (RSS).

Figure 4B:
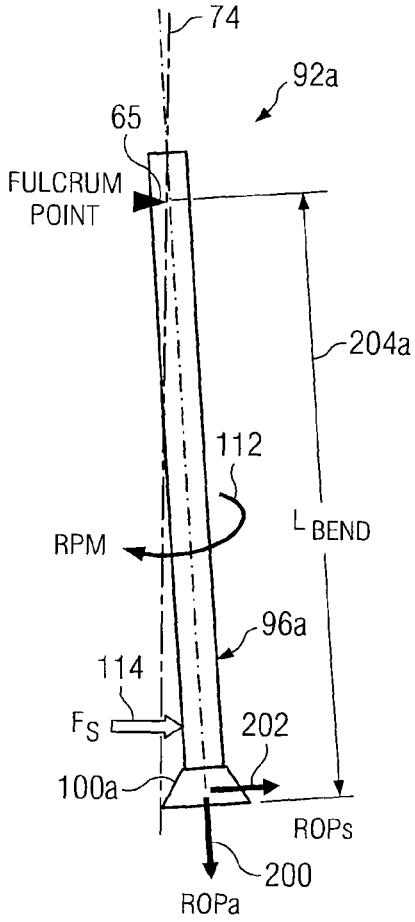
FIG. 4B is a graphical representation showing portions of a push-the-bit directional drilling system forming a directional wellbore.
Figure 4C:
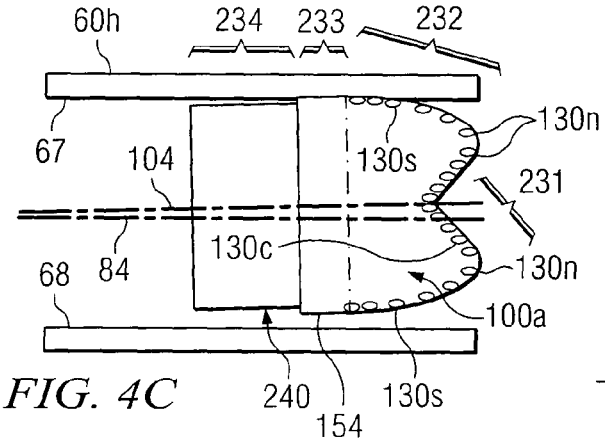
FIG. 4C is a schematic drawing showing various components of a push-the-bit directional drilling system including a fixed cutter drill bit disposed in a generally horizontal wellbore.
Figure 4D:
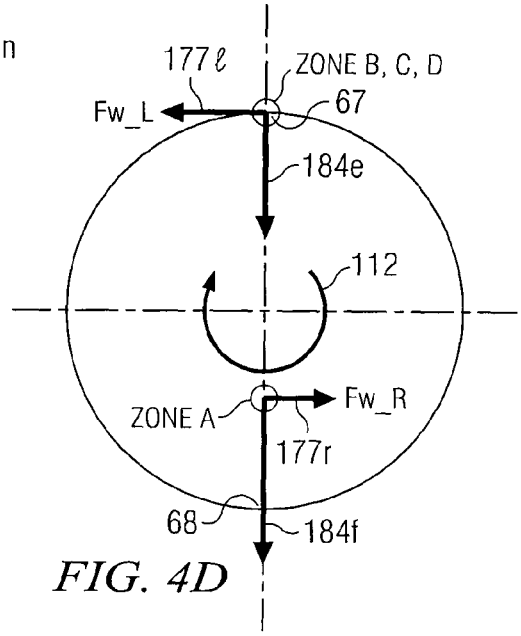
FIG. 4D is a schematic drawing in section showing various forces acting on the fixed cutter rotary drill bit in FIG. 4C.

In many push-the-bit RSS, a number of expandable thrust pads may be located a selected distance above an associated rotary drill bit. Expandable thrust pads may be used to bias the rotary drill bit along a desired trajectory. Several steering mechanisms may be used, but push-the-bit principles are generally the same. A side force is applied to the bit by the RSS from a fulcrum point disposed uphole from the RSS. Rotary drill bits used with push-the-bit RSS typically have a short gage pad length in order to satisfactorily steer the bit. Near bit stabilizers or sleeves are generally not used with push-the-bit RSS. FIGS. 4B, 4C and 4D show some principles associated with a push-the-bit RSS.

Push-the-bit systems generally require simultaneous axial penetration and side penetration in order to drill directionally. Bit motion associated with push-the-bit directional drilling systems is often a combination of axial bit penetration, bit rotation, bit side cutting and bit tilting. Simulation of forming a wellbore using a push-the-bit directional drilling system and methods incorporating teachings of the present disclosure such as shown in FIGS. 18A-18G may result in more accurate simulation and improved downhole tool designs.

Steering unit 92*a* may extend one or more arms or thrust pads 94*a* to apply force 114*a* to adjacent portions of wellbore 60 and maintain desired contact between steering unit 92*a* and adjacent portions of wellbore 60. Side forces 114 and 114*a* may be approximately equal to each other. If there is no weight on rotary drill bit 100*a*, no axial penetration will occur at end or bottom hole 62 of wellbore 60. Side cutting will generally occur as portions of rotary drill bit 100*a* engage and remove adjacent portions of wellbore 60*a*.

FIG. 4B shows various parameters associated with a push-the-bit directional drilling system. Steering unit 92*a* may include bent subassembly 96*a*. A wide variety of bent subassemblies (sometimes referred to as "bent subs") may be satisfactorily used to allow drill string 32 to rotate drill bit 100*a* while steering unit 92*a* pushes or applies required force to move rotary drill bit 100*a* at a desired tilt rate relative to vertical axis 74. Arrow 200 represents the rate of penetration ($ROP_a$) relative to the rotational axis of rotary drill bit 100*a*. Arrow 202 represents the rate of side penetration ($ROP_s$) of rotary drill bit 200 as steering unit 92*a* pushes or directs rotary drill bit 100*a* along a desired trajectory or path.

Bend length 204*a* may be a function of the distance between fulcrum point 65 (where thrust pads 94*a* contacts adjacent portions of wellbore 60) and the end of rotary drill bit 100*a*. Bend length may be used as one of the inputs to simulate forming portions of a wellbore in accordance with teachings of the present disclosure. Bend length may be generally described as the distance from a fulcrum point of an associated bent subassembly to a furthest location on a "bit face" or "bit face profile" of an associated rotary drill bit. The furthest location may sometimes be referred to as the extreme end of the associated rotary drill bit.

During formation of a kick off section or other portions of a wellbore with a changing tilt rate, axial penetration of an associated drill bit will occur in response to WOB and/or axial forces applied to the drill bit. Bit tilting motion may often result from a side force or lateral force applied to the drill bit by an associated push-the-bit steering unit. Therefore, bit motion is usually a combination of bit axial penetration and bit tilting motion for push-the-bit steering units.

When bit axial penetration rate is very small (close to zero) and the distance from the bit to an associated fulcrum point or bend length is very large, side penetration or side cutting may be dominate motion of the drill bit. Resulting bit motion may or may not be continuous when using a push-the-bit RSS depending on WOB, RPM, applied side force and other parameters associated with the drill bit. Since bend length associated with a push-the-bit directional drilling system is usually relatively large (often greater than 20 times associated bit size), cutting action associated with forming a directional wellbore may be a combination of axial bit penetration, bit rotation, bit side cutting and bit tilting. See FIGS. 4A, 4B and 8A.

FIG. 4C is a schematic drawing showing one example of a rotary drill bit which may be designed in accordance with teachings of the present disclosure for optimum performance in a push-the-bit RSS. For example, methods such as shown in FIGS. 18A-18G may provide three dimensional models satisfactory to design a rotary drill bit with optimum active and/or passive gage length for use with a push-the-bit RSS. Rotary drill bit 100*a* may be generally described as a fixed cutter drill bit. For some applications rotary drill bit 100*a* may also be described as a matrix drill bit, steel body drill bit and/or a PDC drill bit. The design and configuration of rotary drill bit 100*a* may be modified as appropriate for each downhole drilling environment based on simulations using methods such as shown in FIGS. 18A-18G.

Rotary drill bit 100*a* may include various components such as cone cutters 130*c*, nose cutters 130*n*, shoulder cutters 130*s*, gage pad segments 154 and associated near bit sleeve 240. When associated rotary steering unit 92*a* builds angle in horizontal wellbore segment 60*h*, cone cutters 130*c* in zone 231 may interact with formation materials adjacent to the end of horizontal segment 60*h*. See FIG. 4C. Shoulder cutters 130*s* in zone 232 may interact with high side 67 of horizontal segment 60*h*. Depending on location, orientation and/or configuration, one or more nose cutters 130*n* may function as part of zone 232 and interact with adjacent formation material on high side 67 of horizontal segment 60*h*.

For some downhole drilling environments and associated drill bit designs, simulations performed in accordance with teachings of the present disclosure indicate that shoulder cutters 130*s* and possibly some nose cutters 130*n* in zone 232 and cone cutters 130*c* in zone 231 may produce two opposite drag forces. Cone cutters 130*c* in zone 231 may generate right walk force 177*r*. See FIG. 4D. Gage pad segments 154 in zone 233 and exterior portion of sleeve 240 in zone 234 may cooperate with cutters 130*s* and 130*n* in zone 232 to generate combined left walk force 177*l* shown in FIG. D.

Whether rotary drill bit 100*a* walks left or walks right may depend on respective magnitude of left walk force 177*l* and right walk force 177*r*. Methods such as shown in FIGS. 18A-18G may be used to design cutting elements 130*c*, 130*n* and 130*s* and gage pad segments 154*c* and sleeve 240 such that rotary drill bit 100*a* may have approximately zero walk rate for anticipated downhole drilling conditions.

Reaction force 184*e* results from interaction between zones 232, 233 and 234 with high side 67 of horizontal segment 60*h*. Reaction force 184*f* results from interaction between cutters 130*c* in zone 231 and adjacent formation materials. Zone 231 corresponds with zone A in FIG. 4D. Zones 232, 233 and 234 correspond with zones B, C, and D in FIG. 4D.

For some applications, gage pad 154 may have an outside diameter or exterior portions corresponding with the full size or nominal size of associated rotary drill bit 100*a*. The length of gage pad 154 may be relatively short for some downhole drilling environments. A typical length for gage pad 154 may be one or two inches. Sleeve 240 may have outside diameter portions which are undergage or smaller than the nominal diameter associated with rotary drill bit 100*a*. Sleeve 240 may also be tapered. For some applications, sleeve 240 may have the same length as gage pad 154 or may have an increased length as compared with gage pad 154.

The left walk forces generated by zones 232, 233 and 234 of rotary drill bit 100*a* are consistent with the prior understandings of walk tendencies associated with fixed cutter drill bits. Methods such as shown in FIGS. 18A-18G allow designing various components in zones 231, 232, 233 and 234 to compensate for the general tendency of a RSS to generate a left walk force on an associated rotary drill bit.

Figure 4E:
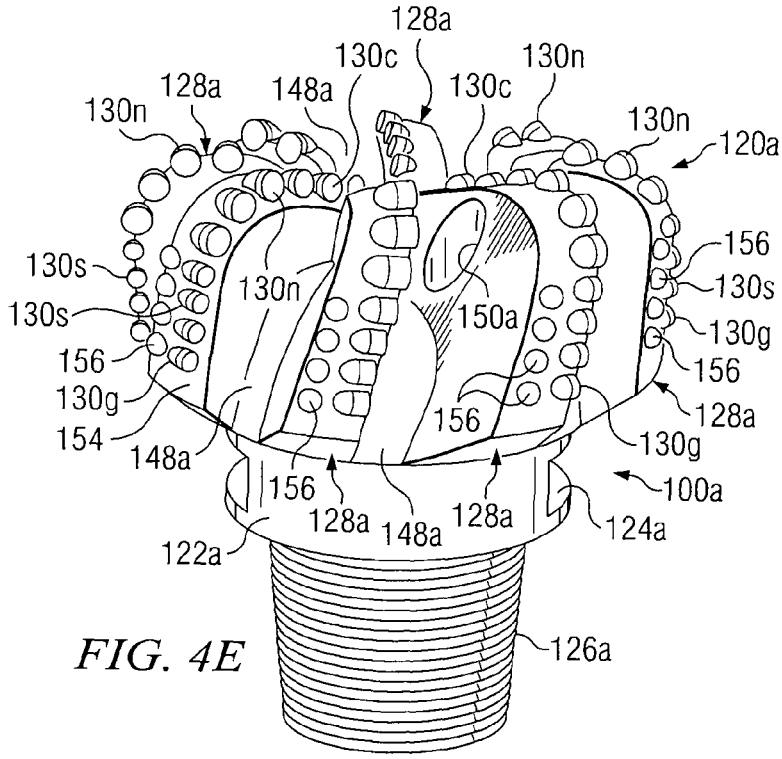
FIG. 4E is a schematic drawing showing an isometric view of a rotary drill bit having various design features which may be optimized for use with a push-the-bit directional drilling system in accordance with teachings of the present disclosure.

For rotary drill bit 100*a* as shown in FIGS. 4E shank 122*a* may include bit breaker slots 124*a* formed on the exterior thereof. Pin 126*a* may be formed as an integral part of shank 122*a* extending from bit body 120*a*. Various types of threaded connections, including but not limited to, API connections and premium threaded connections may be formed on the exterior of pin 126*a*.

A longitudinal bore (not expressly shown) may extend from end 121*a* of pin 126*a* through shank 122*a* and into bit body 120*a*. The longitudinal bore may be used to communicate drilling fluids from drilling string 32 to one or more nozzles (not expressly shown) disposed in bit body 120*a*. Nozzle outlet 150*a* is shown in FIG. 4E.

A plurality of cutter blades 128*a* may be disposed on the exterior of bit body 120*a*. Respective junk slots or fluid flow slots 148*a* may be formed between adjacent blades 128*a*. Each blade 128 may include a plurality of cutting elements 130.

Respective gage cutter 130*g* may be disposed on each blade 128*a*. Rotary drill bit 100*a* may have an active gage or active gage elements disposed on exterior portion of each blade 128*a*. Gage surface 154 of each blade 128*a* may also include a plurality of active gage elements 156. Active gage elements 156 may be formed from various types of hard abrasive materials sometimes referred to as "hardfacing". Active elements 156 may sometimes be described as "buttons" or "gage inserts".

Exterior portions of bit body 120*a* opposite shank 122*a* may be described as a "bit face" or "bit face profile." The bit face profile of rotary drill bit 100*a* may include a generally cone-shaped recess or indentation having a plurality of cone cutters 130*c*, a plurality of nose cutters 130*n* and a plurality of shoulder cutters 130*s* disposed on exterior portions of each blade 128*a*. One of the benefits of the present disclosure includes the ability to design a rotary drill bit having an optimum number of cone cutters, nose cutters, shoulder cutters and gage cutters to provide desired walk rate, bit steerability, and bit controllability.

Point-the-bit directional drilling systems such as shown in FIGS. 5A-5E generally require creation of a fulcrum point between an associated bit cutting structure or bit face profile and associated point-the-bit rotary steering system. The fulcrum point may be formed by a stabilizer or a sleeve disposed uphole from the associated rotary drill bit.

FIG. 5A shows portions of BHA 90*b* disposed in a generally vertical section of wellbore 60*a* as rotary drill bit 100*b* begins to form kick off segment 60*b*. BHA 90*b* includes rotary drill bit steering unit 92*b* which may provide one portion of a point-the-bit directional drilling system. A point-the-bit directional drilling system usually generates a deflection which deforms portions of an associated drill string to direct an associated drill bit in a desired trajectory. See for example FIG. 8A. There are several steering or deflection mechanisms associated with point-the-bit rotary steering systems. However, a common feature of point-the-bit RSS is often a deflection angle generated between the rotational axis of an associated rotary drill bit and longitudinal axis of an associated wellbore.

Point-the-bit directional drilling systems typically form a directional wellbore using a combination of axial bit penetration, bit rotation and bit tilting. Point-the-bit directional drilling systems may not produce side penetration such as described with respect to rotary steering unit 92*a* in FIG. 4A. It may be particularly advantageous to simulate forming a wellbore with a point-the-bit directional drilling system using methods such as shown in FIGS. 18A-18G to consider bit tilting motion in accordance with teachings of the present disclosure. One example of a point-the-bit directional drilling system is the Geo-Pilot® Rotary Steerable System available from Sperry Drilling Services at Halliburton Company.

Figure 5B:
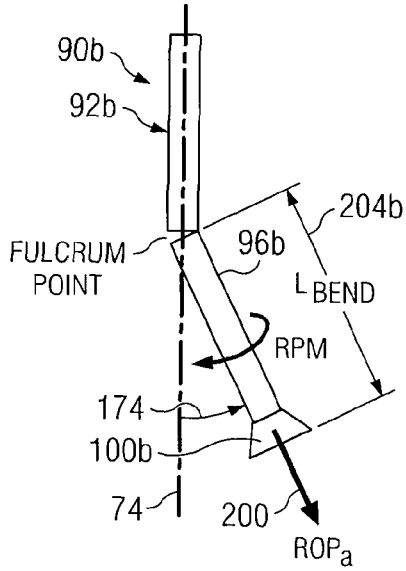
FIG. 5B is a graphical representation showing portions of a point-the-bit directional drilling system forming a directional wellbore.

FIG. 5B is a graphical representation showing various parameters associated with a point-the-bit directional drilling system. Steering unit 92*b* will generally include bent subassembly 96*b*. A wide variety of bent subassemblies may be satisfactorily used to allow drill string 32 to rotate drill bit 100*b* while bent subassembly 96*b* directs or points drill bit 100*b* at a desired angle away from vertical axis 74. Since bend length associated with a point-the-bit directional drilling system is usually relatively small (often less than 12 times associated bit size), most of the cutting action associated with forming a directional wellbore may be a combination of axial bit penetration, bit rotation and bit tilting. See FIGS. 5A, 5B and 8C.

Some bent subassemblies have a constant "bent angle". Other bent subassemblies have a variable or adjustable "bent angle". Bend length 204*b* is generally a function of the dimensions and configurations of associated bent subassembly 96*b*. As previously noted, side penetration of rotary drill bit will generally not occur in a point-the-bit directional drilling system. Arrow 200 represents the rate of penetration along rotational axis of rotary drill bit 100*c*.

Figure 5F:
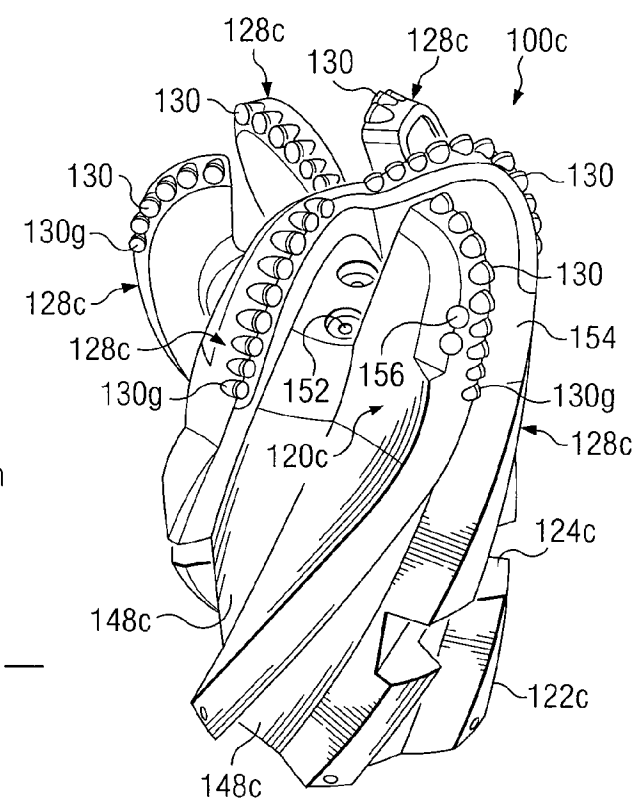
FIG. 5F is a schematic drawing showing an isometric view of a rotary drill bit having various design features which may be optimized for use with a point-the-bit directional drilling system in accordance with teachings of the present disclosure.
Figure 5C:
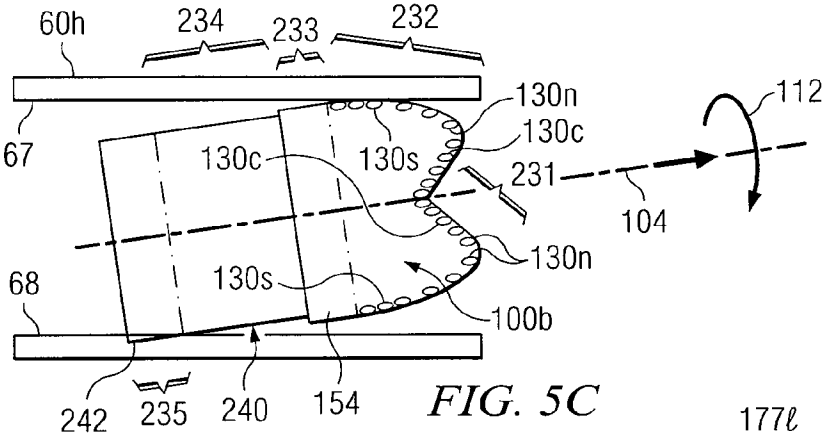
FIG. 5C is a schematic drawing in section with portions broken away showing a point-the-bit directional drilling system and associated fixed cutter drill bit disposed in a generally horizontal wellbore.
Figure 5E:
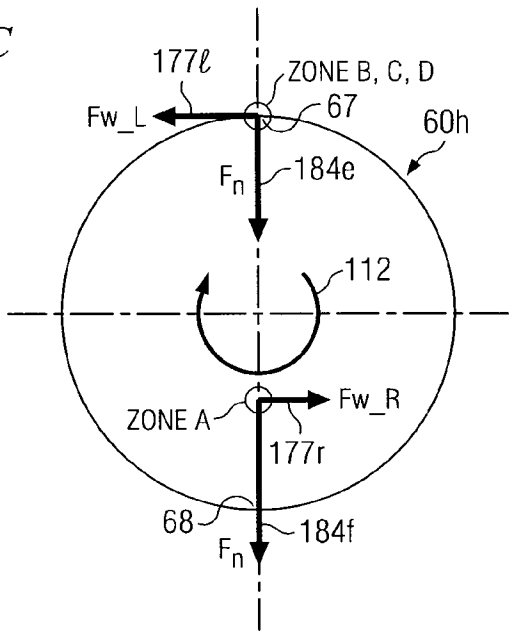
FIG. 5E is a graphical representation showing various forces acting on the stabilizer portion of the rotary drill bit of FIG. 5C.
Figure 5D:
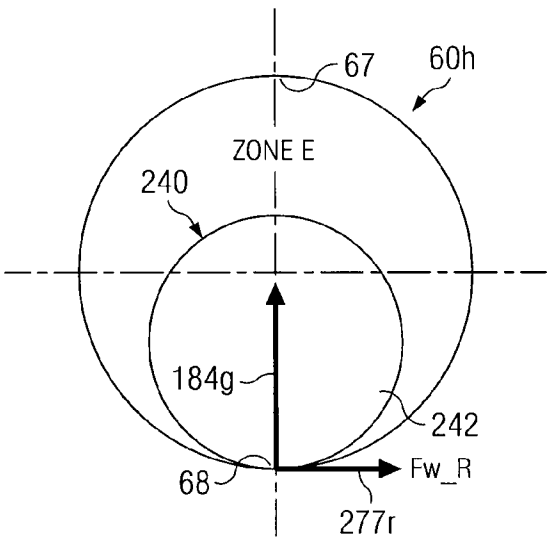
FIG. 5D is a graphical representation showing various forces acting on the fixed cutter rotary drill bit of FIG. 5C.

FIGS. 5C, 5D and 5E show various forces associated with fixed cutter drill bit 100*b* and attached near bit stabilizer or sleeve 240 building an angle relative to horizontal segment 60*h* of a wellbore. Uphole portion 242 of sleeve 240 may contact adjacent portions of horizontal segment 60*b* to provide desired fulcrum point for point-the-bit rotary steering system 92B.

Figure 8A:
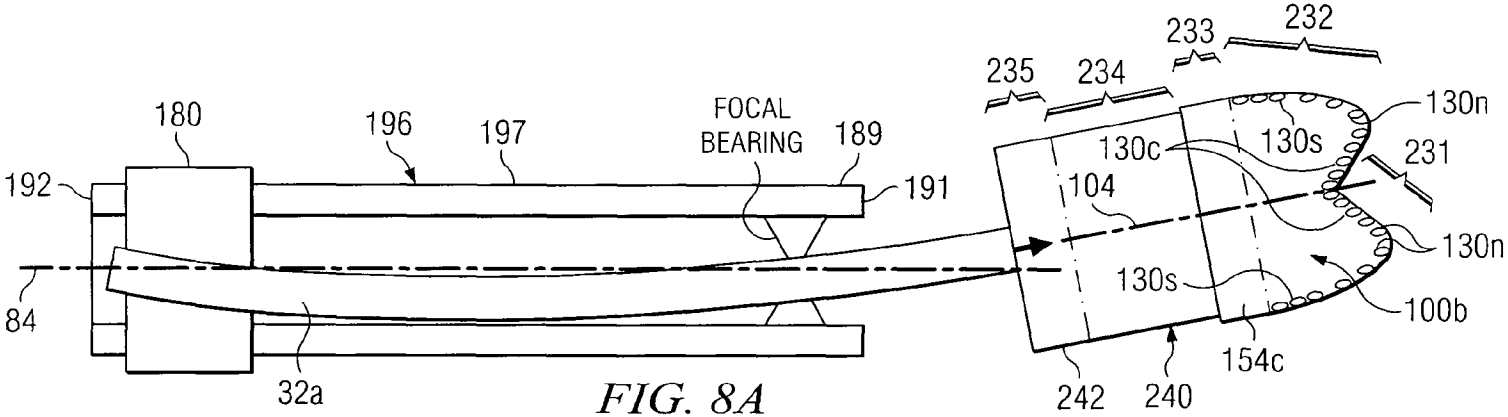
FIGS. 8A and 8B are schematic drawings in section with portions broken away showing typical forces associated with a point-the-bit rotary steering system directing a fixed cutter drill bit in a horizontal wellbore.
Figure 8B:
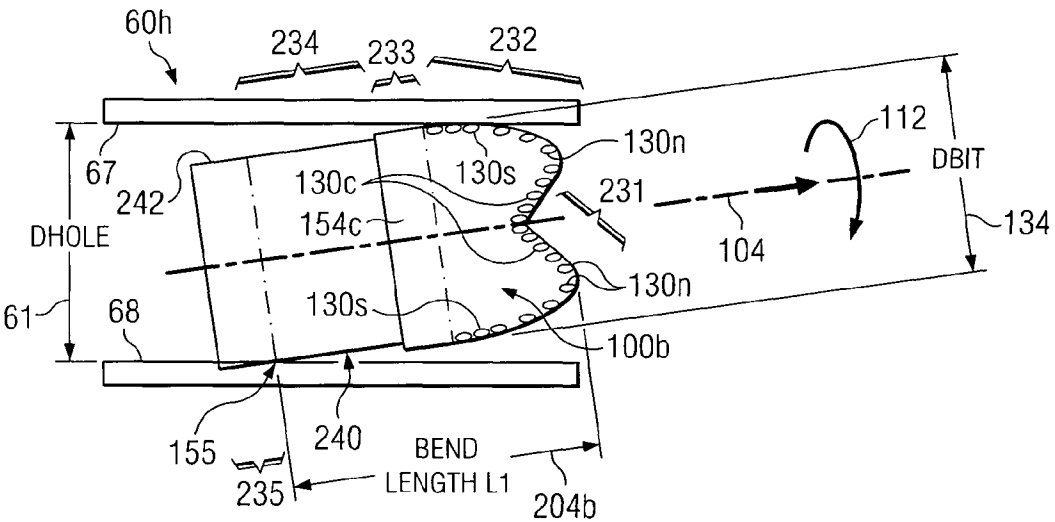

The bit face profile for rotary drill bit 100*b* in FIGS. 5C, 8A and 8B may include a recessed portion or cone shaped with a plurality of cone cutters 130*c* disposed therein. Each blade (not expressly shown) may include a respective nose segment which defines in part an extreme downhole end of rotary drill bit 100*b*. A plurality of nose cutters 130*n* may be disposed on each nose segment. Each blade may also have a respective shoulder extending outward from the respective nose segment. A plurality of shoulder cutters 130*s* may be disposed on each blade.

For some applications, fixed cutter drill bit 100*b* and associated near bit stabilizer or sleeve 240 may be divided into five components for use in evaluating building an angle using the methods shown in FIGS. 18A-18G. Zone 231 with corresponding cone cutting elements 130*c* and zone 235 on exterior portions of sleeve 240 may generate right bit walk force 177*r* as shown in FIG. 5E. Cutters 130 in zone 232 and possibly some nose cutters 130*n* in zone 232 may produce all or portions of left walk force 177*l* as shown in FIG. 5E. Exterior portions of gage pad 154 in zone 233 and exterior portions of sleeve 240 in zone 234 may or may not contact high side 67 of horizontal segment 670.

As shown in FIG. 5D, right walk force 177*r* associated with contact between exterior portions of sleeve 240 adjacent to uphole in 242 may be relatively large. The resulting composite right walk force (277*r* plus 177*r*) may be substantially larger than walk force 177*l*. As a result, rotary drill bit 100*b* may often have a tendency to walk right when a point-the-bit RSS is used with rotary drill bit 100*b* to build a directional well bore from horizontal segment 60*h*.

Point-the-bit RSS may result in cutters 130*c* in zone 231 removing substantially more formation material as compared with cutters 130*c* in zone 231 when a rotary drill bit attached to a push-the-bit rotary steering system. This characteristic of point-the-bit RSS may also increase the combined right walk force (walk force 177*r* plus walk force 277*r*) acting on rotary drill bit 100*b* as compared with the right walk force applied to rotary drill bit 100*a* by associated push-the-bit RSS.

In FIG. 5D, zone E, may generally correspond with zone 235. In FIG. 5E, zone 231, may correspond with zone A and zones 232, 233 and 234 may correspond with zones B, C and D. Reaction forces or normal forces 184E, F and G as shown in FIGS. 5D and 5E result from interactions with respective high sides and low sides of well bore of horizontal segment 60*h*.

FIG. 5F is a schematic drawing showing one example of a rotary drill bit which may be designed in accordance with teachings of the present disclosure for optimum performance in a point-the-bit directional drilling system. For example, methods such as shown in FIGS. 18A-18G may be used to design a rotary drill bit with an optimum ratio of cone cutters, nose cutters, shoulder cutters and gage cutters to form a directional wellbore with a point-the-bit directional drilling system. Rotary drill bit 100*c* may be generally described as a fixed cutter drill bit. For some applications rotary drill bit 100*c* may also be described as a matrix drill bit steel body drill bit and/or a PDC drill bit. Rotary drill bit 100*c* may include bit body 120*c* with shank 122*c*.

Shank 122*c* may include bit breaker slots 124*c* formed on the exterior thereof. Shank 122*c* may also include extensions of associated blades 128*c*. Various types of threaded connections, including but not limited to, API connections and premium threaded connections on shank 122*c* may releasably engage rotary drill bit 100*c* with a drill string. A longitudinal bore (not expressly shown) may extend through shank 122*c* and into bit body 120*c*. The longitudinal bore may communicate drilling fluids from an associated drilling string to one or more nozzles 152 disposed in bit body 120*c*.

A plurality of cutter blades 128*c* may be disposed on the exterior of bit body 120*c*. Respective junk slots or fluid flow slots 148*c* may be formed between adjacent blades 128*a*. Each cutter blade 128*c* may include a plurality of cutters 130*d*.

Blades 128 and 128*d* may also spiral or extend at an angle relative to the associated bit rotational axis. One of the benefits of the present disclosure includes simulating drilling portions of a directional wellbore to determine optimum blade length, blade width and blade spiral for a rotary drill bit which may be used to form all or portions of the directional wellbore. For embodiments represented by rotary drill bits 100*a*, 100*b* and 100*c* associated gage surfaces may be formed proximate one end of blades 128*a*, 128*b* and 128*c* opposite an associated bit face profile.

For some applications bit bodies 120*a*, 120*b* and 120*c* may be formed in part from a matrix of very hard materials associated with rotary drill bits. For other applications bit body 120*a*, 120*b* and 120*c* may be machined from various metal alloys satisfactory for use in drilling wellbores in downhole formations. Examples of matrix type drill bits are shown in U.S. Pat. Nos. 4,696,354 and 5,099,929.

Figure 6A:
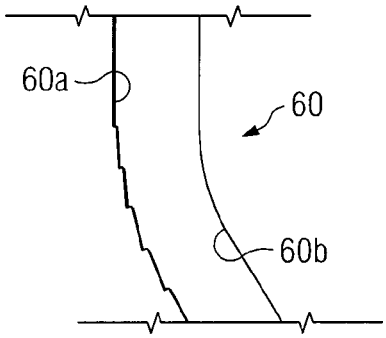
FIG. 6A is a schematic drawing in section with portions broken away showing one simulation of forming a directional wellbore using a simulation model incorporating teachings of the present disclosure.

FIG. 6A is a schematic drawing showing one example of simulating of forming a directional wellbore using a directional drilling system such as shown in FIGS. 4A and 4B or FIGS. 5A and 5B. The simulation in FIG. 6A may generally correspond with forming a transition from vertical segment 60*a* to kick off segment 60*b* of wellbore 60 such as shown in FIGS. 4A and 5B. This simulation may be based on several parameters including, but not limited to, various parameters in Appendix A. The resulting simulation indicates forming a relatively smooth or uniform inside diameter as compared with prior art step hole simulation shown in FIG. 6C.

Figure 6B:
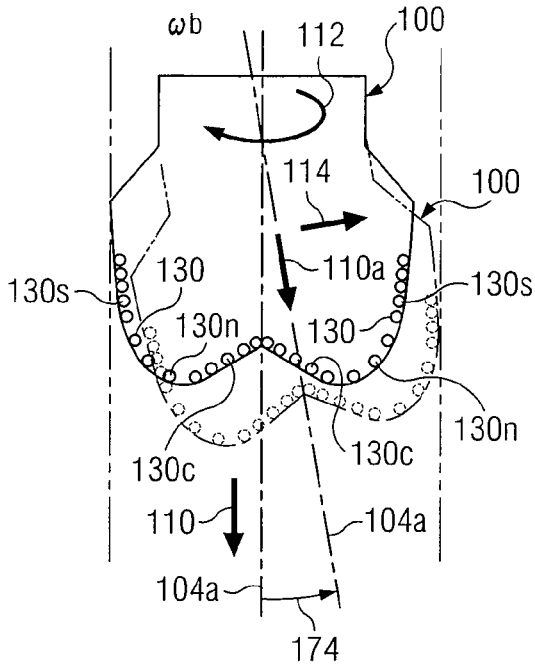
FIG. 6B is a schematic drawing in section with portions broken away showing one example of parameters used to simulate drilling a direction wellbore in accordance with teachings of the present disclosure.

FIG. 6B shows some of the parameters which would be applied to rotary drill bit 100 during formation of a wellbore. Rotary drill bit 100 is shown by solid lines in FIG. 6B during formation of a vertical segment or straight hole segment of a wellbore. Bit rotational axis 100*a* of rotary drill bit 100 will generally be aligned with the longitudinal axis of the associated wellbore, and a vertical axis associated with a corresponding bit hole coordinate system.

Rotary drill bit 100 is also shown in dotted lines in FIG. 6B to illustrate various parameters used to simulate drilling kick off segment 60*b* in accordance with teachings of the present disclosure. Instead of using bit side penetration or bit side cutting motion, the simulation shown in FIG. 6A is based upon tilting of rotary drill bit 100 as shown in dotted lines relative to vertical axis.

Figure 6C:
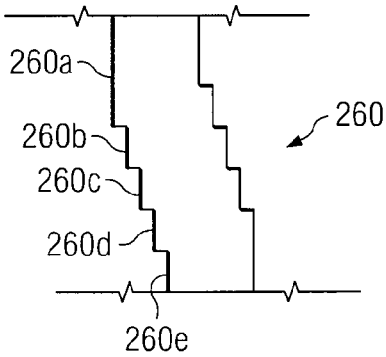
FIG. 6C (PRIOR ART)
FIG. 6C is a schematic drawing in section with portions broken away showing one simulation of forming a direction wellbore using a prior simulation model.
Figure 6D:
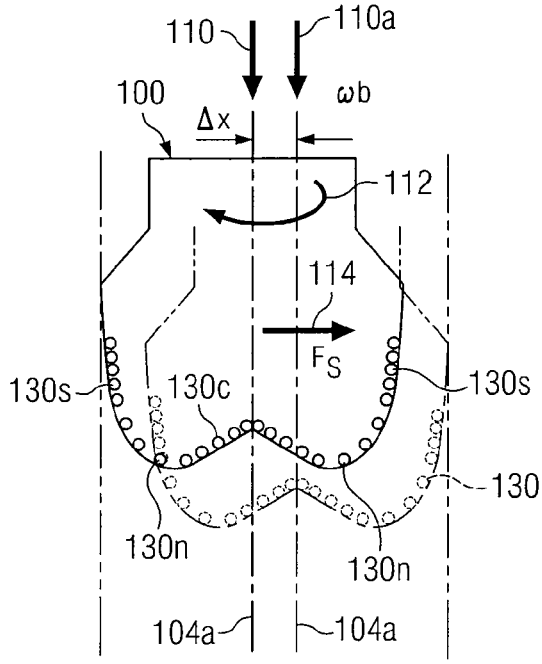
FIG. 6D (PRIOR ART)
FIG. 6D is a schematic drawing in section with portions broken away showing one example of forces used to simulate drilling a directional wellbore with a rotary drill bit in accordance with the prior simulation model.

FIG. 6C is a schematic drawing showing a typical prior simulation which used side cutting penetration as a step function to represent forming a directional wellbore. For the simulation shown in FIG. 6C, the formation of wellbore 260 is shown as a series of step holes 260*a*, 260*b*, 260*c*, 260*d* and 260*e*. As shown in FIG. 6D the assumption made during this simulation was that rotational axis 104*a* of rotary drill bit 100 remained generally aligned with a vertical axis during the formation of each step hole 260*a*, 260*b*, 260*c*, etc. Simulations of forming directional wellbores in accordance with teachings of the present disclosure have indicated the influence of gage length on bit walk rate, bit steerability and bit controllability.

Figure 7A:
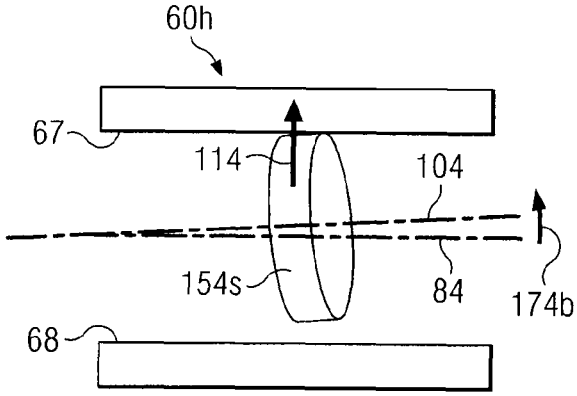
FIG. 7A is a schematic drawing in section with portions broken away showing various forces including a left bit walk force acting on a short gage pad or a short stabilizer while an associated rotary drill bit builds an angle in a generally horizontal wellbore.
Figure 7B:
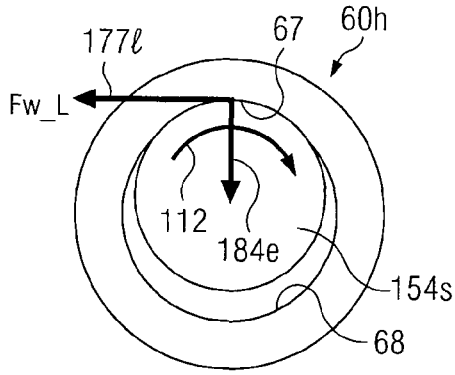
FIG. 7B is a schematic drawing in section with portions broken away showing various forces including a left bit walk force acting on a gage pad or a short stabilizer while an associated rotary drill bit forms a wellbore segment having a dropping angle from a generally horizontal wellbore.
Figure 7C:
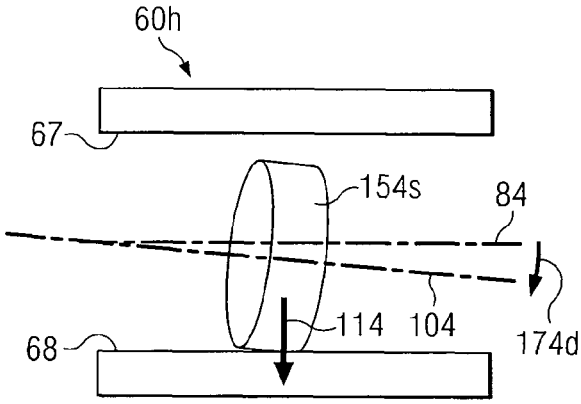
FIGS. 7C and 7D are schematic drawings in section with portions broken away showing bit walk forces acting on a short gage pad or short stabilizer while an associated drill bit forms a dropping angle relative to a generally horizontal wellbore.
Figure 7D:
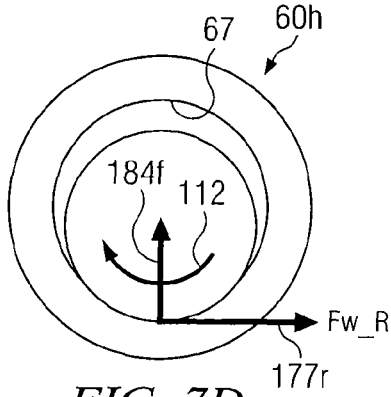

FIGS. 7A-7M are schematic drawings showing various components of a rotary drill bit and/or associated downhole tools disposed in horizontal segment 60*h* of a wellbore. FIGS. 7A and 7B show portions of gage pad 154*s* contacting high side 67 of horizontal wellbore 60*h*. Gage pad 154*s* may be described as "short" when compared to gage pad 154*e*. FIGS. 7C and 7D show portions of Gage pad 154*s* contacting low side 68 of horizontal segment 60*h*.

Gage pad 154*s* may be formed as an integral component of an associated rotary drill bit. See for example gage pad 154 on rotary drill bit 100 in FIG. 2A. Gage pad 154*s* as shown in FIGS. 7A-7D may also represent portions of a short stabilizer or short sleeve attached to uphole portions of an associated rotary drill bit. Gage pad 154*s* may function as an active gage or as a passive gage and may have walk characteristics similar to a "short sleeve" or a "short stabilizer."

FIGS. 7A and 7B show gage pad 154*s* and an associated rotary drill bit building angle from high side 67 of horizontal segment 60*h*. Build angle or tilt angle 174*b* may be represented by the angle formed between longitudinal axis 84 of horizontal segment 60*h* and rotational axis 104 of the associated rotary drill bit. Arrow 114 in FIG. 7A represents the amount of side force applied to adjacent portions of high side 67 of horizontal segment 60*h* by gage pad 154*s*.

FIG. 7B indicates that, left walk force 1171 may be generated by contact between high side 67 and exterior portions of gage pad 154*s*. Reaction force or normal force 184*e* may be applied to exterior portions of gage pad 154*s* as a result of contact with high side 67 of horizontal segment 60*h*. The amount or value of left walk force 177*l* and reaction force 184*e* may depend on various factors including, but not limited to, aggressiveness of gage pad 154*s*, amount of formation materials (if any) removed by gage pad 154*s*, rate of rotation of gage pad 154*s* and the associated rotary drill bit and value or amount of side force 114.

Left walk force 177*l* and reaction force 184*e* do not rotate with gage pad 154*s*. Left walk force 177*l* will generally extend left from associated bit rotational axis 104. Left walk force 177*l* may cause gage pad 154*s* to walk left relative to longitudinal axis 84 of horizontal segment 60*h*. The effect of left walk force 177*l* on the associated rotary drill bit depends on other walk forces applied to other components of the associated rotary drill bit and/or BHA.

FIGS. 7C and 7D show gage pad 154*s* forming a dropping angle from low side 68 of horizontal segment 60*h*. Drop angle or tilt angle 174*d* corresponds with the angle formed between longitudinal axis 84 of horizontal segment 60*h* and rotational axis 104 of the associated rotary drill bit (not expressly shown). Arrow 114 represents the amount of side force applied to gage pad 154*s* and adjacent portions of low side 68 of horizontal segment 60*h* by gage pads 154*s*.

FIG. 7D indicates that right walk force 177*r* may be generated by contact between low side 68 and exterior portions of gage pad 154*s*. The amount or value of right walk force 177*r* and reaction force 184*f* will depend on various factors as previously discussed with respect to left walk force 177*l* in FIGS. 7A and 7B. Right walk force 177*r* and reaction force 184*f* do not rotate with gage pad 154*s*. Right walk force 177*r* will generally extend right from associated bit rotational axis 104. Right walk force 177*r* may cause gage pads 154*s* to walk right relative to longitudinal axis 84 of horizontal segment 60*h*. The effect of right walk force 177*r* on an associated rotary drill bit and other downhole tools will depend on the value of other walk forces applied thereto.

Walk mechanisms associated with a long gage pad, long stabilizer or long sleeve may be significantly different from walk mechanisms associated with a short gage pad, short stabilizer or short sleeve. Gage pad 154*l* may be described as "long" as compared with gage pad 154*s*. Gage pad 154*l* may have walk characteristics similar to a "long sleeve" or a "long stabilizer."

Figure 7E:
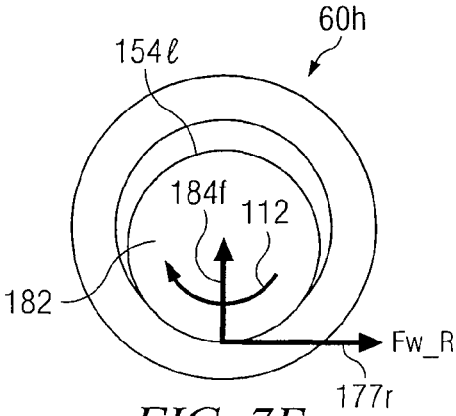
FIGS. 7E, 7F AND 7G are schematic drawings in section showing walk forces associated with a long gage pad, near bit stabilizer and/or sleeve during the building an angle in a generally horizontal wellbore with an associated rotary drill bit.
Figure 7F:
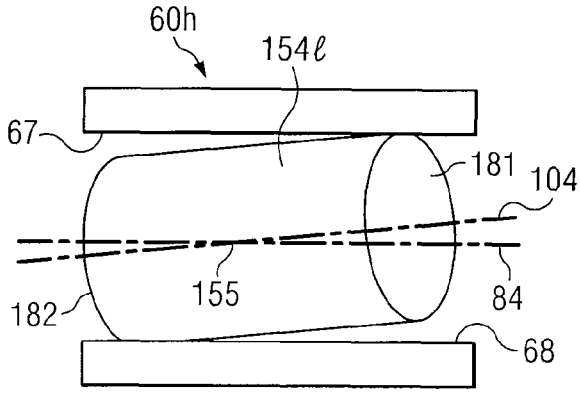
Figure 7G:
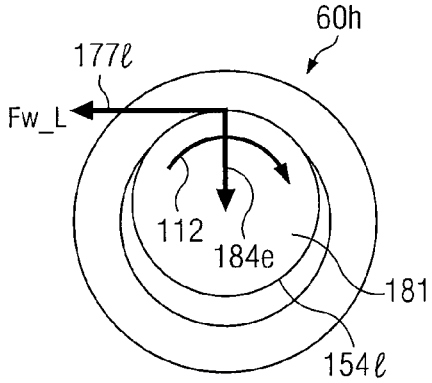

As shown in FIGS. 7E, 7F and 7G gage pad 154*l* and an associated rotary drill bit may build angle by tilting relative to fulcrum point 155 disposed between first end or downhole end 181 and second end or uphole end 182 of gage pad 154*l*. The location of fulcrum point 155 relative to gage pad 154*l* may vary based on several factors including characteristics of each RSS used to direct gage pad 154*l* and an associated rotary drill bit. The associated RSS may tilt gage pad 154*l* and the associated rotary drill bit relative to fulcrum point 155 to effectively divide gage pad 154*l* into two components or segments.

As shown in FIGS. 7E, 7F and 7G exterior portions of gage pad 154*l* proximate uphole end 182 may contact or interact with formation materials adjacent to low side 68 of horizontal segment 60*h*. Exterior portions of gage pad 154*l* proximate downhole end or first end 181 may contact or interact with formation materials adjacent to high side 67 of horizontal segment 60*h*. FIG. 7E shows right walk force 177*r* and reaction force 184*f* generated by exterior portions of gage pad 154*l* adjacent second end or uphole end 182 contacting low side 68 of horizontal segment 60*h*. FIG. 7G shows left walk force 177*l* and reaction force 184*f* generated by contact between exterior portions of downhole end or first end 181 and formation materials proximate uphole side 67 of horizontal segment 60*h*.

Gage pad 154*l* may have a tendency to walk left or walk right depending upon the magnitude of respective walk forces 177*r* and 177*l*. Various factors may affect the magnitude of right walk force 177*r* and left walk force 177*l* such as the location of fulcrum point 155 relative to downhole end 181 and uphole end 182 of gage pad 154*l*. If fulcrum point 155 is located closer to uphole end 182 of gage pad 154*l*, then exterior portions of gage pad 154*l* proximate uphole end 182 may have less interaction or less contact with adjacent portions of horizontal segment 60*h*. See for example gap 82 in FIG. 7H. Exterior portions of gage pad 154*l* proximate downhole end 181 may have increased contact with formation materials proximate high side 67 of horizontal segment 60*h*. As a result of increased contact proximate downhole end 181, left walk force 177*l* may be greater than right walk force 177*r*. Therefore, gage pad 154*l* may tend to walk left based on the location of fulcrum point 155 shown in FIG. 7H.

Another factor which may affect the value of right walk force 177*r* and left walk force 177*l* may be aggressiveness of exterior portions of gage pad 154*l* proximate downhole end 181 and uphole end 182. For example, if exterior portions of gage pad 154*l* proximate uphole end 182 are relatively passive and exterior portions of gage pad 184*l* proximate downhole end 181 are relatively aggressive, then left walk force 177*l* generated by downhole end 181 may be less than right walk force 177*r* generated by exterior portions of gage pad 154*l* proximate uphole end or second end 182. In this case, gage pad 154*l* may have a tendency to walk left based on variations in aggressiveness between exterior portions of gage pad 154*e* proximate downhole end 181 and uphole end 182. Increasing aggressiveness of exterior portions of a gage pad, stabilizer or sleeve may increase its capability of removing formation material and therefore may decrease the amount of side force required to tilt a gage pad relative to longitudinal axis 84 of horizontal segment 60*h*.

Figure 7H:
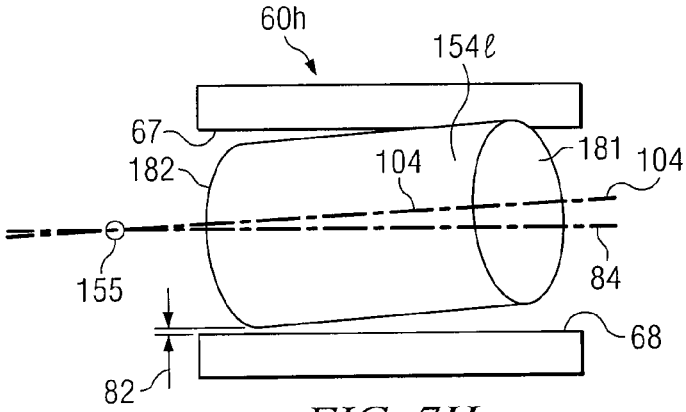
FIGS. 7H and 7I are schematic drawings in section showing left walk forces associated with a long gage pad or sleeve during building a angle from a generally horizontal wellbore by an associated rotary drill bit.
Figure 7I:
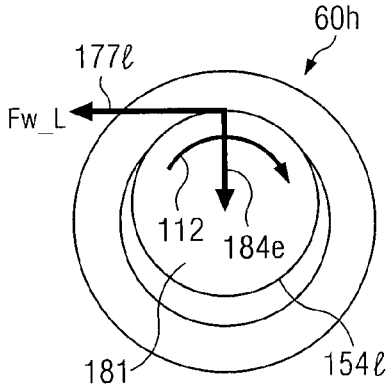

FIGS. 7H and 7I show gage pad 154*l* disposed in horizontal segment 60*h* of a wellbore. For this embodiment, fulcrum point 155 may be located uphole relative to second end 182 of gage pad 154*l*. As a result, exterior portions of gage pad 154*l* adjacent to second end 182 may have little or no contact with formation materials adjacent the low side of horizontal segment 60*h*. See gap 82. As a result, contact between exterior portions of gage pad 154*l* proximate first end 181 may generate relatively large left walk force 177*l*. For embodiments such as shown in FIGS. 7H and 7I, gage pad 154*l* may have a tendency to walk left as a result of only exterior portions of gage pad 154*l* proximate first end 181 contacting formation materials proximate the high side of horizontal segment 60*h* adjacent to first end 181.

Figure 7J:
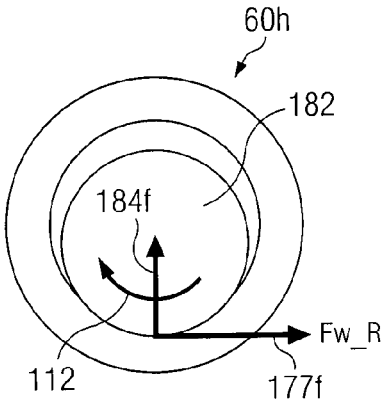
FIGS. 7J and 7K are schematic drawings in section showing right walk forces associated with a long gage pad or sleeve during building angle from a generally horizontal wellbore by an associated rotary drill bit.
Figure 7K:
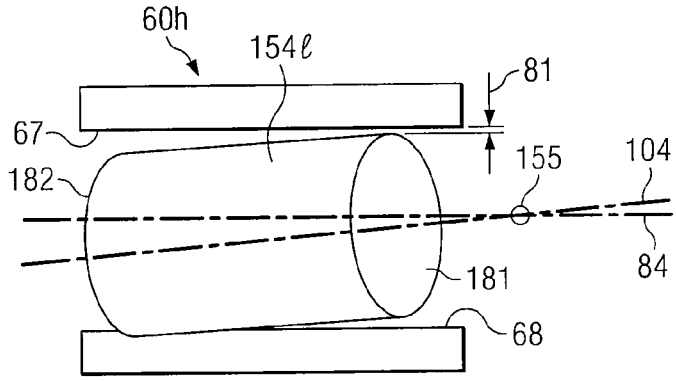

FIGS. 7H and 7K show gage pad 154*l* disposed in horizontal segment 60*h* of a wellbore. For this embodiment, fulcrum point 155 may be located downhole relative to downhole end 181 of gage pad 154*l*. As a result, exterior portions of gage pad 154*l* adjacent to downhole end 181 may have little or no contact with formation materials adjacent to high side 67 of horizontal segment 60*h*. See gap 81. As a result, contact between exterior portions of gage pad 154*l* proximate uphole end 182 may generate relatively large right walk force 177*r*. For embodiments such as shown in FIGS. 7J and 7K, gage pad 154*l* may have a tendency to walk right as a result of only exterior portions of gage pad 154*l* proximate uphole end 182 contacting formation materials on low side 68 of horizontal segment 60*a*.

Oversized wellbores, non-circular wellbores and/or non-symmetrical wellbores may sometimes be formed due to heavy mechanical loads from various components of a BHA, RSS, near bit stabilizers, near bit sleeve and/or gage pads removing excessive amounts of adjacent formation materials and/or anisotropy of associated formation materials. Such wellbores may have oval or elliptical configurations. Erosion resulting from drilling fluid flow between exterior portions of a drill string and adjacent interior portions of a wellbore may erode formation materials and cause enlarged (oversized), non-circular and/or non-concentric wellbores. Such wellbores may often occur when drilling through soft sand or other soft formation materials with low compressive strength.

Figure 7M:
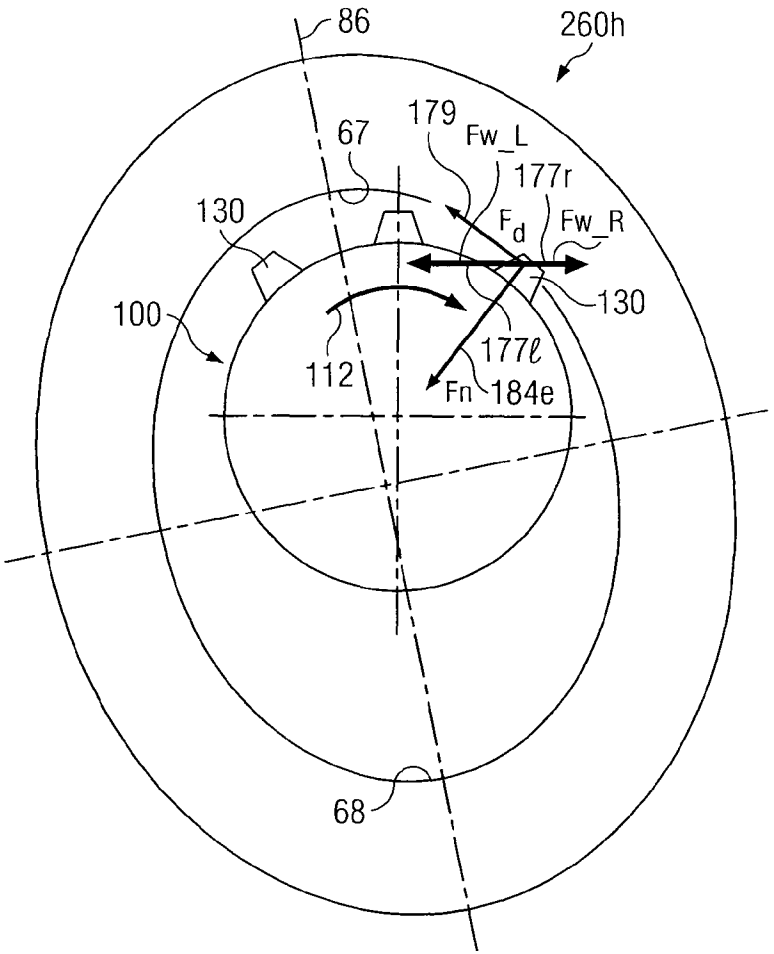
FIG. 7M is a schematic drawing in section showing bit walk left forces associated with a fixed cutter drill bit forming a directional wellbore having a non-circular cross-section.
Figure 7L:
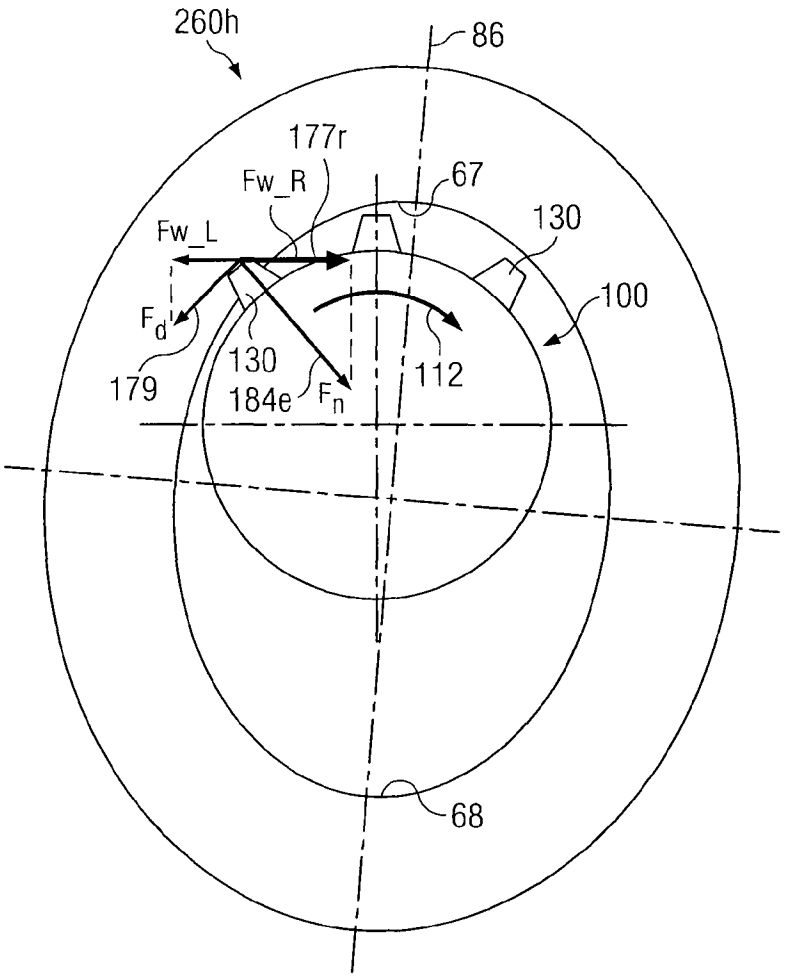
FIG. 7L is a schematic drawing in section showing bit walk right forces associated with a fixed cutter drill bit forming a directional wellbore having a non-circular cross-section.

FIGS. 7L and 7M show examples of walk forces which may result from an enlarged wellbore having a non-circular cross-section. Interior dimensions and configurations of horizontal segments 260*h* and 360*h* as shown in FIGS. 7L and 7M are substantially larger than the outside diameter of rotary drill bit 100 and other components of a BHA used to form horizontal segments 260*h* and 360*h*.

Without regard to the type RSS used (either push-the bit or point-the bit) excessive amounts of force will generally be required to satisfactorily steer or direct rotary drill bit 100 while building angle or forming a wellbore with dropping angle from either horizontal segment 260*h* or horizontal segment 360*h*. Relatively large amounts of deflection of rotary drill bit will generally be required to form a directional wellbore extending from horizontal segment 260*h* or 360*h*. Large amounts of deflection generally produce relatively large side forces acting on rotary drill bit 100, associated gage pad, sleeves and/or stabilizers. Large side forces associated with very large deflection angles often generate very strong right walk forces. Depending on the amount of deflection and required side force, the resulting right walk force may exceed all other walk forces acting on rotary drill bit 100 and associated downhole tools and components.

FIGS. 7L and 7M show some effects of wellbores having with generally elliptical cross-sections and/or oversized cross-sections on bit walk when large deflection angles and large side forces do not effectively cancel all other walk forces. In FIG. 7L long axis 86 of elliptical wellbore 260*h* is shown oriented to the right of high side 67 of elliptical wellbore 260*h*. Right walk force 177*r* may be generated as rotary drill bit 100 builds angle. When long axis 86 of elliptical wellbore 360*h* is located to the left of high side 67 as shown in FIG. 7M, left walk force 177*l* may be generated when associated rotary drill bit 100 builds angle.

As shown in FIG. 7L when cutting elements 130 engages adjacent formation materials drag force 179 will be created. Normal force 184*e* resulting from interactions between cutting element 130 will also be produced. The large side force associated with steering rotary drill bit 100 in over-sized wellbore 260*h* will produce corresponding large normal force 184*e*. Drag force 179 will create left walk force 177*l* which will decrease the value of right walk force 177*r* produced by normal force 184*e*. Rotary drill bit 100 will still typically walk right when forming horizontal segment 260*h* as shown in FIG. 7L since the associated side force is large or very large.

As shown in FIG. 7M long axis 86 of elliptical cross section of horizontal 360*h* is located left of high side 67. Left walk force 177*l* may be generated as rotary drill bit 100 builds angle. Engagement between cutting element 130 and adjacent formation materials may create drag force 179 and reaction force or normal force 184*e*. Assuming the same value of side force is applied to rotary drill bit 100 in FIGS. 7L and 7M and all other downhole drilling conditions are the same except for the orientation of longitudinal axis 86, drag force 79 and normal force 184*e* will have approximately the same value in both FIGS. 7L and 7M. However, the value of left walk force 177*l* will be substantially larger and the value of right walk force 177*r* will be substantially smaller in FIG. 7M as compared to FIG. 7L. In FIG. 7M, drag force 179 and normal force 184*e* cooperate with each other to substantially increase the size of left walk force 177*l*. The interaction between drag force 179 and normal force 184*e* reduces the size of right walk force 177*r*. Therefore, as shown in FIG. 7M relatively strong left walk force 177*l* may cause rotary drill bit 100 to walk left.

FIGS. 8A and 8B show interactions which may occur when a point-the-bit RSS directs rotary drill bit 100*b* to build angle in horizontal segment 60*h* of a wellbore. Point-the-bit RSS may include orientation unit 196. Various steering and/or deflection mechanisms may be disposed within housing 197 of orientation unit 196 to deflect drill string or drill shaft 32*a* at a desired angle relative to housing 196 and adjacent portions of a wellbore. Focal bearing 189 may be disposed in housing 196 approximate first end or downhole end 191. Stabilizer 180 may form part of orientation unit 196 proximate second end or uphole end 192. From time to time, exterior portions of stabilizer 180 may contact adjacent portions of horizontal segment 60*h* as appropriate to protect housing 196. However, contact between exterior portions of stabilizer 180 and adjacent portions of horizontal segment 60*h* do not act as a fulcrum point to direct or steer rotary drill bit 100*b*.

As shown in FIG. 8B, fulcrum point 155 may be formed by a contact between exterior portions of sleeve or stabilizer 240 with low side 68 of horizontal segment 60*h*. As previously noted, push-the-bit RSS generally require that a fulcrum point be created between the bit face profile of rotary drill bit 100*a* and components of the associated RSS such as orientation unit 196 to satisfactorily direct or steer rotary drill bit 100*b*. For embodiments such as shown in FIG. 8B, hole diameter 61 may be larger than associated bit diameter or bit size 134. As a result, relatively large deflection angles and/or side forces may be required to steer rotary drill bit 100*b* to build angle from horizontal side forces may be required to steer rotary drill bit 100*b* to build angle from horizontal segment 60*h*.

Figure 9A:
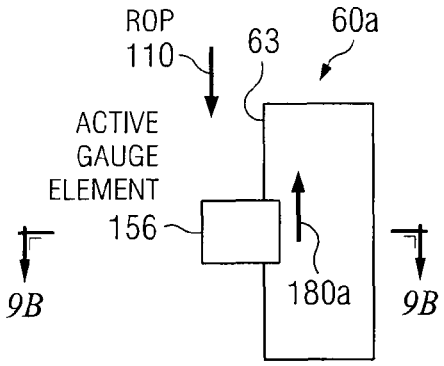
FIG. 9A is a schematic drawing in section showing typical forces of associated with an active gage element engaging adjacent portions of a wellbore.
Figure 9C:
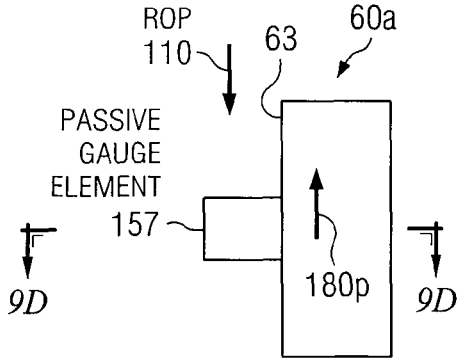
FIG. 9C is a schematic drawing in section with portions broken away associated with a passive gage element interacting with adjacent portions of a wellbore.
Figure 9B:
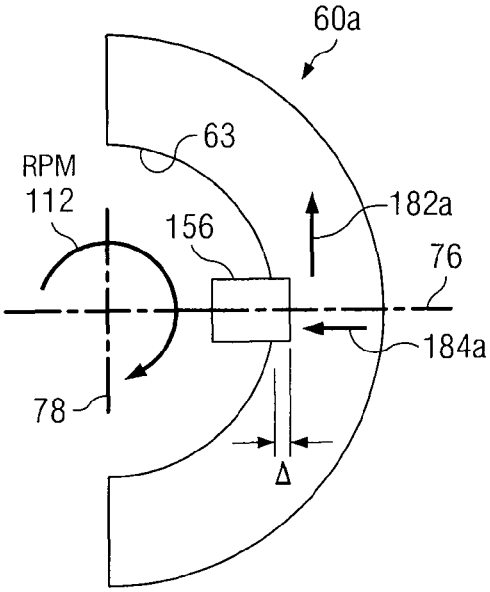
FIG. 9B is a schematic drawing in section taken along lines 9B-9B of FIG. 9A.
Figure 9D:
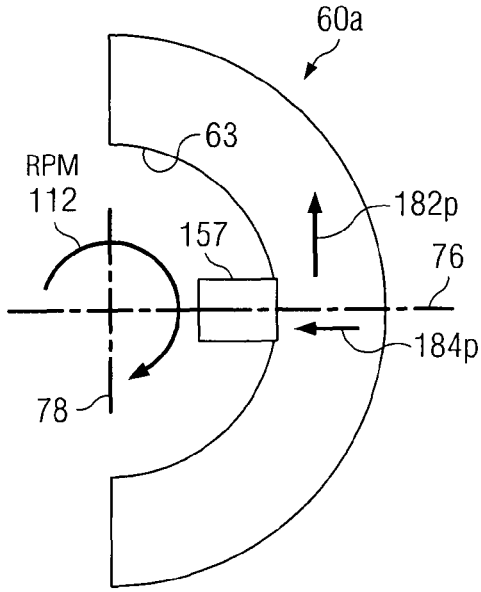
FIG. 9D is a schematic drawing in section with portions broken away taken along lines 9D-9D of FIG. 9C.

FIGS. 9A and 9B show interaction between active gage element 156 and adjacent portions of sidewall 63 of wellbore segment 60*a*. FIGS. 9C and 9D show interaction between passive gage element 157 and adjacent portions of sidewall 63 of wellbore segment 60*a*. Active gage element 156 and passive gage element 157 may be relatively small segments or portions of respective active gage 138 and passive gage 139 which contacts adjacent portions of sidewall 63.

Figure 8C:
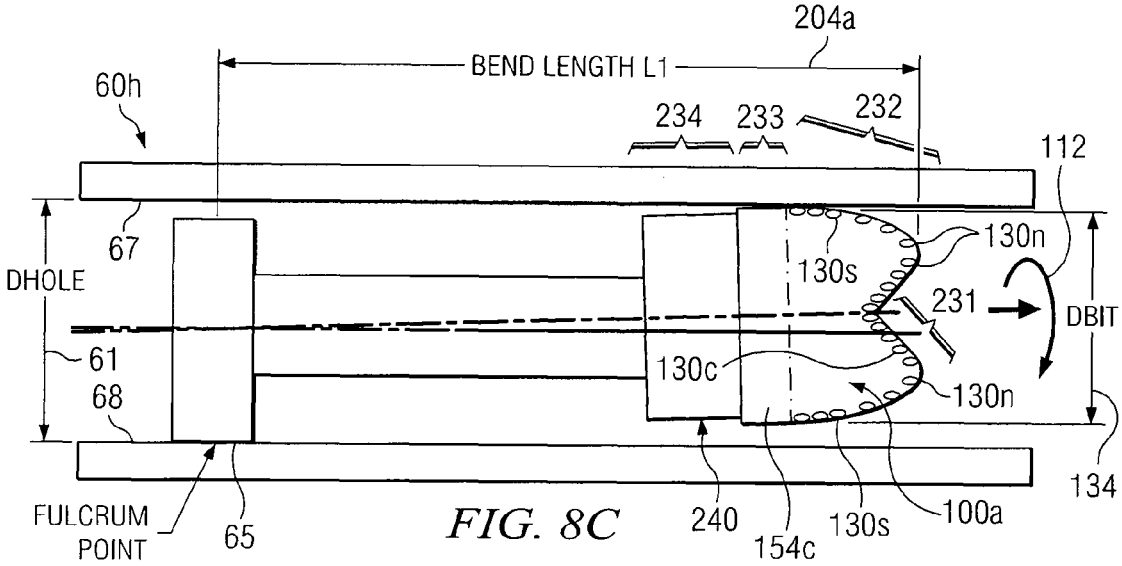
FIG. 8C is a schematic drawing in section with portions broken away showing typical forces associated with a push-the-bit rotary steering system directing a fixed cutter drill bit in a horizontal wellbore.

Arrow 180*a* represents an axial force ($F_a$) which may be applied to active gage element 156 as active gage element engages and removes formation materials from adjacent portions of sidewall 63 of wellbore segment 60*a*. Arrow 180*p* as shown in FIG. 8C represents an axial force ($F_a$) applied to passive gage cutter 130*p* during contact with sidewall 63. Axial forces applied to active gage 130*g* and passive gage 130*p* may be a function of the associated rate of penetration of rotary drill bit 100*e*.

Arrow 182*a* associated with active gage element represents drag force ($F_d$) associated with active gage element 156 penetrating and removing formation materials from adjacent portions of sidewall 63. A drag force ($F_d$) may sometimes be referred to as a tangent force ($F_t$) which generates torque on an associate gage element. The amount of penetration in inches is represented by Δ as shown in FIG. 9B.

Arrow 182*p* represents the amount of drag force ($F_d$) applied to passive gage element 130*p* during plastic and/or elastic deformation of formation materials in sidewall 63 when contacted by passive gage 157. The amount of drag force associated with active gage element 156 is generally a function of rate of penetration of associated rotary drill bit 100*e* and depth of penetration of respective gage element 156 into adjacent portions of sidewall 63. The amount of drag force associated with passive gage element 157 is generally a function of the rate of penetration of associated rotary drill bit 100*e* and elastic and/or plastic deformation of formation materials in adjacent portions of sidewall 63.

Arrow 184*a* as shown in FIG. 9B represents a normal force ($F_n$) applied to active gage element 156 as active gage element 156 penetrates and removes formation materials from sidewall 63 of wellbore segment 60*a*. Arrow 184*p* as shown in FIG. 9D represents a normal force ($F_n$) applied to passive gage element 157 as passive gage element 157 plastically or elastically deforms formation material in adjacent portions of sidewall 63. Normal force ($F_n$) is directly related to the cutting depth of an active gage element into adjacent portions of a wellbore or deformation of adjacent portions of a wellbore by a passive gage element. Normal force ($F_n$) is also directly related to the cutting depth of a cutter into adjacent portions of a wellbore.

The following algorithms may be used to estimate or calculate forces associated with contact between an active and passive gage and adjacent portions of a wellbore. The algorithms are based in part on the following assumptions:

An active gage may remove some formation material from adjacent portions of a wellbore such as sidewall 63. A passive gage may deform adjacent portions of a wellbore such as sidewall 63. Formation materials immediately adjacent to portions of a wellbore such as sidewall 63 may be satisfactorily modeled as a plastic/elastic material.

For each small element or portion of an active gage (sometimes referred to as a "cutlet") which removes formation material:

$$F_n = ka_1 * \Delta 1 + ka_2 * \Delta 2$$

$$F_a = ka_3 * F_r$$

$$F_d = ka_4 * F_r$$

Where Δ1 is the cutting depth of a respective cutlet (small gage element) extending into adjacent portions of a wellbore, and Δ2 is the deformation depth of hole wall by a respective cutlet.

$ka_1$, $ka_2$, $ka_3$ and $ka_4$ are coefficients related to rock properties and fluid properties often determined by testing of anticipated downhole formation material.

For each cutlet or small element of a passive gage which deforms formation material:

$$F_n = kp_1 * \Delta p$$

$$F_a = kp_2 * F_r$$

$$F_d = kp_3 * F_r$$

Where Δp is depth of deformation of formation material by a respective cutlet contacting adjacent portions of the wellbore.

$kp_1$, $kp_2$, $kp_3$ are coefficients related to rock properties and fluid properties and may be determined by testing of anticipated downhole formation material.

Many rotary drill bits have a tendency to "walk" relative to a longitudinal axis of a wellbore while forming the wellbore. The tendency of a rotary drill bit to walk may be particularly noticeable when forming directional wellbores and/or when the rotary drill bit penetrates adjacent layers of different formation material and/or inclined formation layers. An evaluation of bit walk rates requires consideration of all forces acting on a rotary drill bit which extend at an angle relative to a tilt plane. Such forces include interactions between bit face profile, active and/or passive gages associated with rotary drill bit and exterior portions of an associated bottom hole may be evaluated.

Figure 10:
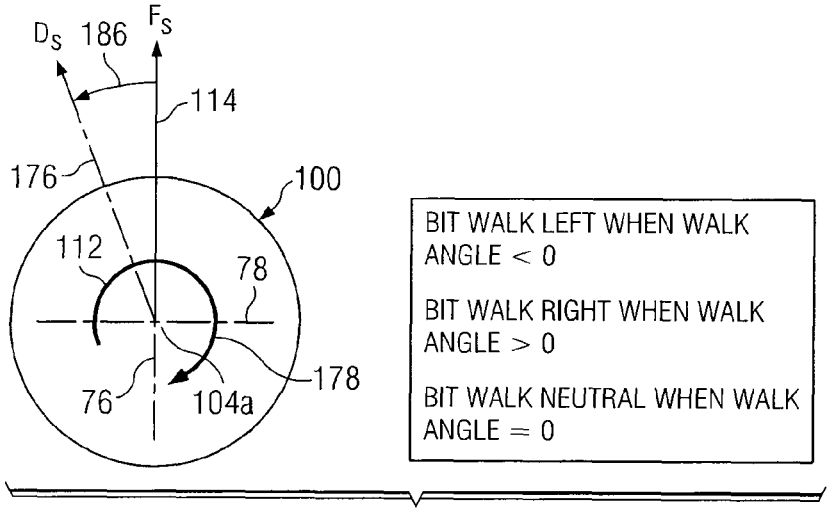
FIG. 10 is a graphical representation of forces used to calculate a walk angle of a rotary drill bit at a downhole location in a wellbore.

FIG. 10 is a schematic drawing showing portions of rotary drill bit 100 in section in a two dimensional hole coordinate system represented by X axis 76 and Y axis 78. Arrow 114 represents a side force applied to rotary drill bit 100 from directional drilling system 20 in tilt plane 170. This side force generally acts normal to bit rotational axis 104*a* of rotary drill bit 100. Arrow 176 represents side cutting or side displacement ($D_s$) of rotary drill bit 100 projected in the hole coordinate system in response to interactions between exterior portions of rotary drill bit 100 and adjacent portions of a downhole formation. Bit walk angle 186 is measured from arrow 114 ($F_s$) to arrow 176 ($D_s$).

Figure 15A:
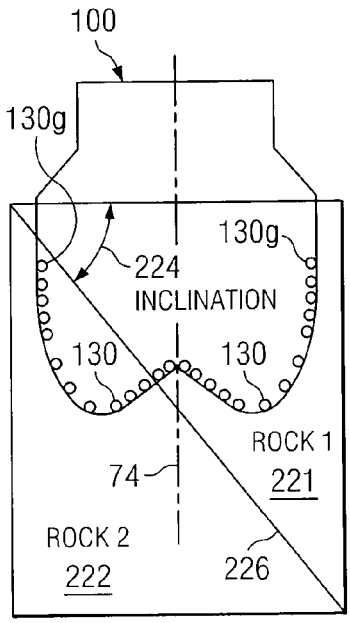
FIG. 15A is a schematic drawing in section with portions broken away showing interaction between a rotary drill bit and two inclined formations during generally vertical drilling relative to the formation.
Figure 15B:
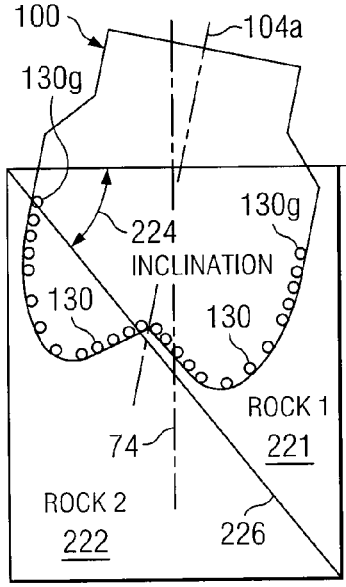
FIG. 15B is a schematic drawing in section with portions broken away showing a graphical representation of a rotary drill bit interacting with two inclined formations during directional drilling relative to the formations.
Figure 15C:
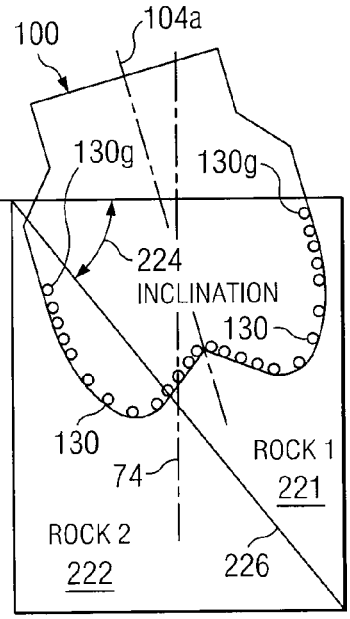
FIG. 15C is a schematic drawing in section with portions broken away showing a graphical representation of a rotary drill bit interacting with two inclined formations during directional drilling of the formations.

When angle 186 is less than zero (opposite to bit rotation direction represented by arrow 178) rotary drill bit 100 will have a tendency to walk to the left of applied side force 114 and titling plane 170. When angle 186 is greater than zero (the same as bit rotation direction represented by arrow 178) rotary drill bit 100 will have a tendency to walk right relative to applied side force 114 and tilt plane 170. When bit walk angle 186 is approximately equal to zero (0), rotary drill bit 100 will have approximately a zero (0) walk rate or neutral walk tendency. Simulations incorporating teachings of the present disclosure indicate that transition drilling through an inclined formation such as shown in FIGS. 15A, 15B and 15C may change bit walk tendencies from bit walk right to bit walk left.

Figure 11:
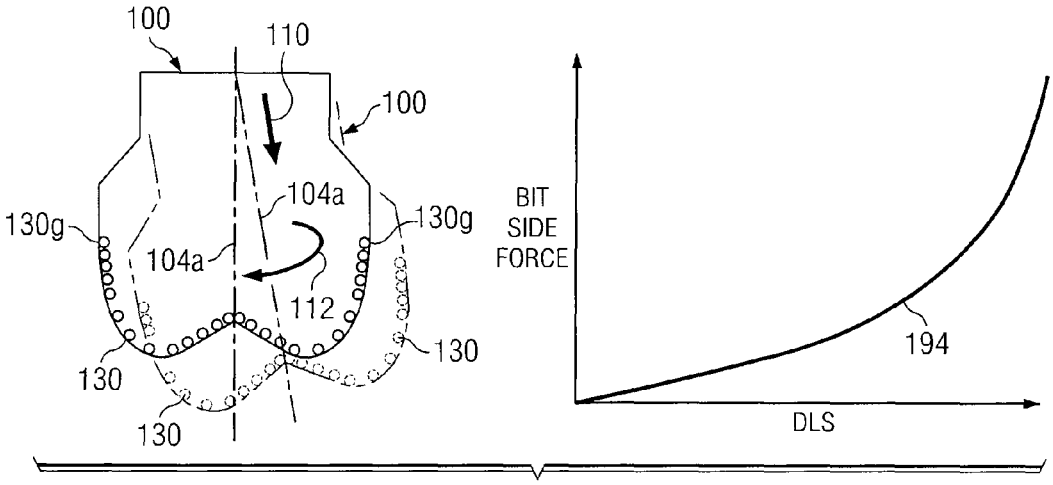
FIG. 11 is a schematic drawing in section with portions broken away of a rotary drill bit showing changes in bit side forces with respect to changes in dog leg severity (DLS) during drilling of a directional wellbore.

FIG. 11 is a schematic drawing showing rotary drill bit 100 in solid lines in a first position associated with forming a generally vertical section of a wellbore. Rotary drill bit 100 is also shown in dotted lines in FIG. 11 showing a directional portion of a wellbore such as kick off segment 60*a*. The graph shown in FIG. 11 indicates that the amount of bit side force required to produce a tilt rate corresponding with the associated dogleg severity (DLS) will generally increase as the dogleg severity of the deviated wellbore increases. The shape of curve 194 as shown in FIG. 11 may be a function of both rotary drill bit design parameters and associated downhole drilling conditions.

Figure 12:
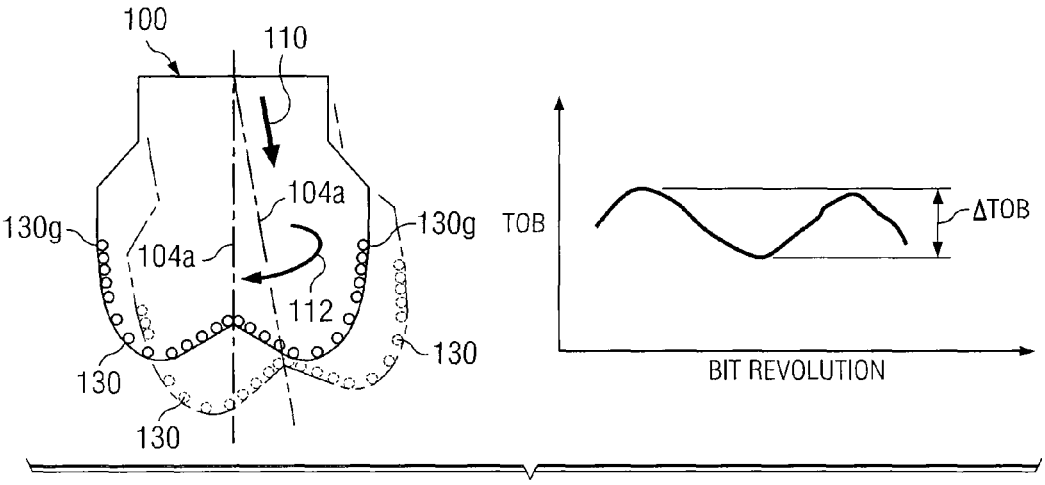
FIG. 12 is a schematic drawing in section with portions broken away of a rotary drill bit showing changes in torque on bit (TOB) with respect to revolutions of a rotary drill bit during drilling of a directional wellbore.

FIG. 12 is a graphical representation showing variations in torque on bit with respect to revolutions per minute during the tilting of rotary drill bit 100 as shown in FIG. 12. The amount of variation or the ΔTOB as shown in FIG. 12 may be used to evaluate the stability of various rotary drill bit designs for the same given set of downhole drilling conditions. The graph shown in FIG. 12 is based on a given rate of penetration, a given RPM and a given set of downhole formation data.

For some applications steerability of a rotary drill bit may be evaluated using the following steps. Design data for the associated drilling equipment may be inputted into a three dimensional model incorporating teachings of the present disclosure. For example design parameters associated with a drill bit may be inputted into a computer system (see for example FIG. 1C) having a software application operable to carry out various methods as shown and described in FIGS. 18A-18G. Alternatively, rotary drill bit design parameters may be read into a computer program from a bit design file or drill bit design parameters such as International Association of Drilling Contractors (IADC) data may be read into the computer program.

Drilling equipment operating data such as RPM, ROP, and tilt rate for an associated rotary drill bit may be selected or defined for each simulation. A tilt rate or DLS may be defined for one or more formation layers and an associated inclination angle for adjacent formation layers. Formation data such as rock compressive strength, transition layers and inclination angle of each transition layer may also be defined or selected.

Total run time, total number of bit rotations and/or respective time intervals per the simulation may also be defined or selected for each simulation. 3D simulations or modeling using a system such as shown in FIG. 1C and software or computer programs operable to carry out one or more of the methods shown in FIGS. 18A-18G may then be conducted to calculate or estimate various forces including side forces acting on a rotary drill bit or other associated downhole drilling equipment.

The preceding steps may be conducted by changing DLS or tilt rate and repeated to develop a curve of bit side forces corresponding with each value of DLS. Another set of rotary drill bit operating parameters may then be inputted into the computer and steps 3 through 7 repeated to provide additional curves of side force ($F_s$) versus dogleg severity (DLS). Bit steerability may then be defined by the set of curves showing side force versus DLS.

Figure 13:
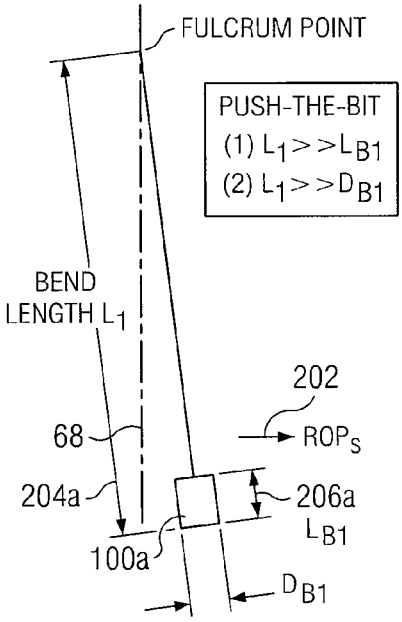
FIG. 13 is a graphical representation of various dimensions associated with a push-the-bit directional drilling system.

FIG. 13 may be described as a graphical representation showing portions of a BHA and rotary drill bit 100*a* associated with a push-the-bit directional drilling system. A push-the-bit directional drilling system may be sometimes have a bend length greater than 20 to 35 times an associated bit size or corresponding bit diameter in inches. Bend length 204*a* associated with a push-the-bit directional drilling system is generally much greater than length 206*a* of rotary drill bit 100*a*. Bend length 204*a* may also be much greater than or equal to the diameter $D_{B1}$ of rotary drill bit 100*a*.

Figure 14:
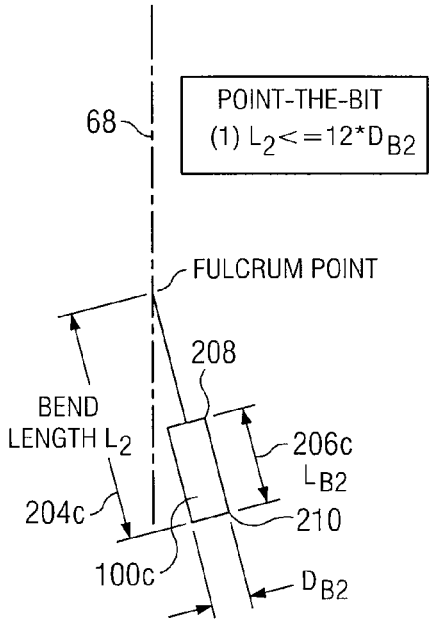
FIG. 14 is a graphical representation of various dimensions associated with a point-the-bit directional drilling system.

FIG. 14 may be generally described as a graphical representation showing portions of a BHA and rotary drill bit 100*c* associated with a point-the-bit directional drilling system. A point-the-bit directional drilling system may sometimes have a bend length less than or equal to 12 times the bit size. For the example shown in FIG. 14, bend length 204*c* associated with a point-the-bit directional drilling system may be approximately two or three times greater than length 206*c* of rotary drill bit 100*c*. Length 206*c* of rotary drill bit 100*c* may be significantly greater than diameter $D_{B2}$ of rotary drill bit 100*c*. The length of a rotary drill bit used with a push-the-bit drilling system will generally be less than the length of a rotary drill bit used with a point-the-bit directional drilling system.

Due to the combination of tilting and axial penetration, rotary drill bits may have side cutting motion. This is particularly true during kick off drilling. However, the rate of side cutting is generally not a constant for a drill bit and is changed along drill bit axis. The rate of side penetration of rotary drill bits 100*a* and 100*c* is represented by arrow 202. The rate of side penetration is generally a function of tilting rate and associated bend length 204*a* and 204*d*. For rotary drill bits having a relatively long bit length and particularly a relatively long gage length, the rate of side penetration at point 208 may be much less than the rate of side penetration at point 210. As the length of a rotary drill bit increases, the side penetration rate proximate an uphole portion of the bit may decrease as compared with a downhole portion of the bit. The difference in rate of side penetration between point 208 and 210 may be small, but the effects on bit steerability may be very large.

FIGS. 15A, 15B and 15C are schematic drawings showing representations of various interactions between rotary drill bit 100 and adjacent portions of first formation 221 and second formation layer 222. Software or computer programs operable to carry out one or more methods shown in FIGS. 18A-18G may be used to simulate or model interactions with multiple or laminated rock layers forming a wellbore.

For some applications first formation layer may have a rock compressibility strength which is substantially larger than the rock compressibility strength of second layer 222. For embodiments such as shown in FIGS. 15A, 15B and 15C first layer 221 and second layer 222 may be inclined or disposed at inclination angle 224 (sometimes referred to as a "transition angle") relative to each other and relative to vertical. Inclination angle 224 may be generally described as a positive angle relative associated vertical axis 74.

Three dimensional simulations may be performed to evaluate forces required for rotary drilling bit 100 to form a substantially vertical wellbore extending through first layer 221 and second layer 222. See FIG. 15A. Three dimensional simulations may also be performed to evaluate forces which must be applied to rotary drill bit 100 to form a directional wellbore extending through first layer 221 and second layer 222 at various angles such as shown in FIGS. 15B and 15C. A simulation using software or a computer program such as outlined in FIG. 18A-18G may be used calculate the side forces which must be applied to rotary drill bit 100 to form a wellbore to tilt rotary drill bit 100 at an angle relative to vertical axis 74.

Figure 15D:
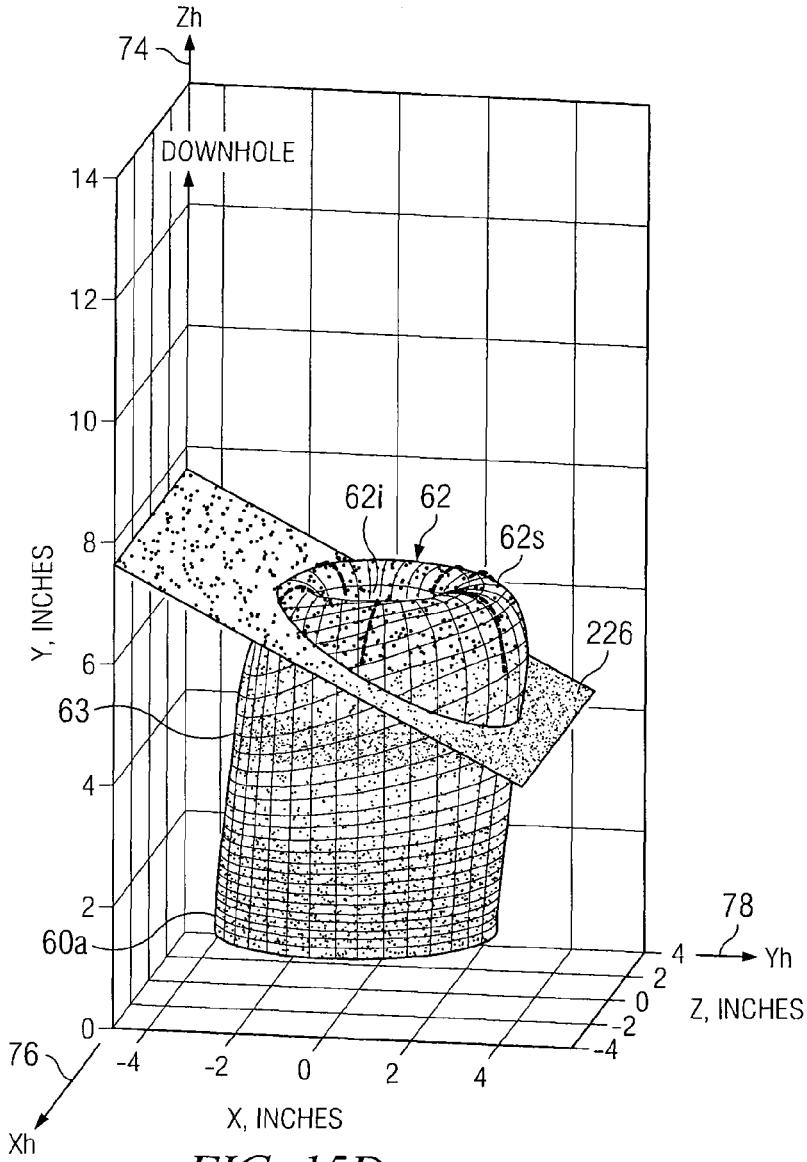
FIG. 15D shows one example of a three dimensional graphical simulation incorporating teachings of the present disclosure of a rotary drill bit penetrating a first rock layer and a second rock layer.

FIG. 15D is a schematic drawing showing a three dimensional meshed representation of the bottom hole or end of wellbore segment 60*a* corresponding with rotary drill bit 100 forming a generally vertical or horizontal wellbore extending therethrough as shown in FIG. 15A. Transition plane 226 as shown in FIG. 15D represents a dividing line or boundary between rock formation layer and rock formation layer 222. Transition plane 226 may extend along inclination angle 224 relative to vertical.

The terms "meshed" and "mesh analysis" may describe analytical procedures used to evaluate and study complex structures such as cutters, active and passive gages, other portions of a rotary drill bit, such as a sleeve, other downhole tools associated with drilling a wellbore, bottom hole configurations of a wellbore and/or other portions of a wellbore. The interior surface of end 62 of wellbore 60*a* may be finely meshed into many small segments or "mesh units" to assist with determining interactions between cutters and other portions of a rotary drill bit and adjacent formation materials as the rotary drill bit removes formation materials from end 62 to form wellbore 60. See FIG. 15D. The use of mesh units may be particularly helpful to analyze distributed forces and variations in cutting depth of respective small portions or small segments (sometimes referred to as "cutlets") of an associated cutter interact with adjacent formation materials.

Three dimensional mesh representations of the bottom of a wellbore and/or various portions of a rotary drill bit and/or other downhole tools may be used to simulate interactions between the rotary drill bit and adjacent portions of the wellbore. For example cutting depth and cutting area of each cutlet during a small time interval may be used to calculate forces acting on each cutting element. Simulation may then update the configuration or pattern of the associated bottom hole and forces acting on each cutter. For some applications the nominal configuration and size of a unit such as shown in FIG. 15D may be approximately 0.5 mm per side. However, the actual configuration size of each mesh unit may vary substantially due to complexities of associated bottom hole geometry and respective cutters used to remove formation materials.

Systems and methods incorporating teachings of the present disclosure may also be used to simulate or model forming a directional wellbore extending through various combinations of soft and medium strength formation with multiple hard stringers disposed within both soft and/or medium strength formations. Hard stones or concretions may be randomly distributed in one or more formation layers. Such formations may sometimes be referred to as "interbedded" formations. Simulations and associated calculations may be similar to simulations and calculations as described with respect to FIGS. 15A-15D.

Figure 15E:
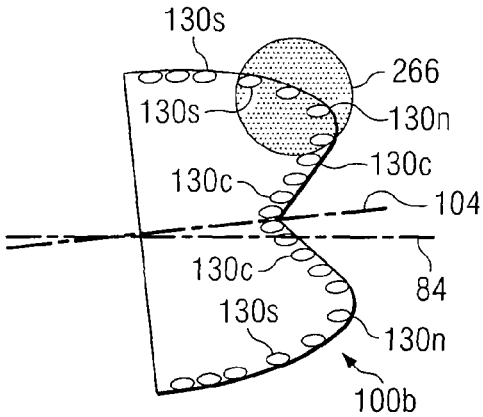
FIGS. 15E and 15F are schematic drawings in section showing effects on a fixed cutter drill bit encountering concretions or hard stones at a downhole location of a respective wellbore.
Figure 15F:
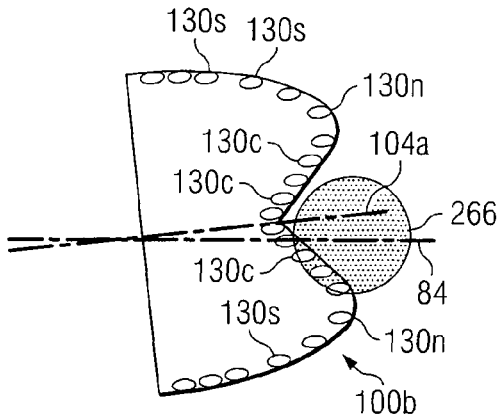

For embodiments such as shown in FIGS. 15E and 15F, portions of rotary drill 100*b* are shown engaged with concretion or hard stone 266 while forming an up angle from a generally horizontal wellbore. Simulations using methods such as shown in FIGS. 18A-18G have indicated that when hard stone 266 engages shoulder cutters 130*s* on the uphole side of the wellbore a relatively strong bit walk left force may be generated. Simulations using methods shown in FIGS. 18A-18G have also shown that when cutter cones 130*c* engage hard stone 266 as shown in FIG. 15F a relatively strong right bit walk force may be generated.

Figure 16C:
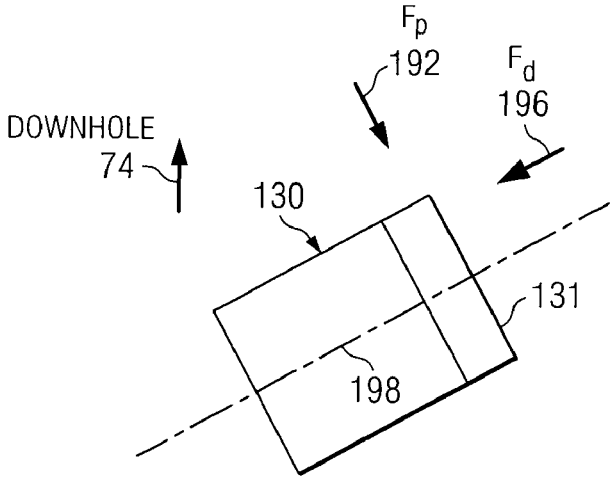
FIG. 16C is a schematic drawing showing forces acting on a cutter of a rotary drill bit in a cutter local coordinate system.

Spherical coordinate systems such as shown in FIGS. 16A-16C may be used to define the location of respective cutlets and/or mesh units of a rotary drill bit and adjacent portions of a wellbore. The location of each mesh unit of a rotary drill bit and associated wellbore may be represented by a single valued function of angle phi ($\phi$), angle theta ($\theta$) and radius rho ($\rho$) in three dimensions (3D) relative to Z axis 74. The same Z axis 74 may be used in a three dimensional Cartesian coordinate system or a three dimensional spherical coordinate system.

The location of a single point such as center 198 of cutter 130 may be defined in the three dimensional spherical coordinate system of FIG. 16A by angle $\phi$ and radius $\rho$. This same location may be converted to a Cartesian hole coordinate system of $X_h$, $Y_h$, $Z_h$ using radius r and angle theta ($\theta$) which corresponds with the angular orientation of radius r relative to X axis 76. Radius r intersects Z axis 74 at the same point radius $\rho$ intersects Z axis 74. Radius r is disposed in the same plane as Z axis 74 and radius $\rho$. Various examples of algorithms and/or matrices which may be used to transform data in a Cartesian coordinate system to a spherical coordinate system and to transform data in a spherical coordinate system to a Cartesian coordinate system are discussed later in this application.

As previously noted, a rotary drill bit may generally be described as having a "bit face profile" which includes a plurality of cutters operable to interact with adjacent portions of a wellbore to remove formation materials therefrom. Examples of a bit face profile and associated cutters are shown in FIGS. 2B, 4C, 5C, 6B, 8A-8C, 11, 12, 15A-15B, 15E and 15F. The cutting edge of each cutter on a rotary drill bit may be represented in three dimensions using either a Cartesian coordinate system or a spherical coordinate system.

FIGS. 16B and 16C show graphical representations of various forces associated with portions of cutter 130 interacting with adjacent portions of bottom hole 62 of wellbore 60. For examples such as shown in FIG. 16B cutter 130 may be located on the shoulder of an associated rotary drill bit.

FIGS. 16B and 16C also show one example of a local cutter coordinate system used at a respective time step or interval to evaluate or interpolate interaction between one cutter and adjacent portions of a wellbore. A local cutter coordinate system may more accurately interpolate complex bottom hole geometry and bit motion used to update a 3D simulation of a bottom hole geometry such as shown in FIG. 15D based on simulated interactions between a rotary drill bit and adjacent formation materials. Numerical algorithms and interpolations incorporating teachings of the present disclosure may more accurately calculate estimated cutting depth and cutting area of each cutter.

In a local cutter coordinate system there are two forces, drag force ($F_d$) and penetration force ($F_p$), acting on cutter 130 during interaction with adjacent portions of wellbore 60. When forces acting on each cutter 130 are projected into a bit coordinate system there will be three forces, axial force ($F_a$), drag force ($F_d$) and penetration force ($F_p$). The previously described forces may also act upon impact arrestors and gage cutters.

For purposes of simulating cutting or removing formation materials adjacent to end 62 of wellbore 60 as shown in FIG. 16B, cutter 130 may be divided into small elements or cutlets 131*a*, 131*b*, 131*c* and 131*d*. Forces represented by arrows $F_e$ may be simulated as acting on cutlets 131*a*-131*d* at respective points such as 191 and 200. For example, respective drag forces may be calculated for each cutlet 131*a*-131*d* acting at respective points such as 191 and 200. The respective drag forces may be summed or totaled to determine total drag force ($F_d$) acting on cutter 130. In a similar manner, respective penetration forces may also be calculated for each cutlet 131*a*-131*d* acting at respective points such as 191 and 200. The respective penetration forces may be summed or totaled to determine total penetration force ($F_p$) acting on cutter 130.

FIG. 16C shows cutter 130 in a local cutter coordinate system defined in part by cutter axis 198. Drag force ($F_d$) represented by arrow 196 corresponds with the summation of respective drag forces calculated for each cutlet 131*a*-131*d*. Penetration force ($F_p$) represented by arrow 192 corresponds with the summation of respective penetration forces calculated for each cutlet 131*a*-131*d*.

FIG. 17 shows portions of bottom hole 62 in a spherical hole coordinate system defined in part by Z axis 74 and radius $R_h$. The configuration of a bottom hole generally corresponds with the configuration of an associated bit face profile used to form the bottom hole. For example, portion 62*i* of bottom hole 62 may be formed by inner cutters 130*i*. Portion 62*s* of bottom hole 62 may be formed by shoulder cutters 130*s*.

Single point 200 as shown in FIG. 17 is located on the exterior of cutter 130*s*. In the hole coordinate system, the location of point 200 is a function of angle $\phi_h$ and radius $\rho_h$. FIG. 17 also shows the same single point 200 on the exterior of cutter 130*s* in a local cutter coordinate system defined by vertical axis $Z_c$ and radius $R_c$. In the local cutter coordinate system, the location of point 200 is a function of angle $\phi_c$ and radius $\rho_c$. Cutting depth 212 associated with single point 200 and associated removal of formation material from bottom hole 62 corresponds with the shortest distance between point 200 and portion 62*s* of bottom hole 62.

Simulating Straight Hole Drilling (Path B, Algorithm A)

The following algorithms may be used to simulate interaction between portions of a cutter and adjacent portions of a wellbore during removal of formation materials proximate the end of a straight hole segment. Respective portions of each cutter engaging adjacent formation materials may be referred to as cutlets. Note that in the following steps y axis represents the bit rotational axis. The x and z axes are determined using the right hand rule. Drill bit kinematics in straight hole drilling is fully defined by ROP and RPM.

Given ROP, RPM, current time t, dt, current cutlet position $(x_i, y_i, z_i)$ or $(\theta_i, \phi_i, \rho_i)$ (1) Cutlet position due to penetration along bit axis Y may be obtained $$x_p=x_i;\ y_p=y_i+rop*d_t;\ z_p=z_i$$

(2) Cutlet position due to bit rotation around the bit axis may be obtained as follows:

$$N_rot=\{0\ 1\ 0\}$$

Accompany matrix:

$$M_{rot}=\begin{matrix} 0 & -N_rot(3) & N_rot(2) \\ N_rot(3) & 9 & -N_rot(1) \\ -N_rot(2) & N_rot(1) & 0 \end{matrix}$$

The transform matrix is:

$$R_rot=\cos\omega tI+(1-\cos\omega t)N_rotN_rot'+\sin\omega tM_rot,$$

where I is 3×3 unit matrix and ω is bit rotation speed.

New cutlet position after bit rotation is:

$$\begin{matrix} x_{i+1} \\ y_{i+1} \\ z_{i+1} \end{matrix} = R_{rot}\begin{matrix} x_p \\ y_p \\ z_p \end{matrix}$$

(3) Calculate the cutting depth for each cutlet by comparing $(x_{i+1}, y_{i+}, z_{i+1})$ of this cutlet with hole coordinate $(x_h, y_h, z_h)$ where $X_h=x_{i+1}$ & $z_h=z_{i+1}$, and $d_p=Y_{i+1}-Y_h$.

(4) Calculate cutting area of this cutlet where cutlet cutting area=$d_p*d_r$ and $d_r$ is the width of this cutlet.

(5) Determine which formation layer is cut by this cutlet by comparing $y_{i+1}$ with hole coordinate $y_h$, if $y_{i+1}<y_h$ then layer A is cut. $y_h$ may be solved from the equation of the transition plane in Cartesian coordinate:

$$l(x_h-x_1)+m(y_h-y_1)+n(z_h-Z_1)=0$$

where $(x_1, y_1, z_1)$ is any point on the plane and {l,m,n} is normal direction of the transition plane.

(6) Save layer information, cutting depth and cutting area into 3D matrix at each time step for each cutlet for force calculation.

(7) Update the associated bottom hole matrix removed by the respective cutlets or cutters.

Simulating Kick Off Drilling (Path C)

The following algorithms may be used to simulate interaction between portions of a cutter and adjacent portions of a wellbore during removal of formation materials proximate the end of a kick off segment. Respective portions of each cutter engaging adjacent formation materials may be referred to as cutlets. Note that in the following steps, y axis is the bit axis, x and z are determined using the right hand rule. Drill bit kinematics in kick-off drilling is defined by at least four parameters: ROP, RPM, DLS and bend length.

Given ROP, RPM, DLS and bend length, $L_{bend}$, current time t, dt, current cutlet position $(x_i, y_i, z_i)$ or $(\theta_i, \phi_i, \rho_i)$ (1) Transform the current cutlet position to bend center:

$$x_i=x_i;$$

$$y_i=y_i-L_{bend}$$

$$z_i=z_i;$$

(2) New cutlet position due to tilt may be obtained by tilting the bit around vector N_tilt an angle γ:

$$N_tilt=\{\sin\alpha\ 0.0\ \cos\alpha\}$$

Accompany matrix:

$$M_{tilt}=\begin{matrix} 0 & -N_tilt(3) & N_tilt(2) \\ N_tilt(3) & 0 & -N_tilt(1) \\ -N_tilt(2) & N_tilt(1) & 0 \end{matrix}$$

The transform matrix is:

$$R_tilt=\cos\gamma I+(1-\cos\gamma)N_tiltN_tilt'+\sin\gamma M_tilt$$

where I is the 3×3 unit matrix.

New cutlet position after tilting is:

$$\begin{matrix} x_t \\ y_t \\ z_t \end{matrix} = R_{Tilt}\begin{matrix} x_i \\ y_i \\ z_i \end{matrix}$$

(3) Cutlet position due to bit rotation around the new bit axis may be obtained as follows:

$$N_rot=\{\sin\gamma\cos\theta\ \cos\gamma\sin\gamma\sin\theta\}$$

Accompany matrix:

$$M_{rot}=\begin{matrix} 0 & -N_rot(3) & N_rot(2) \\ N_rot(3) & 0 & -N_rot(1) \\ -N_rot(2) & N_rot(1) & 0 \end{matrix}$$

The transform matrix is:

$$R_rot=\cos\omega tI+(1-\cos\omega t)N_rotN_rot'+\sin\omega tM_rot,$$

I is 3×3 unit matrix and ω is bit rotation speed

New cutlet position after tilting is:

$$\begin{matrix} x_r \\ y_r \\ z_r \end{matrix} = R_{rot} \begin{matrix} x_t \\ y_t \\ z_t \end{matrix}$$

(4) Cutlet position due to penetration along new bit axis may be obtained $$d_p = rop \times dt;$$

$$x_{i+1} = x_r + d_p_x$$

$$y_{i+1} = y_r + d_p_y$$

$$z_{i+1} = z_r + d_p_z$$

With $d_p_x$, $d_p_y$ and $d_p_z$ being projection of $d_p$ on X, Y, Z.

(5) Transfer the calculated cutlet position after tilting, rotation and penetration into spherical coordinate and get ($\theta_{i+1}$, $\phi_{i+1}$, $\rho_{i+1}$)

(6) Determine which formation layer is cut by this cutlet by comparing $Y_{i+1}$ with hole coordinate $y_h$, if $y_{i+1} < y_h$ first layer is cut (this step is the same as Algorithm A).

(7) Calculate the cutting depth of each cutlet by comparing ($\theta_{i+1}$, $\phi_{i+1}$, $\rho_{i+1}$) of the cutlet and ($\theta_h$, $\phi_h$, $\rho_h$) of the hole where $\theta_h = \theta_{i+1}$ & $\phi_h = \phi_{i+1}$. Therefore $d_\rho = \rho_{i+1} - \rho_h$. It is usually difficult to find point on hole ($\theta_h$, $\phi_h$, $\rho_h$), an interpretation is used to get an approximate $\rho_h$:

$$\rho_h = \text{interp2}(\theta_h, \phi_h, \rho_h, \theta_{i+1}, \phi_{i+1})$$

where $\theta_h$, $\phi_h$, $\rho_h$ is sub-matrices representing a zone of the hole around the cutlet. Function interp2 is a MATLAB function using linear or non-linear interpolation method.

(8) Calculate the cutting area of each cutlet using $d\phi$, $d\rho$ in the plane defined by $\rho_i$, $\rho_{i+1}$. The cutlet cutting area is $$A = 0.5 * d\phi * (\rho_{i+1}\hat{}2 - (\rho_{i+1} - d\rho)\hat{}2)$$

(9) Save layer information, cutting depth and cutting area into 3D matrix at each time step for each cutlet for force calculation.

(10) Update the associated bottom hole matrix removed by the respective cutlets or cutters.

Simulating Equilibrium Drilling (Path D)

The following algorithms may be used to simulate interaction between portions of a cutter and adjacent portions of a wellbore during removal of formation materials in an equilibrium segment. Respective portions of each cutter engaging adjacent formation materials may be referred to as cutlets. Note that in the following steps, y represents the bit rotational axis. The x and z axes are determined using the right hand rule. Drill bit kinematics in equilibrium drilling is defined by at least three parameters: ROP, RPM and DLS.

Given ROP, RPM, DLS, current time t, selected time interval dt, current cutlet position ($x_i$, $y_i$, $z_i$) or ($\theta_i$, $\phi_i$, $\rho_i$), (1) Bit as a whole is rotating around a fixed point $O_w$, the radius of the well path is calculated by $$R = 5730 * 12 / DLS \quad \text{(inch)}$$

and angle $$\gamma = DLS * rop / 100.0 / 3600 \quad \text{(deg/sec)}$$

(2) The new cutlet position due to rotation $\gamma$ may be obtained as follows:

$$\text{Axis}: N_1 = \{0\ 0\ -1\}$$

Accompany matrix:

$$M_1 = \begin{matrix} 0 & -N_1(3) & N_1(2) \\ N_1(3) & 0 & -N_1(1) \\ -N_1(2) & N_1(1) & 0 \end{matrix}$$

The transform matrix is:

$$R_1 = \cos\gamma I + (1 - \cos\gamma) N_1 N_1' + \sin\gamma M1$$

where I is 3×3 unit matrix

New cutlet position after rotating around $O_w$ is:

$$\begin{matrix} x_t \\ y_t \\ z_t \end{matrix} = R_1 \begin{matrix} x_i \\ y_i \\ z_i \end{matrix}$$

(3) Cutlet position due to bit rotation around the new bit axis may be obtained as follows:

$$N_rot = \{\sin\gamma \cos\alpha \cos\gamma \sin\gamma \sin\alpha\}$$

where $\alpha$ is the azimuth angle of the well path

Accompany matrix:

$$M_{rot} = \begin{matrix} 0 & -N_rot(3) & N_rot(2) \\ N_rot(3) & 0 & -N_rot(1) \\ -N_rot(2) & N_rot(1) & 0 \end{matrix}$$

The transform matrix is:

$$R_rot = \cos\theta I + (1 - \cos\theta) N_rot N_rot' + \sin\theta M_rot,$$

where I is 3×3 unit matrix

New cutlet position after bit rotation is:

$$\begin{matrix} x_{i+1} \\ y_{i+1} \\ z_{i+1} \end{matrix} = R_{rot} \begin{matrix} x_t \\ y_t \\ z_t \end{matrix}$$

(4) Transfer the calculated cutlet position into spherical coordinate and get ($\theta_{i+1}$, $\phi_{i+1}$, $\rho_{i+1}$).

(5) Determine which formation layer is cut by this cutlet by comparing $y_{i+1}$ with hole coordinate $y_h$, if $y_{i+1} < y_h$ first layer is cut (this step is the same as Algorithm A).

(6) Calculate the cutting depth of each cutlet by comparing ($\theta_{i+1}$, $\phi_{i+1}$, $\rho_{i+1}$) of the cutlet and ($\theta_h$, $\phi_h$, $\rho_h$) of the hole where $\theta_h = \theta_{i+1}$ & $\phi_h = \phi_{i+1}$. Therefore $d_\rho = \rho_{i+1} - \rho_h$. It is usually difficult to find point on hole ($\theta_h$, $\phi_h$, $\rho_h$), an interpretation is used to get an approximate $\rho_h$:

$$\rho_h = \text{interp2}(\theta_h, \phi_h, \rho_h, \theta_{i+1}, \phi_{i+1})$$

where $\theta_h$, $\phi_h$, $\rho_h$ is sub-matrices representing a zone of the hole around the cutlet. Function interp2 is a MATLAB function using linear or non-linear interpolation method.

(7) Calculate the cutting area of each cutlet using $d\phi$, $d\rho$ in the plane defined by $\rho_i$, $\rho_{i+1}$. The cutlet cutting area is:

$$A = 0.5 * d\phi * (\rho_{i+1}\hat{}2 - (\rho_{i+1} - d\rho)\hat{}2)$$

(8) Save layer information, cutting depth and cutting area into 3D matrix at each time step for each cutlet for force calculation.

(9) Update the associated bottom hole matrix for portions removed by the respective cutlets or cutters.

An Alternative Algorithm to Calculate Cutting Area of A Cutter

The following steps may also be used to calculate or estimate the cutting area of the associated cutter. See FIGS. 16C and 17.

(1) Determine the location of cutter center $O_c$ at current time in a spherical hole coordinate system, see FIG. 17.

(2) Transform three matrices $\phi_H$, $\theta_H$ and $\rho_H$ to Cartesian coordinate in hole coordinate system and get $X_h$, $Y_h$ and $Z_h$;

(3) Move the origin of $X_h$, $Y_h$ and $Z_h$ to the cutter center $O_c$ located at ($\phi_c$, $\theta_c$ and $\rho_c$);

(4) Determine a possible cutting zone on portions of a bottom hole interacted by a respective cutlet for this cutter and subtract three sub-matrices from $X_h$, $Y_h$ and $Z_h$ to get $x_h$, $y_h$ and $z_h$;

(5) Transform $x_h$, $y_h$ and $z_h$ back to spherical coordinate and get $\phi_h$, $\theta_h$ and $\rho_h$ for this respective subzone on bottom hole;

(6) Calculate spherical coordinate of cutlet B: $\phi_B$, $\theta_B$ and $\rho_B$ in cutter local coordinate;

(7) Find the corresponding point C in matrices $\phi_h$, $\theta_h$ and $\rho_h$ with condition $\phi_C=\phi_B$ and $\theta_C=\theta_B$;

(8) If $\rho_B>\rho_C$, replacing $\rho_C$ with $\rho_B$ and matrix $\rho_h$ in cutter coordinate system is updated;

(9) Repeat the steps for all cutlets on this cutter;

(10) Calculate the cutting area of this cutter;

(11) Repeat steps 1-10 for all cutters;

(12) Transform hole matrices in local cutter coordinate back to hole coordinate system and repeat steps 1-12 for next time interval.

Force Calculations in Different Drilling Modes

The following algorithms may be used to estimate or calculate forces acting on all face cutters of a rotary drill bit.

(1) Summarize all cutlet cutting areas for each cutter and project the area to cutter face to get cutter cutting area, $A_c$ (2) Calculate the penetration force ($F_p$) and drag force ($F_d$) for each cutter using, for example, AMOCO Model (other models such as SDBS model, Shell model, Sandia Model may be used).

$$F_p=\sigma*A_c*(0.16*abs(\beta e)-1.15))$$

$$F_d=F_d*F_p+\sigma*A_c*(0.04*abs(\beta e)+0.8))$$

where $\sigma$ is rock strength, $\beta e$ is effective back rake angle and $F_d$ is drag coefficient (usually $F_d$=0.3)

(3) The force acting point M for this cutter is determined either by where the cutlet has maximal cutting depth or the middle cutlet of all cutlets of this cutter which are in cutting with the formation. The direction of $F_p$ is from point M to cutter face center $O_c$. $F_d$ is parallel to cutter axis. See for example FIGS. 16B and 16C.

For some applications a three dimensional (3D) model incorporating teachings of the present disclosure may be used to evaluate respective components of a rotary drill bit or other downtool to simulate forces acting on each component. Methods such as shown in FIGS. 18A-18G may separately calculate or estimate the effect of each component on bit walk rate, bit steerability and/or bit controllability for a given set of downhole drilling parameters. Various portions of a rotary drill bit may be designed and/or a rotary drill bit selected from existing bit designs for use in forming a wellbore based upon directional characteristics of respective components. Similar techniques may be used to design or select components of a BHA or other portions of a directional drilling system in accordance with teachings of the present disclosure.

Three dimensional (3D) simulation or modeling of forming a wellbore may begin at step 800. At step 802 the drilling mode, which will be used to simulate forming a respective segment of the simulated wellbore, may be selected from the group consisting of straight hole drilling, kick off drilling or equilibrium drilling. Additional drilling modes may also be used depending upon characteristics of associated downhole formations and capabilities of an associated drilling system.

At step 804*a* bit parameters such as rate of penetration and revolutions per minute may be inputted into the simulation if straight hole drilling was selected. If kickoff drilling was selected, data such as rate of penetration, revolutions per minute, dogleg severity, bend length and other characteristics of an associated BHA may be inputted into the simulation at step 804*b*. If equilibrium drilling was selected, parameters such as rate of penetration, revolutions per minute and dogleg severity may be inputted into the simulation at step 804*c*.

At steps 806, 808 and 810 various parameters associated with configuration and dimensions of a first rotary drill bit design and downhole drilling conditions may be input into the simulation. See Appendix A.

At step 812 parameters associated with each simulation, such as total simulation time, step time, mesh size of cutters, gages, blades and mesh size of adjacent portions of the wellbore in a spherical coordinate system may be inputted into the model. At step 814 the model may simulate one revolution of the associated drill bit around an associated bit axis without penetration of the rotary drill bit into the adjacent portions of the wellbore to calculate the initial (corresponding to time zero) hole spherical coordinates of all points of interest during the simulation. The location of each point in a hole spherical coordinate system may be transferred to a corresponding Cartesian coordinate system for purposes of providing a visual representation on a monitor and/or print out.

At step 816 the same spherical coordinate system may be used to calculate initial spherical coordinates for each cutlet of each cutter and each gage portions which will be used during the simulation.

At step 818 the simulation will proceed along one of three paths based upon the previously selected drilling mode. At step 820*a* the simulation will proceed along path A for straight hole drilling. At step 820*b* the simulation will proceed along path B for kick off hole drilling. At step 820*c* the simulation will proceed along path C for equilibrium hole drilling.

Steps 822, 824, 828, 830, 832 and 834 are substantially similar for straight hole drilling (Path A), kick off hole drilling (Path B) and equilibrium hole drilling (Path C). Therefore, only steps 822*a*, 824*a*, 828*a*, 830*a*, 832*a* and 834*a* will be discussed in more detail.

At step 822*a* a determination will be made concerning the current run time, the $\Delta T$ for each run and the total maximum amount of run time or simulation which will be conducted. At step 824*a* a run will be made for each cutlet and a count will be made for the total number of cutlets used to carry out the simulation.

At step 826*a* calculations will be made for the respective cutlet being evaluated during the current run with respect to penetration along the associated bit axis as a result of bit rotation during the corresponding time interval. The location of the respective cutlet will be determined in the Cartesian coordinate system corresponding with the time the amount of penetration was calculated. The information will be transferred from a corresponding hole coordinate system into a spherical coordinate system.

At step 828*a* the model will determine which layer of formation material has been cut by the respective cutlet. A calculation will be made of the cutting depth, cutting area of the respective cutlet and saved into respective matrices for rock layer, depth and area for use in force calculations.

At step 830*a* the hole matrices in the hole spherical coordinate system will be updated based on the previously calculated cutlet position at the corresponding time. At step 832*a* a determination will be made to determine if the current cutter count is less than or equal to the total number of cutlets which will be simulated. If the number of the current cutter is less than the total number, the simulation will return to step 824*a* and repeat steps 824*a* through 832*a*.

If the cutlet count at step 832*a* is equal to the total number of cutlets, the simulation will proceed to step 834*a*. If the current time is less than the total maximum time selected, the simulation will return to step 822*a* and repeat steps 822*a* through 834*a*. If the current time is equal to the previously selected total maximum amount of time, the simulation will proceed to steps 840 and 860.

Figure 18A:
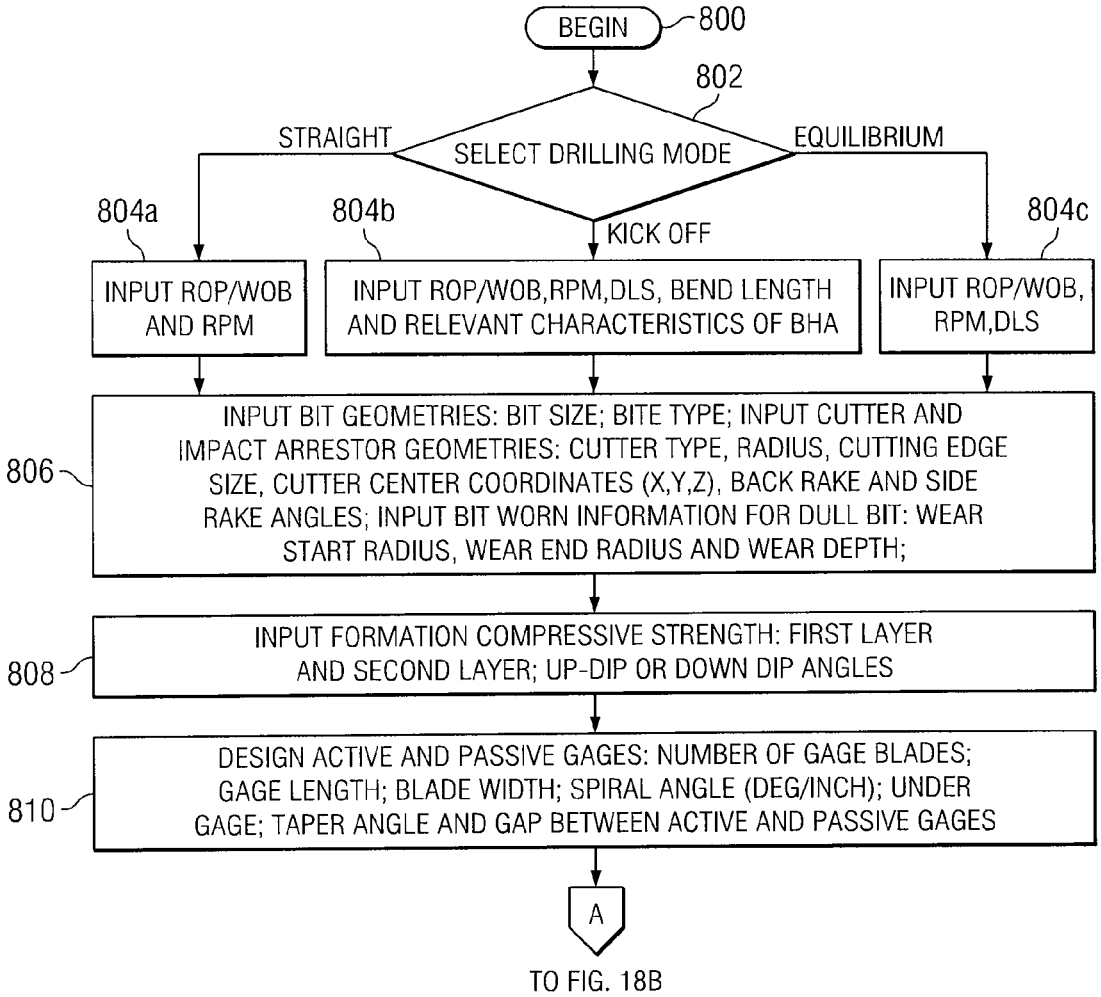
FIGS. 18A-18G is a block diagram showing one example of a method for simulating or modeling drilling of a directional wellbore using a rotary drill bit in accordance with teachings of the present disclosure.
Figure 18B:
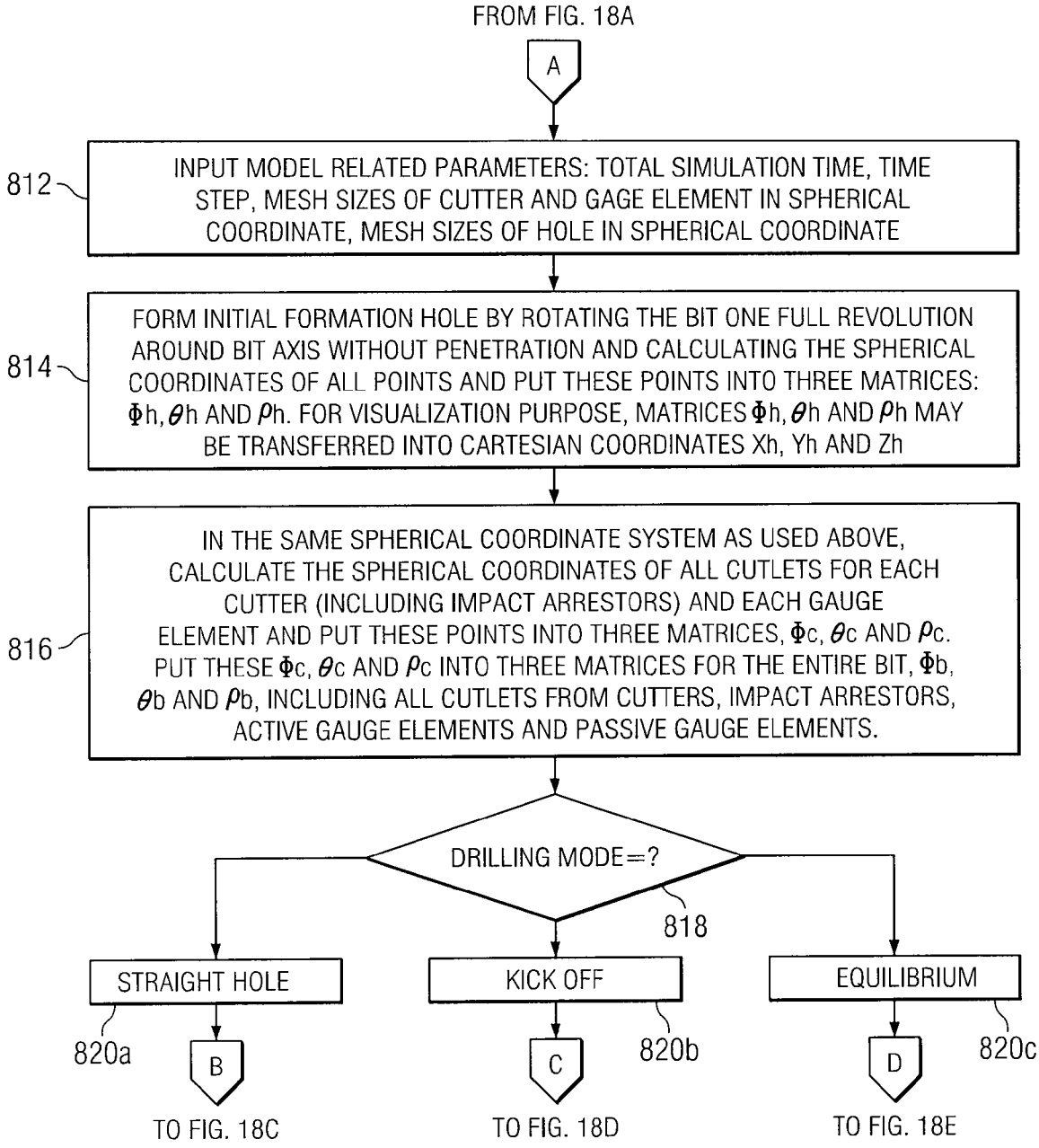
Figure 18C:
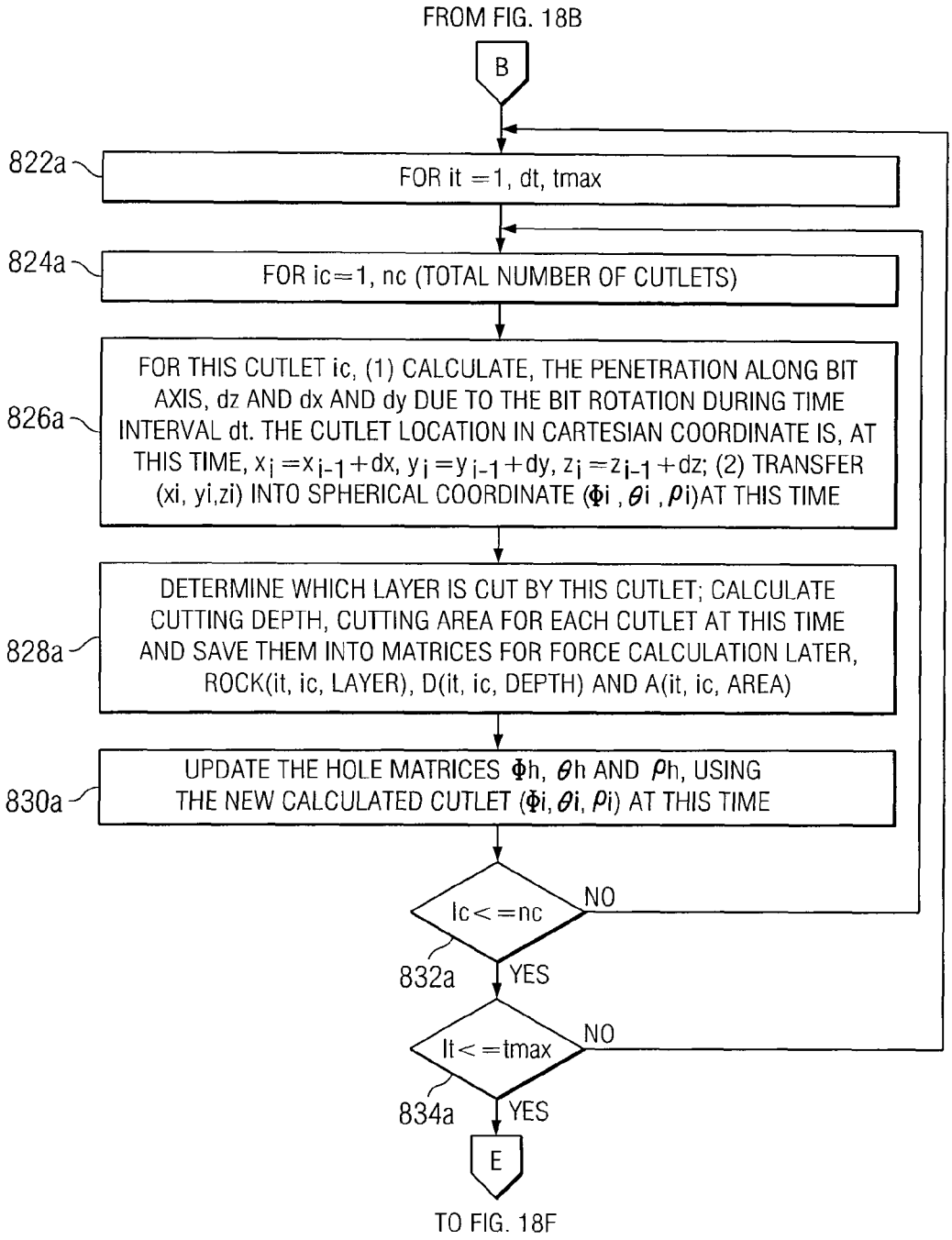
Figure 18D:
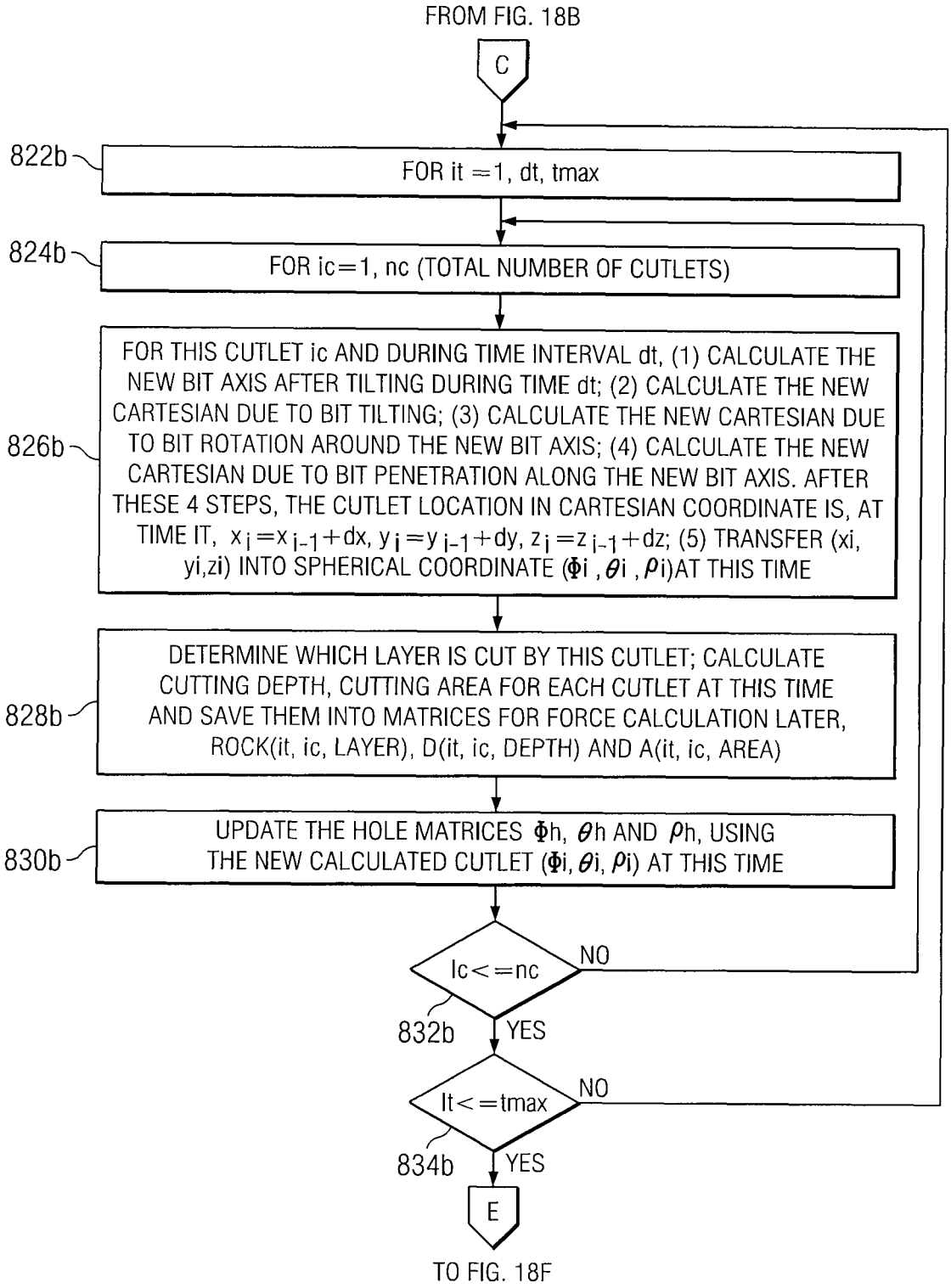

As previously noted, if a simulation proceeds along path C as shown in FIG. 18D corresponding with kick off hole drilling, the same steps will be performed as described with respect to path B for straight hole drilling except for step 826*b*. As shown in FIG. 18D, calculations will be made at step 826*b* corresponding with location and orientation of the new bit axis after tilting which occurred during respective time interval dt.

A calculation will be made for the new Cartesian coordinate system based upon bit tilting and due to bit rotation around the location of the new bit axis. A calculation will also be made for the new Cartesian coordinate system due to bit penetration along the new bit axis. After the new Cartesian coordinate systems have been calculated, the cutlet location in the Cartesian coordinate systems will be determined for the corresponding time interval. The information in the Cartesian coordinate time interval will then be transferred into the corresponding spherical coordinate system at the same time. Path C will then proceed through steps 828*b*, 830*b*, 832*b* and 834*b* as previously described with respect to path B.

Figure 18E:
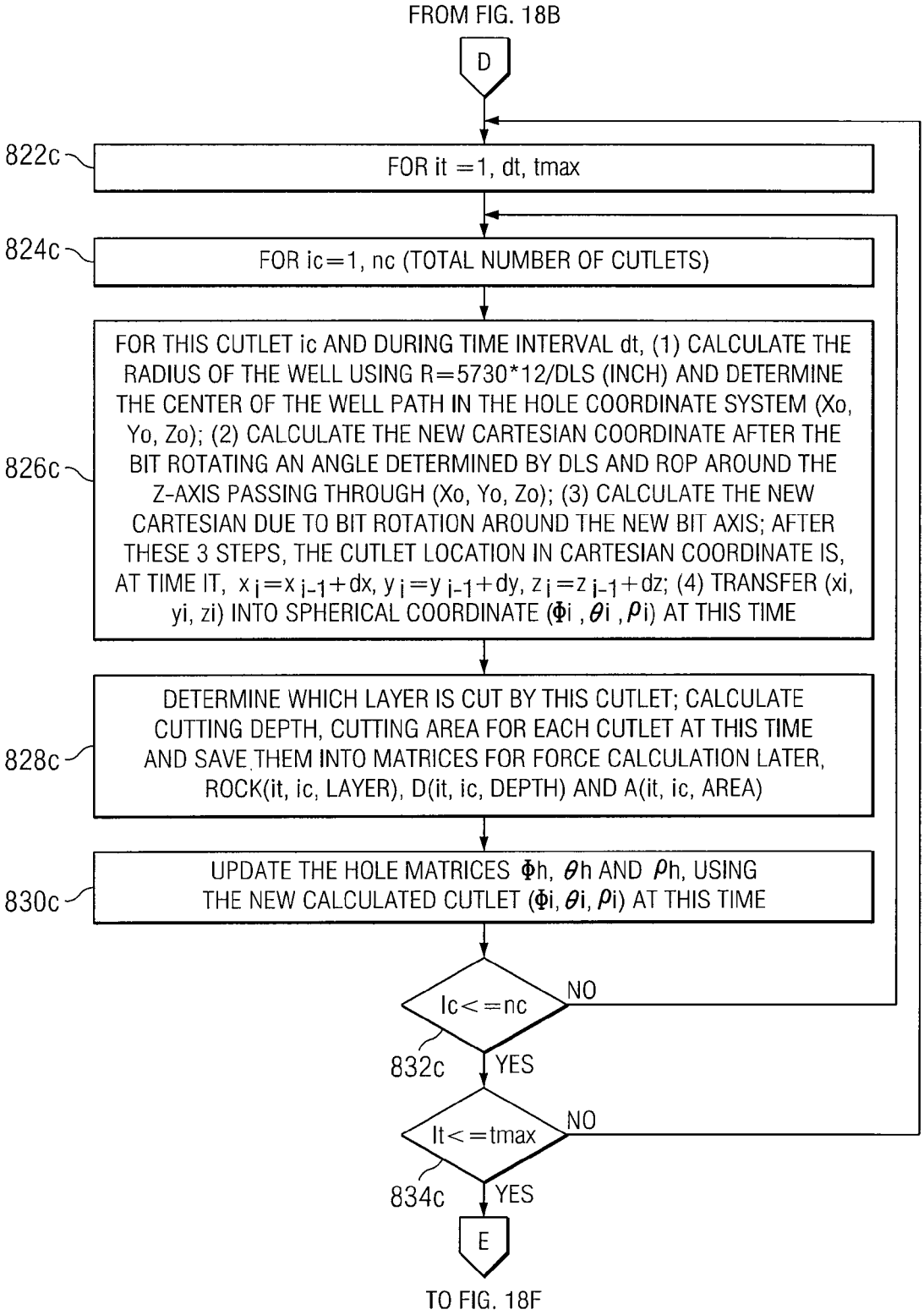
Figure 18F:
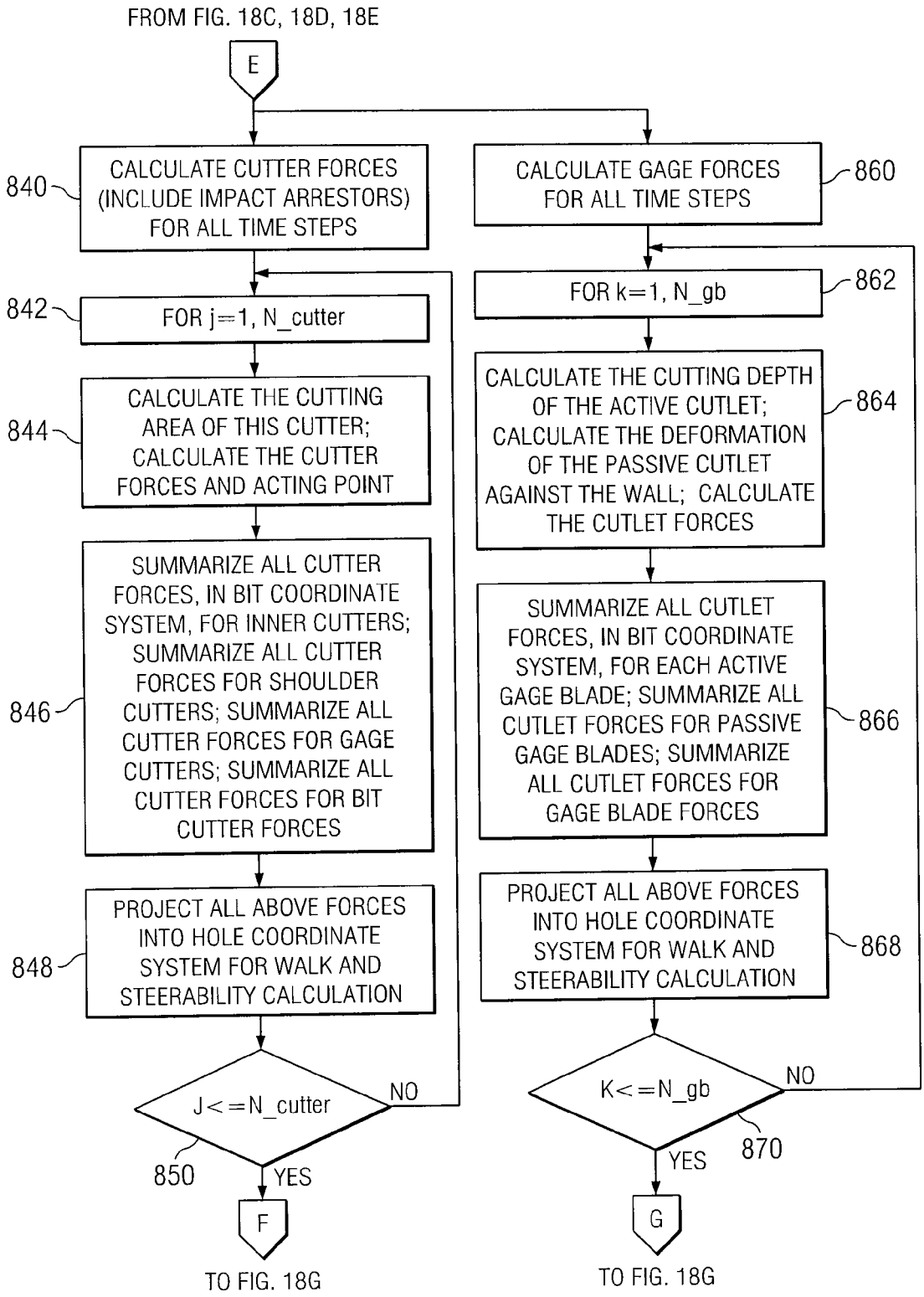
Figure 18G:
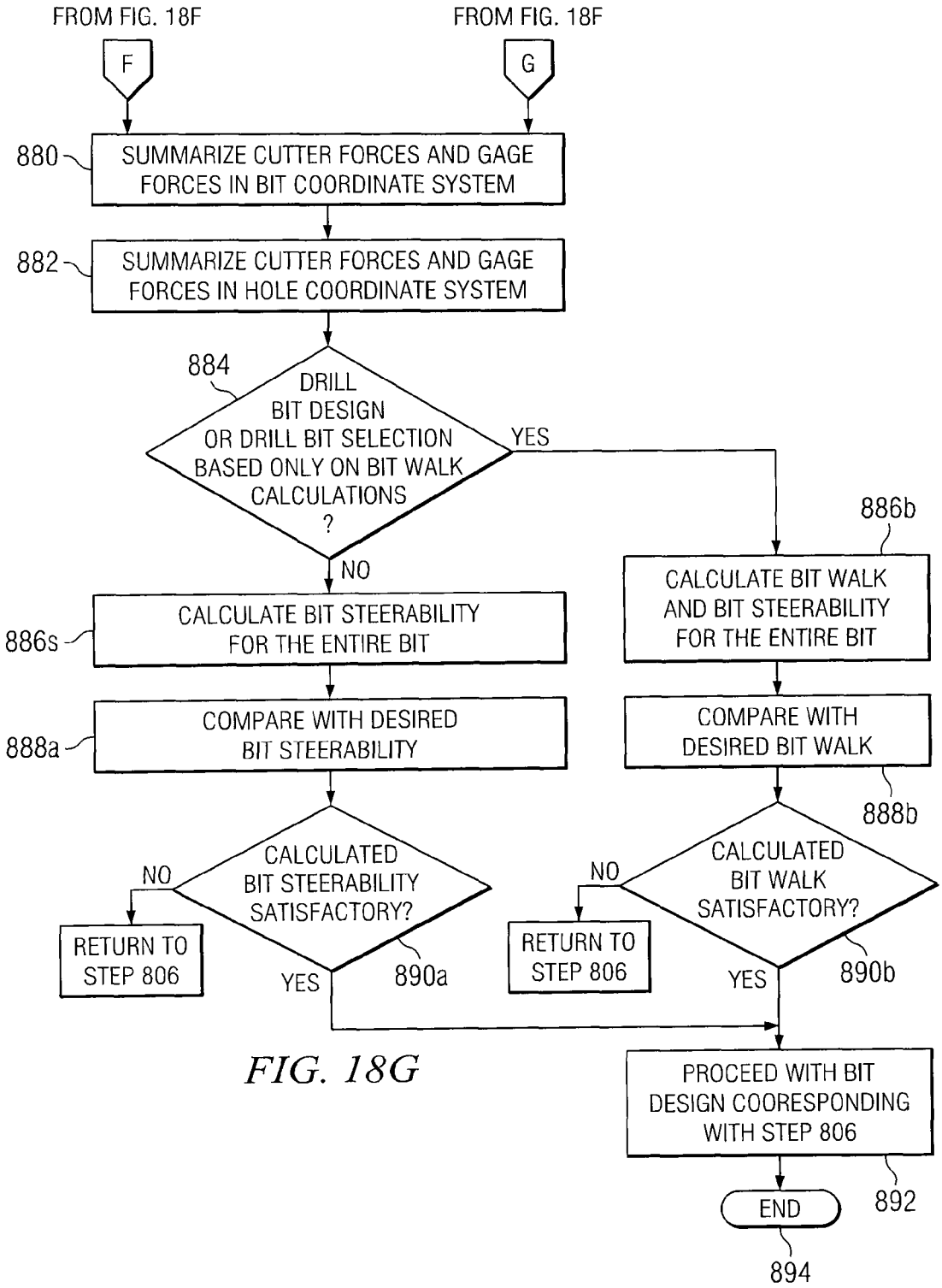

If equilibrium drilling is being simulated, the same functions will occur at steps 822*c* and 824*c* as previously described with respect to path B. For path D as shown in FIG. 18E, the simulation will proceed through steps 822*c* and 824*c* as previously described with respect to steps 822*a* and 824*a* of path B. At step 826*a* a calculation will be made for the respective cutlet during the respective time interval based upon the radius of the corresponding wellbore segment. A determination will be made based on the center of the path in a hole coordinate system. A new Cartesian coordinate system will be calculated after bit rotation has been entered based on the amount of DLS and rate of penetration along the Z axis passing through the hole coordinate system. A calculation of the new Cartesian coordinate system will be made due to bit rotation along the associated bit axis. After the above three calculations have been made, the location of a cutlet in the new Cartesian coordinate system will be determined for the appropriate time interval and transferred into the corresponding spherical coordinate system for the same time interval. Path D will continue to simulate equilibrium drilling using the same functions for steps 828*c*, 830*c*, 832*c* and 834*c* as previously described with respect to Path B straight hole drilling.

When selected path B, C or D has been completed at respective step 834*a*, 834*b* or 834*c* the simulation will then proceed to calculate cutter forces including impact arrestors for all step times at step 840 and will calculate associated gage forces for all step times at step 860. At step 842 a respective calculation of forces for a respective cutter will be started.

At step 844 the cutting area of the respective cutter is calculated. The total forces acting on the respective cutter and the acting point will be calculated.

At step 846 the sum of all the cutting forces in a bit coordinate system is summarized for the inner cutters and the shoulder cutters. The cutting forces for all active gage cutters may be summarized. At step 848 the previously calculated forces are projected into a hole coordinate system for use in calculating associated bit walk rate and steerability of the associated rotary drill bit.

At step 850 the simulation will determine if all cutters have been calculated. If the answer is NO, the model will return to step 842. If the answer is YES, the model will proceed to step 880.

At step 880 all cutter forces and all gage blade forces are summarized in a three dimensional bit coordinate system. At step 882 all forces are summarized into a hole coordinate system.

At step 884 a determination will be made concerning using only bit walk calculations or only bit steerability calculations. If bit walk rate calculations will be used, the simulation will proceed to step 886*b* and calculate bit steer force, bit walk force and bit walk rate for the entire bit. At step 888*b* the calculated bit walk rate will be compared with a desired bit walk rate. If the bit walk rate is satisfactory at step 890*b*, the simulation will end and the last inputted rotary drill bit design will be selected. If the calculated bit walk rate is not satisfactory, the simulation will return to step 806.

If the answer to the question at step 884 is NO, the simulation will proceed to step 886*a* and calculate bit steerability using associated bit forces in the hole coordinate system. At step 888*a* a comparison will be made between calculated steerability and desired bit steerability. At step 890*a* a decision will be made to determine if the calculated bit steerability is satisfactory. If the answer is YES, the simulation will end and the last inputted rotary drill bit design at step 806 will be selected. If the bit steerability calculated is not satisfactory, the simulation will return to step 806.

Although the present disclosure and its advantages have been described in detail, it should be understood that various changes, substitutions and alternations may be made herein without departing from the spirit and scope of the disclosure as defined by the following claims.

APPENDIX A

| EXAMPLES OF DRILLING EQUIPMENT DATA | | EXAMPLES OF WELLBORE | EXAMPLES OF FORMATION |
|---|---|---|---|
| Design Data | Operating Data | DATA | DATA |
| active gage | axial bit penetration rate | azimuth angle | compressive strength |
| bend (tilt) length | bit ROP | bottom hole configuration | down dip angle |
| bit face profile | bit rotational speed | bottom hole pressure | first layer |
| bit geometry | bit RPM | bottom hole temperature | formation plasticity |
| blade (length, number, spiral, width) | bit tilt rate | directional wellbore | formation strength |
| bottom hole assembly | equilibrium drilling | dogleg severity (DLS) | inclination |
| cutter (type, size, number) | kick off drilling | equilibrium section | lithology |
| cutter density | lateral | horizontal | number of |

APPENDIX A-continued

| | | | |
|---|---|---|---|
| | penetration rate | section | layers |
| cutter location (inner or cone, nose, shoulder) | rate of penetration (ROP) | inside diameter | porosity |
| cutter orientation (back rake, side rake) | revolutions per minute (RPM) | kick off section | rock pressure |
| cutting area | side penetration azimuth | profile | rock strength |
| cutting depth | side penetration rate | radius of curvature | second layer |
| cutting structures | steer force | side azimuth | shale plasticity |
| drill string | steer rate | side forces | up dip angle |
| fulcrum point | straight hole drilling | slant hole | |
| gage gap | tilt rate | straight hole | |
| gage length | tilt plane | tilt rate | |
| gage radius | tilt plane azimuth | tilting motion | |
| gage taper | torque on bit (TOB) | tilt plane azimuth angle | |
| IADC Bit Model | walk angle | trajectory | |
| impact arrestor (type, size, number) | walk rate | vertical section | |
| passive gage | weight on bit (WOB) | | |
| worn (dull) bit data | | | |

| EXAMPLES OF MODEL PARAMETERS FOR SIMULATING DRILLING A DIRECTIONAL WELLBORE |
|---|
| Mesh size for portions of downhole equipment interacting with adjacent portions of a wellbore. |
| Mesh size for portions of a wellbore. |
| Run time for each simulation step. |
| Total simulation run time. |
| Total number of revolutions of a rotary drill bit per simulation. |

What is claimed is:

1. A computer implemented method for determining bit walk characteristics of a rotary drill bit comprising:

applying a set of drilling conditions to the bit including a rate of penetration along a bit rotational axis, at least one characteristic of an earth formation, and at least one characteristic of a wellbore formed by the rotary drill bit;

applying a steer rate to the bit by tilting the bit relative to a fulcrum point located uphole from the bit;

simulating, for a time interval, drilling of the earth formation by the bit under the set of drilling conditions, including calculating a steer force applied to the bit, an associated walk force and an associated walk angle;

calculating a walk rate based at least on the steer force and the walk force;

repeating the simulating and the calculating the walk rate steps successively for a predefined number of time intervals;

calculating an average walk rate and an average walk angle for the bit over the simulated predefined number of time intervals; and outputting the calculated average walk rate and the average walk angle on a computer display and saving them in a computer file as determined bit walk characteristics of the rotary drill bit.

2. The method of claim 1 wherein applying the at least one characteristic of the wellbore further comprises comparing interior dimensions of the wellbore with exterior dimensions of the rotary drill bit and other downhole tools associated with the rotary drill bit.

3. The method of claim 1 wherein calculating the walk rate further comprises comparing an interior configuration of the wellbore with an exterior configuration of the rotary drill bit and other downhole tools associated with the rotary drill bit.

4. The method as defined in claim 1, further comprising calculating the walk rate of the bit at time t, by:

$$\text{Walk Rate}=(\text{Steer Rate}/\text{Steer Force})\times\text{Walk Force}.$$

5. The method of claim 1 further comprising:

determining a bit walk direction of the rotary drill bit by calculating the average walk rate over the predefined number of time intervals under the applied set of drilling conditions where at least a magnitude of the applied steer rate is not equal to zero; and determining the bit walk characteristics based on if the average walk rate is negative, the bit walks left, and if the average walk rate is positive, the bit walks right.

6. A computer implemented method to find and optimize bit operational parameters to control bit walk characteristics of a rotary drill bit during drilling of at least one portion of a directional wellbore comprising:

(a) determining a bit path for the at least one portion of the directional wellbore;

(b) determining a desired bit walk rate and a desired walk direction to compensate for the bit path;

(c) determining downhole formation properties at a first location and at a second location ahead of the first location in the at least one portion of the wellbore;

(d) simulating drilling the wellbore with the rotary drill bit between the first location and the second location, wherein simulating drilling includes predicting a wellbore inside diameter greater than bit size;

(e) during the simulation applying to the rotary drill bit a steer rate;

(f) calculating a walk rate and a walk direction of the rotary drill bit and comparing the calculated walk rate and walk direction with the desired walk rate and the desired walk direction;

(g) changing at least one set of the bit operational parameters;

(h) repeating steps (d) through (g) until the calculated walk rate and walk direction approximately equal the desired walk rate and the desired walk direction; and (i) outputting final bit operational parameters on a computer display and saving them in a computer file as optimized bit operational parameters.

7. The method of claim 6 further comprising simulating drilling the wellbore with a generally oval shaped configuration.

8. The method of claim 6 further comprising simulating drilling the wellbore with a generally non-symmetrical cross-section.

9. The method of claim 6 further comprising simulating drilling the wellbore with a generally elliptical cross-section.

10. The method of claim 6 further comprising simulating drilling the wellbore with a generally non-circular cross-section.

11. A computer implemented method for designing a rotary drill bit having an optimum gage pad geometry for a corresponding bit size, the method comprising:

(a) determining one or more formation properties for use in simulating drilling a wellbore with the bit;

(b) determining one or more drilling conditions for use in simulating drilling with the bit;

(c) simulating drilling using the one or more formation properties and the one or more drilling conditions, and wherein simulating drilling includes predicting the wellbore having at least one segment with a cross-section greater than the bit size;

(d) calculating a walk rate and a walk angle based on the simulated drilling;

(e) comparing the calculated walk rate and walk angle with a desired walk rate and a desired walk angle;

(f) if the calculated walk rate and the calculated walk angle are not approximately equal to the desired walk rate and the desired walk angle, changing at least one of the following parameters: number of gage pads, length of at least one gage pad and width of at least one gage pad;

(g) repeating steps (c) through (f) until the calculated walk rate and the calculated walk angle approximately equal the desired walk rate and the desired walk angle; and (h) outputting final number of gage pads, the length of the at least one gage pad and the width of the at least one gage pad as optimum gage pad geometry parameters on a computer display and saving them in a computer file.

12. The method of claim 11 further comprising simulating drilling the wellbore having a generally non-circular cross-section.

13. The method of claim 11 further comprising simulating drilling the wellbore having a generally oval cross-section.

14. The method of claim 11 further comprising simulating drilling the wellbore having a generally elliptical cross-section.

15. The method of claim 11 further comprising simulating drilling the wellbore having a generally non-symmetrical cross-section.

16. A computer implemented method to prevent an undesired bit walk while forming a directional wellbore with a fixed cutter rotary drill bit and an associated sleeve comprising:

applying a set of drilling conditions to the fixed cutter rotary drill bit including at least a bit rotational speed, a rate of penetration along a bit rotational axis or a bit axial force;

applying at least one characteristic of an earth formation and at least one characteristic of the directional wellbore formed by the fixed cutter rotary drill bit;

applying a steer rate to the fixed cutter rotary drill bit by tilting the bit relative to a fulcrum point used to direct the fixed cutter rotary drill bit to form the directional wellbore;

simulating, for a time interval, drilling the earth formation using the fixed cutter rotary drill bit under the set of drilling conditions, including calculating steer forces applied to the fixed cutter rotary drill bit and associated walk forces and walk angles;

calculating walk rates based at least on the steer forces and the walk forces;

repeating the simulating and the calculating the walk rates steps successively for a predefined number of time intervals;

calculating an average walk rate and an average walk angle of the bit over the simulated predefined number of time intervals;

if the simulations indicate undesired bit walk rates, modifying design of the sleeve including at least a length of the sleeve, a width of a sleeve pad and an aggressiveness of an uphole portion of the sleeve to reduce friction forces between uphole portions of the sleeve and adjacent portions of the wellbore when steering forces are applied to the fixed cutter rotary drill bit;

repeating the steps of the simulating, for a time interval, calculating walk rates, repeating the simulating for a predefined number of time intervals, calculating an average walk rate and an average walk angle and modifying design of the sleeve until the calculated average walk rate and the average walk angle indicate that bit walk characteristics of the fixed cutter rotary drill bit have been reduced to satisfactory values; and (h) outputting final average walk rate, average walk angle, at least the length of the sleeve, the width of the sleeve pad and the aggressiveness of the uphole portion of the sleeve on a computer display and saving them in a computer file.

17. The method of claim 16 further comprising manufacturing the fixed cutter rotary drill bit and the associated sleeve with design features that corresponded with the simulation having satisfactory bit walk characteristics.

18. A computer implemented method for determining bit walk characteristics of a rotary drill bit and an associated sleeve comprising:

specifying design of the sleeve including at least a length of the sleeve, a width of a sleeve pad and an aggressiveness of an uphole portion of the sleeve;

applying a set of drilling conditions to the bit including at least a bit rotational speed, a bit axial force, at least one characteristic of an earth formation, and a characteristic of a wellbore formed by the rotary drill bit;

applying a steer rate to the bit by tilting the bit around a fulcrum point located on the sleeve located above bit gage, wherein the fulcrum point is defined as a contact between exterior portion of the sleeve and adjacent portion of wellbore;

simulating, for a time interval, drilling of the earth formation by the bit under the set of drilling conditions, including calculating a steer force applied to the bit and an associated walk force;

calculating a walk rate based at least on the steer force and the walk force;

repeating the simulating successively for a predefined number of time intervals;

calculating an average walk rate as the walk characteristics of the bit over the simulated predefined number of time intervals; and outputting the calculated average walk rate and the specified design of the sleeve on a computer display and saving them in a computer file.

19. A computer implemented method for determining bit walk characteristic of a rotary drill bit while forming a directional wellbore in a soft downhole formation comprising:

applying a set of drilling conditions to the bit and associated downhole tools including at least a rate of penetration along a bit rotational axis and at least one characteristic of the soft downhole formation;

simulating, for a time interval, drilling of the soft downhole formation by the bit and the associated downhole tools under the set of drilling conditions, including calculating forces applied to the bit and the associated downhole tools;

calculating an average walk force and associated walk direction based at least on respective walk forces acting on two or more components of the bit and the associated downhole tools;

repeating the simulating for a predefined number of time intervals;

calculating an average walk force and an average walk direction for the bit and the associated downhole tools over the simulated predefined number of time intervals; and outputting the calculated average walk force and average walk direction on a computer display and saving them in a computer file as determined bit walk characteristics of the rotary drill bit.

20. The method of claim 19 further comprising simulating drilling of the soft downhole formation using a point-the-bit rotary steerable system with a sleeve extending from an uphole portion of the rotary drill bit.

21. The method of claim 19 wherein determining the bit walk characteristics further comprises:

determining respective three dimensional locations of all cutting edges of all cutting elements and all gage portions in a hole coordinate system;

determining respective interactions of all cutting edges of the cutting elements and gage portions with the soft downhole formation;

calculating a cutting depth for each cutting element;

calculating respective three dimensional forces of the cutting elements and projecting the forces into a hole coordinate system;

summing all of the forces projected in the hole coordinate system;

projecting the summed forces into a vertical tilting plane; and calculating a steer force in the vertical tilting plane and perpendicular to bit rotational axis.

22. The method of claim 19 further comprising:

calculating forces acting on an uphole portion of a sleeve; and modifying design of exterior portions of the sleeve to reduce forces acting thereon to provide desired bit walk characteristics for the bit and the associated downhole tools.

23. The method of claim 19 further comprising modifying aggressiveness of at least one gage pad disposed on exterior portions of a sleeve adjacent to an uphole end of the sleeve.

24. A computer implemented method for determining bit walk rate of a rotary drill bit having long gage pads comprising:

applying a set of drilling conditions to the bit including at least a bit rotational speed, a hole size and a rate of penetration along a bit rotational axis and at least one characteristic of an earth formation;

simulating, for a time interval, drilling of the earth formation by the bit under the set of drilling conditions, including calculating forces applied to the bit and walk rate characteristics of the bit having the long gage pads;

repeating the simulating successively for a predefined number of time intervals;

calculating an average walk rate characteristics of the bit over the simulated predefined number of time intervals; and modifying design parameters of the long gage pads;

repeating the simulating, calculating the average walk rate characteristics and modifying the design parameters of the long gage pad until the average walk rate characteristics correspond with desired walk characteristics for the bit; and outputting the calculated average walk rate characteristics and the modified design parameters of the long gage pads on a computer display and saving them in a computer file.

25. A computer implemented method to find and optimize design parameters to control bit walk characteristics of a rotary drill bit during drilling of at least one portion of a directional wellbore comprising:

(a) determining a bit path to form the at least one portion of the directional wellbore;

(b) determining downhole formation properties at a first location and a second location downhole from the first location in the at least one portion of the directional wellbore;

(c) simulating drilling the bit path with the rotary drill bit between the first location and the second location using a point-the-bit directional drilling system;

(d) calculating walk characteristics of the rotary drill bit when using the point-the-bit directional drilling system;

(e) simulating drilling the bit path with the rotary drill bit between the first location and the second location using a push-the-bit directional drilling system;

(f) calculating walk characteristics of the rotary drill bit when using the push-the-bit directional drilling system;

(g) comparing the walk characteristics of the rotary drill bit when using the point-the-bit directional drilling system and the walk characteristics of the rotary drill bit when using the push-the-bit directional drilling system against a desired walk characteristics;

(h) changing at least one of bit design parameters;

(i) repeating steps (b) through (h) until at least one of the two calculated walk characteristics approximately equal desired walk characteristics;

(j) selecting the push-the-bit directional drilling system or the point-the-bit directional drilling system and the design parameters of the rotary drill bit for use in forming the at least one portion of the directional wellbore; and (k) outputting the two calculated walk characteristics, corresponding final design parameters of the rotary drill bit and the selected directional drilling system on a computer display and saving them in a computer file.

26. A long gage rotary drill bit with a desired bit walk rate prepared by a process comprising:

(a) applying one or more drilling conditions and one or more formation characteristics of a formation to be drilled by the bit;

(b) simulating drilling at least one portion of a wellbore having a wellbore diameter greater than a bit diameter, using the one or more drilling conditions;

(c) calculating an average bit walk rate;

(d) comparing the calculated average bit walk rate to the desired bit walk rate;

(e) if the calculated average bit walk rate does not approximately equal the desired bit walk rate, performing the following steps:

(f) dividing a bit body into at least an inner zone, a shoulder zone, an active gage zone and a passive gage zone;

(g) calculating a walk rate of each zone;

(h) identifying a zone which has a maximal magnitude of the walk rate and a zone which has a minimal magnitude of the walk rate;

(i) modifying one or more structures within the zone which has the maximal magnitude of the walk rate or the zone which has the minimal magnitude of the walk rate;

(j) repeating steps (b) through (i) until the calculated average bit walk rate approximately equals the desired bit walk rate; and (k) manufacturing the long gage rotary drill bit based on parameters of the modified structures.

27. The rotary drill bit of claim 26, further comprising the rotary drill bit prepared by a process wherein calculating the average bit walk rate further comprises:

applying a set of drilling conditions to the bit including at least a bit rotational speed, a hole size and a rate of penetration along a bit rotational axis and at least one characteristic of an earth formation;

applying a steer rate to the bit, wherein applying the steer rate includes tilting the bit around a fulcrum point located at a top section of the bit gage;

simulating, for a time interval, drilling of the earth formation by the bit under the set of drilling conditions, including calculating a steer moment applied to the bit and an associated walk moment;

calculating a walk rate based on the bit steer rate, the steer moment, and the walk moment;

repeating the simulating and calculating the steer moment, the walk moment and walk rate successively for a predefined number of time intervals; and calculating the average bit walk rate using an average steer moment and an average walk moment over the simulated predefined number of time intervals.

28. A rotary drill bit having a gage and a corresponding bit size, prepared by a process comprising:

(a) determining one or more formation properties for use in simulating drilling with the bit;

(b) determining one or more drilling conditions for use in simulating drilling with the bit;

(c) simulating drilling using the one or more formation properties and the one or more drilling conditions, and wherein simulating drilling includes predicting a wellbore diameter greater than the bit size;

(d) calculating a walk rate based on the simulated drilling;

(e) comparing the calculated walk rate with a desired walk rate;

(f) if the calculated walk rate is not approximately equal to the desired walk rate, changing a bit geometry or changing a geometric parameter of the gage;

(g) repeating steps (c) through (f) until the calculated walk rate approximately equals the desired walk rate; and (h) manufacturing the rotary drill bit based on the changed bit geometry and geometric parameter of the gage.

* * * * *